US009949035B2

(12) United States Patent
Rucker et al.

(10) Patent No.: US 9,949,035 B2
(45) Date of Patent: Apr. 17, 2018

(54) TRANSDUCER DEVICES AND METHODS FOR HEARING

(71) Applicant: EARLENS CORPORATION, Redwood City, CA (US)

(72) Inventors: Paul Rucker, San Francisco, CA (US); Sunil Puria, Sunnyvale, CA (US); Jonathan Fay, San Mateo, CA (US); Micha Rosen, Mountain View, CA (US)

(73) Assignee: Earlens Corporation, Menlo Park, CA (US)

( * ) Notice: Subject to any disclaimer, the term of this patent is extended or adjusted under 35 U.S.C. 154(b) by 228 days.

(21) Appl. No.: 15/042,595

(22) Filed: Feb. 12, 2016

(65) Prior Publication Data

US 2016/0183017 A1 Jun. 23, 2016

Related U.S. Application Data

(63) Continuation of application No. 13/069,282, filed on Mar. 22, 2011, now abandoned, which is a (Continued)

(51) Int. Cl.
*H04R 25/02* (2006.01)
*H04R 11/02* (2006.01)

(Continued)

(52) U.S. Cl.
CPC ..... *H04R 11/02* (2013.01); *H04R 17/00* (2013.01); *H04R 23/008* (2013.01); *H04R 25/02* (2013.01);

(Continued)

(58) Field of Classification Search
CPC ..... H04R 25/00–25/75; H04R 25/60–25/608
See application file for complete search history.

(56) References Cited

U.S. PATENT DOCUMENTS 3,209,082 A 9/1965 McCarrell et al.
3,229,049 A 1/1966 Goldberg (Continued)

FOREIGN PATENT DOCUMENTS

AU 2004301961 A1 2/2005
DE 2044870 A1 3/1972

(Continued)

OTHER PUBLICATIONS

Carlile, et al. Frequency bandwidth and multi-talker environments. Audio Engineering Society Convention 120. Audio Engineering Society, May 20-23, 2006. Paris, France. 118: 8 pages.

(Continued)

*Primary Examiner* — Catherine B Kuhlman
(74) *Attorney, Agent, or Firm* — Wilson, Sonsini, Goodrich & Rosati

(57) ABSTRACT

A device to transmit an audio signal to a user may comprise a mass, a piezoelectric transducer, and a support to support the mass and the piezoelectric transducer with the eardrum. The piezoelectric transducer can be configured to drive the support and the eardrum with a first force and the mass with a second force opposite the first force. The device may comprise circuitry configured to receive wireless power and wireless transmission of an audio signal, and the circuitry can be supported with the eardrum to drive the transducer in response to the audio signal, such that vibration between the circuitry and the transducer can be decreased. The transducer can be positioned away from the umbo of the ear to drive the eardrum, for example on the lateral process of the malleus.

53 Claims, 37 Drawing Sheets

Related U.S. Application Data continuation of application No. PCT/US2009/057716, filed on Sep. 22, 2009.

(60) Provisional application No. 61/217,801, filed on Jun. 3, 2009, provisional application No. 61/139,526, filed on Dec. 19, 2008, provisional application No. 61/109,785, filed on Oct. 30, 2008, provisional application No. 61/099,087, filed on Sep. 22, 2008.

(51) Int. Cl.
*H04R 25/00* (2006.01)
*H04R 17/00* (2006.01)
*H04R 23/00* (2006.01)

(52) U.S. Cl.
CPC ..... *H04R 25/554* (2013.01); *H04R 25/606* (2013.01); *H04R 25/65* (2013.01); *H04R 25/652* (2013.01); *H04R 2225/025* (2013.01); *H04R 2460/09* (2013.01); *H04R 2460/13* (2013.01)

(56) References Cited

U.S. PATENT DOCUMENTS 3,440,314 A 4/1969 Eldon
3,549,818 A 12/1970 Turner
3,585,416 A 6/1971 Howard
3,594,514 A 7/1971 Robert
3,710,399 A 1/1973 Hurst
3,712,962 A 1/1973 Epley
3,764,748 A 10/1973 Branch et al.
3,808,179 A 4/1974 Gaylord
3,882,285 A 5/1975 Nunley et al.
3,965,430 A 6/1976 Brandt
3,985,977 A 10/1976 Beaty et al.
4,002,897 A 1/1977 Kleinman et al.
4,031,318 A 6/1977 Pitre
4,061,972 A 12/1977 Burgess
4,075,042 A 2/1978 Das
4,098,277 A 7/1978 Mendell
4,109,116 A 8/1978 Victoreen
4,120,570 A 10/1978 Gaylord
4,248,899 A 2/1981 Lyon et al.
4,252,440 A 2/1981 Frosch et al.
4,303,772 A 12/1981 Novicky
4,319,359 A 3/1982 Wolf
4,334,315 A 6/1982 Ono et al.
4,334,321 A 6/1982 Edelman
4,338,929 A 7/1982 Lundin et al.
4,339,954 A 7/1982 Anson et al.
4,357,497 A 11/1982 Hochmair et al.
4,380,689 A 4/1983 Giannetti
4,428,377 A 1/1984 Zollner et al.
4,524,294 A 6/1985 Brody
4,540,761 A 9/1985 Kawamura et al.
4,556,122 A 12/1985 Goode
4,592,087 A 5/1986 Killion et al.
4,606,329 A 8/1986 Hough
4,611,598 A 9/1986 Hortmann et al.
4,628,907 A 12/1986 Epley
4,641,377 A 2/1987 Rush et al.
4,654,554 A 3/1987 Kishi
4,689,819 A 8/1987 Killion et al.
4,696,287 A 9/1987 Hortmann et al.
4,729,366 A 3/1988 Schaefer
4,741,339 A 5/1988 Harrison et al.
4,742,499 A 5/1988 Butler
4,756,312 A 7/1988 Epley
4,759,070 A 7/1988 Voroba et al.
4,766,607 A 8/1988 Feldman
4,774,933 A 10/1988 Hough et al.
4,776,322 A 10/1988 Hough et al.
4,782,818 A 11/1988 Mori
4,800,884 A 1/1989 Heide et al.
4,800,982 A 1/1989 Carlson
4,817,607 A 4/1989 Tatge
4,840,178 A 6/1989 Heide et al.
4,845,755 A 7/1989 Busch et al.
4,865,035 A 9/1989 Mori
4,870,688 A 9/1989 Voroba et al.
4,932,405 A 6/1990 Peeters et al.
4,936,305 A 6/1990 Ashtiani et al.
4,944,301 A 7/1990 Widin et al.
4,948,855 A 8/1990 Novicky
4,957,478 A 9/1990 Maniglia
4,963,963 A 10/1990 Dorman
4,999,819 A 3/1991 Newnham et al.
5,003,608 A 3/1991 Carlson
5,012,520 A 4/1991 Steeger
5,015,224 A 5/1991 Maniglia
5,015,225 A 5/1991 Hough et al.
5,031,219 A 7/1991 Ward et al.
5,061,282 A 10/1991 Jacobs
5,066,091 A 11/1991 Stoy et al.
5,068,902 A 11/1991 Ward
5,094,108 A 3/1992 Kim et al.
5,117,461 A 5/1992 Moseley
5,142,186 A 8/1992 Cross et al.
5,163,957 A 11/1992 Sade et al.
5,167,235 A 12/1992 Seacord et al.
5,201,007 A 4/1993 Ward et al.
5,259,032 A 11/1993 Perkins et al.
5,272,757 A 12/1993 Scofield et al.
5,276,910 A 1/1994 Buchele
5,277,694 A 1/1994 Leysieffer et al.
5,282,858 A 2/1994 Bisch et al.
5,360,388 A 11/1994 Spindel et al.
5,378,933 A 1/1995 Pfannenmueller et al.
5,402,496 A 3/1995 Soli et al.
5,411,467 A 5/1995 Hortmann et al.
5,425,104 A 6/1995 Shennib
5,440,082 A 8/1995 Claes
5,440,237 A 8/1995 Brown et al.
5,455,994 A 10/1995 Termeer et al.
5,456,654 A 10/1995 Ball
5,531,787 A 7/1996 Lesinski et al.
5,531,954 A 7/1996 Heide et al.
5,535,282 A 7/1996 Luca
5,554,096 A 9/1996 Ball
5,558,618 A 9/1996 Maniglia
5,572,594 A 11/1996 Devoe et al.
5,606,621 A 2/1997 Reiter et al.
5,624,376 A 4/1997 Ball et al.
5,654,530 A 8/1997 Sauer et al.
5,692,059 A 11/1997 Kruger
5,699,809 A 12/1997 Combs et al.
5,701,348 A 12/1997 Shennib et al.
5,707,338 A 1/1998 Adams et al.
5,715,321 A 2/1998 Andrea et al.
5,721,783 A 2/1998 Anderson
5,722,411 A 3/1998 Suzuki et al.
5,729,077 A 3/1998 Newnham et al.
5,740,258 A 4/1998 Goodwin-Johansson
5,749,912 A 5/1998 Zhang et al.
5,762,583 A 6/1998 Adams et al.
5,772,575 A 6/1998 Lesinski et al.
5,774,259 A 6/1998 Saitoh et al.
5,782,744 A 7/1998 Money
5,788,711 A 8/1998 Lehner et al.
5,795,287 A 8/1998 Ball et al.
5,797,834 A 8/1998 Goode
5,800,336 A 9/1998 Ball et al.
5,804,109 A 9/1998 Perkins
5,804,907 A 9/1998 Park et al.
5,814,095 A 9/1998 Mueller et al.
5,825,122 A 10/1998 Givargizov et al.
5,836,863 A 11/1998 Bushek et al.
5,842,967 A 12/1998 Kroll
5,857,958 A 1/1999 Ball et al.
5,859,916 A 1/1999 Ball et al.
5,868,682 A 2/1999 Combs et al.
5,879,283 A 3/1999 Adams et al.
5,888,187 A 3/1999 Jaeger et al.

(56) References Cited

U.S. PATENT DOCUMENTS 5,897,486 A 4/1999 Ball et al.
5,899,847 A 5/1999 Adams et al.
5,900,274 A 5/1999 Chatterjee et al.
5,906,635 A 5/1999 Maniglia
5,913,815 A 6/1999 Ball et al.
5,922,077 A 7/1999 Espy et al.
5,940,519 A 8/1999 Kuo
5,949,895 A 9/1999 Ball et al.
5,984,859 A 11/1999 Lesinski
5,987,146 A 11/1999 Pluvinage et al.
6,005,955 A 12/1999 Kroll et al.
6,024,717 A 2/2000 Ball et al.
6,045,528 A 4/2000 Arenberg et al.
6,050,933 A 4/2000 Bushek et al.
6,068,589 A 5/2000 Neukermans
6,068,590 A 5/2000 Brisken
6,084,975 A 7/2000 Perkins
6,093,144 A 7/2000 Jaeger et al.
6,135,612 A 10/2000 Clore
6,137,889 A 10/2000 Shennib et al.
6,139,488 A 10/2000 Ball
6,153,966 A 11/2000 Neukermans
6,174,278 B1 1/2001 Jaeger et al.
6,181,801 B1 1/2001 Puthuff et al.
6,190,305 B1 2/2001 Ball et al.
6,190,306 B1 2/2001 Kennedy
6,208,445 B1 3/2001 Reime
6,217,508 B1 4/2001 Ball et al.
6,222,302 B1 4/2001 Imada et al.
6,222,927 B1 4/2001 Feng et al.
6,240,192 B1 5/2001 Brennan et al.
6,241,767 B1 6/2001 Stennert et al.
6,259,951 B1 7/2001 Kuzma et al.
6,261,224 B1 7/2001 Adams et al.
6,264,603 B1 7/2001 Kennedy
6,277,148 B1 8/2001 Dormer
6,312,959 B1 11/2001 Datskos
6,339,648 B1 1/2002 McIntosh et al.
6,354,990 B1 3/2002 Juneau et al.
6,359,993 B2 3/2002 Brimhall
6,366,863 B1 4/2002 Bye et al.
6,385,363 B1 5/2002 Rajic et al.
6,387,039 B1 5/2002 Moses
6,393,130 B1 5/2002 Stonikas et al.
6,422,991 B1 7/2002 Jaeger
6,432,248 B1 8/2002 Popp et al.
6,436,028 B1 8/2002 Dormer
6,438,244 B1 8/2002 Juneau et al.
6,445,799 B1 9/2002 Taenzer et al.
6,473,512 B1 10/2002 Juneau et al.
6,475,134 B1 11/2002 Ball et al.
6,491,644 B1 12/2002 Vujanic et al.
6,493,453 B1 12/2002 Glendon
6,493,454 B1 12/2002 Loi et al.
6,498,858 B2 12/2002 Kates
6,519,376 B2 2/2003 Biagi et al.
6,536,530 B2 3/2003 Schultz et al.
6,537,200 B2 3/2003 Leysieffer et al.
6,549,633 B1 4/2003 Westermann
6,549,635 B1 4/2003 Gebert
6,554,761 B1 4/2003 Puria et al.
6,575,894 B2 6/2003 Leysieffer et al.
6,592,513 B1 7/2003 Kroll et al.
6,603,860 B1 8/2003 Taenzer et al.
6,620,110 B2 9/2003 Schmid
6,626,822 B1 9/2003 Jaeger et al.
6,629,922 B1 10/2003 Puria et al.
6,631,196 B1 10/2003 Taenzer et al.
6,663,575 B2 12/2003 Leysieffer
6,668,062 B1 12/2003 Luo et al.
6,676,592 B2 1/2004 Ball et al.
6,681,022 B1 1/2004 Puthuff et al.
6,695,943 B2 2/2004 Juneau et al.
6,724,902 B1 4/2004 Shennib et al.
6,726,618 B2 4/2004 Miller
6,726,718 B1 4/2004 Carlyle et al.
6,727,789 B2 4/2004 Tibbetts et al.
6,728,024 B2 4/2004 Ribak
6,735,318 B2 5/2004 Cho
6,754,358 B1 6/2004 Boesen et al.
6,754,359 B1 6/2004 Svean et al.
6,754,537 B1 6/2004 Harrison et al.
6,785,394 B1 8/2004 Olsen et al.
6,801,629 B2 10/2004 Brimhall et al.
6,829,363 B2 12/2004 Sacha
6,837,857 B2 1/2005 Stirnemann
6,842,647 B1 1/2005 Griffith et al.
6,888,949 B1 5/2005 Vanden et al.
6,900,926 B2 5/2005 Ribak
6,912,289 B2 6/2005 Vonlanthen et al.
6,920,340 B2 7/2005 Laderman
6,931,231 B1 8/2005 Griffin
6,940,988 B1 9/2005 Shennib et al.
6,940,989 B1 9/2005 Shennib et al.
D512,979 S 12/2005 Corcoran et al.
6,975,402 B2 12/2005 Bisson et al.
6,978,159 B2 12/2005 Feng et al.
7,043,037 B2 5/2006 Lichtblau et al.
7,050,675 B2 5/2006 Zhou et al.
7,050,876 B1 5/2006 Fu et al.
7,057,256 B2 6/2006 Mazur et al.
7,058,182 B2 6/2006 Kates
7,072,475 B1 7/2006 Denap et al.
7,076,076 B2 7/2006 Bauman
7,095,981 B1 8/2006 Voroba et al.
7,167,572 B1 1/2007 Harrison et al.
7,174,026 B2 2/2007 Niederdrank et al.
7,203,331 B2 4/2007 Boesen
7,239,069 B2 7/2007 Cho
7,245,732 B2 7/2007 Jorgensen et al.
7,255,457 B2 8/2007 Ducharme et al.
7,266,208 B2 9/2007 Charvin et al.
7,289,639 B2 10/2007 Abel et al.
7,313,245 B1 12/2007 Shennib
7,322,930 B2 1/2008 Jaeger et al.
7,349,741 B2 3/2008 Maltan et al.
7,354,792 B2 4/2008 Mazur et al.
7,376,563 B2 5/2008 Leysieffer et al.
7,390,689 B2 6/2008 Mazur et al.
7,394,909 B1 7/2008 Widmer et al.
7,421,087 B2 9/2008 Perkins et al.
7,424,122 B2 9/2008 Ryan
7,444,877 B2 11/2008 Li et al.
7,547,275 B2 6/2009 Cho et al.
7,630,646 B2 12/2009 Anderson et al.
7,668,325 B2 2/2010 Puria et al.
7,747,295 B2 6/2010 Choi
7,826,632 B2 11/2010 Von et al.
7,867,160 B2 1/2011 Pluvinage et al.
8,090,134 B2 1/2012 Takigawa et al.
8,197,461 B1 6/2012 Arenberg et al.
8,233,651 B1 7/2012 Haller
8,295,505 B2 10/2012 Weinans et al.
8,295,523 B2 10/2012 Fay et al.
8,320,601 B2 11/2012 Takigawa et al.
8,340,335 B1 12/2012 Shennib
8,391,527 B2 3/2013 Feucht et al.
8,396,239 B2 3/2013 Fay et al.
8,401,212 B2 3/2013 Puria et al.
8,506,473 B2 8/2013 Puria
8,526,651 B2 9/2013 van Hal et al.
8,545,383 B2 10/2013 Wenzel, I et al.
8,600,089 B2 12/2013 Wenzel et al.
8,696,054 B2 4/2014 Crum
8,696,541 B2 4/2014 Pluvinage et al.
8,715,152 B2 5/2014 Puria et al.
8,715,153 B2 5/2014 Puria et al.
8,715,154 B2 5/2014 Perkins et al.
8,761,423 B2 6/2014 Wagner et al.
8,824,715 B2 9/2014 Fay et al.
8,855,323 B2 10/2014 Kroman
8,858,419 B2 10/2014 Puria et al.
8,885,860 B2 11/2014 Djalilian et al.
9,049,528 B2 6/2015 Fay et al.

(56) References Cited

U.S. PATENT DOCUMENTS 9,154,891 B2 10/2015 Puria et al.
9,211,069 B2 12/2015 Larsen et al.
9,226,083 B2 12/2015 Puria et al.
9,591,409 B2 3/2017 Puria et al.
2001/0003788 A1 6/2001 Ball et al.
2001/0007050 A1 7/2001 Adelman
2001/0024507 A1 9/2001 Boesen
2001/0027342 A1 10/2001 Dormer
2001/0043708 A1 11/2001 Brimhall
2001/0053871 A1 12/2001 Zilberman et al.
2002/0012438 A1 1/2002 Leysieffer et al.
2002/0029070 A1 3/2002 Leysieffer et al.
2002/0030871 A1 3/2002 Anderson et al.
2002/0035309 A1 3/2002 Leysieffer
2002/0085728 A1 7/2002 Shennib et al.
2002/0086715 A1 7/2002 Sahagen
2002/0172350 A1 11/2002 Edwards et al.
2002/0183587 A1 12/2002 Dormer
2003/0021903 A1 1/2003 Shlenker et al.
2003/0064746 A1 4/2003 Rader et al.
2003/0081803 A1 5/2003 Petilli et al.
2003/0097178 A1 5/2003 Roberson et al.
2003/0125602 A1 7/2003 Sokolich et al.
2003/0142841 A1 7/2003 Wiegand
2003/0208099 A1 11/2003 Ball
2003/0208888 A1 11/2003 Fearing et al.
2004/0019294 A1 1/2004 Stirnemann
2004/0165742 A1 8/2004 Shennib et al.
2004/0166495 A1 8/2004 Greinwald et al.
2004/0167377 A1 8/2004 Schafer et al.
2004/0184732 A1 9/2004 Zhou et al.
2004/0202339 A1 10/2004 O'Brien, Jr. et al.
2004/0202340 A1 10/2004 Armstrong et al.
2004/0208333 A1 10/2004 Cheung et al.
2004/0234089 A1 11/2004 Rembrand et al.
2004/0234092 A1 11/2004 Wada et al.
2004/0236416 A1 11/2004 Falotico
2004/0240691 A1 12/2004 Grafenberg
2005/0018859 A1 1/2005 Buchholz
2005/0020873 A1 1/2005 Berrang et al.
2005/0036639 A1 2/2005 Bachler et al.
2005/0038498 A1 2/2005 Dubrow et al.
2005/0088435 A1 4/2005 Geng
2005/0101830 A1 5/2005 Easter et al.
2005/0163333 A1 7/2005 Abel et al.
2005/0226446 A1 10/2005 Luo et al.
2005/0271870 A1 12/2005 Jackson
2006/0023908 A1 2/2006 Perkins et al.
2006/0058573 A1 3/2006 Neisz et al.
2006/0062420 A1 3/2006 Araki
2006/0074159 A1 4/2006 Lu et al.
2006/0075175 A1 4/2006 Jensen et al.
2006/0107744 A1 5/2006 Li et al.
2006/0161255 A1 7/2006 Zarowski et al.
2006/0177079 A1 8/2006 Baekgaard et al.
2006/0183965 A1 8/2006 Kasic et al.
2006/0189841 A1 8/2006 Pluvinage et al.
2006/0231914 A1 10/2006 Carey
2006/0233398 A1 10/2006 Husung
2006/0237126 A1 10/2006 Guffrey et al.
2006/0247735 A1 11/2006 Honert et al.
2006/0251278 A1 11/2006 Puria et al.
2006/0278245 A1 12/2006 Gan
2007/0030990 A1 2/2007 Fischer
2007/0036377 A1 2/2007 Stirnemann
2007/0076913 A1 4/2007 Schanz
2007/0083078 A1 4/2007 Easter et al.
2007/0100197 A1 5/2007 Perkins et al.
2007/0127748 A1 6/2007 Carlile et al.
2007/0127752 A1 6/2007 Armstrong
2007/0127766 A1 6/2007 Combest
2007/0135870 A1 6/2007 Shanks et al.
2007/0161848 A1 7/2007 Dalton et al.
2007/0191673 A1 8/2007 Ball et al.
2007/0206825 A1 9/2007 Thomasson
2007/0225776 A1 9/2007 Fritsch et al.
2007/0236704 A1 10/2007 Carr et al.
2007/0250119 A1 10/2007 Tyler et al.
2007/0251082 A1 11/2007 Milojevic et al.
2007/0286429 A1 12/2007 Grafenberg et al.
2008/0021518 A1 1/2008 Hochmair et al.
2008/0051623 A1 2/2008 Schneider et al.
2008/0054509 A1 3/2008 Berman et al.
2008/0063228 A1 3/2008 Mejia et al.
2008/0063231 A1 3/2008 Juneau et al.
2008/0089292 A1 4/2008 Kitazoe et al.
2008/0107292 A1 5/2008 Kornagel
2008/0123866 A1 5/2008 Rule et al.
2008/0188707 A1 8/2008 Bernard et al.
2008/0298600 A1 12/2008 Poe et al.
2008/0300703 A1 12/2008 Widmer et al.
2009/0023976 A1 1/2009 Cho et al.
2009/0043149 A1 2/2009 Abel et al.
2009/0092271 A1 4/2009 Fay et al.
2009/0097681 A1 4/2009 Puria et al.
2009/0141919 A1 6/2009 Spitaels et al.
2009/0149697 A1 6/2009 Steinhardt et al.
2009/0253951 A1 10/2009 Ball et al.
2009/0262966 A1 10/2009 Vestergaard et al.
2009/0281367 A1 11/2009 Cho et al.
2009/0310805 A1 12/2009 Petroff
2010/0034409 A1 2/2010 Fay et al.
2010/0036488 A1 2/2010 De, Jr. et al.
2010/0048982 A1 2/2010 Puria et al.
2010/0085176 A1 4/2010 Flick
2010/0111315 A1 5/2010 Kroman
2010/0152527 A1 6/2010 Puria
2010/0177918 A1 7/2010 Keady et al.
2010/0202645 A1 8/2010 Puria et al.
2010/0222639 A1 9/2010 Purcell et al.
2010/0272299 A1 10/2010 Van et al.
2010/0290653 A1 11/2010 Wiggins et al.
2010/0312040 A1 12/2010 Puria et al.
2010/0317914 A1 12/2010 Puria et al.
2011/0069852 A1 3/2011 Arndt et al.
2011/0077453 A1 3/2011 Pluvinage et al.
2011/0116666 A1 5/2011 Dittberner et al.
2011/0152602 A1 6/2011 Perkins et al.
2011/0182453 A1 7/2011 Van et al.
2011/0258839 A1 10/2011 Probst
2012/0008807 A1 1/2012 Gran
2012/0014546 A1 1/2012 Puria et al.
2012/0039493 A1 2/2012 Rucker et al.
2012/0140967 A1 6/2012 Aubert et al.
2013/0034258 A1 2/2013 Lin
2013/0083938 A1 4/2013 Bakalos et al.
2013/0287239 A1 10/2013 Fay et al.
2013/0308782 A1 11/2013 Dittberner et al.
2013/0343584 A1 12/2013 Bennett et al.
2014/0003640 A1 1/2014 Puria et al.
2014/0056453 A1 2/2014 Olsen et al.
2014/0153761 A1 6/2014 Shennib et al.
2014/0169603 A1 6/2014 Sacha et al.
2014/0254856 A1 9/2014 Blick et al.
2014/0286514 A1 9/2014 Pluvinage et al.
2014/0288356 A1 9/2014 Van
2014/0296620 A1 10/2014 Puria et al.
2014/0321657 A1 10/2014 Stirnemann
2014/0379874 A1 12/2014 Starr et al.
2015/0010185 A1 1/2015 Puria et al.
2015/0023540 A1 1/2015 Fay et al.
2015/0031941 A1 1/2015 Perkins et al.
2015/0201269 A1 7/2015 Dahl et al.
2015/0222978 A1 8/2015 Murozaki et al.
2015/0271609 A1 9/2015 Puria
2016/0029132 A1 1/2016 Freed et al.
2016/0066101 A1 3/2016 Puria et al.
2016/0150331 A1 5/2016 Wenzel
2016/0277854 A1 9/2016 Puria et al.
2016/0302011 A1 10/2016 Olsen et al.
2016/0309265 A1 10/2016 Pluvinage et al.

(56) References Cited

U.S. PATENT DOCUMENTS

| | | | |
|---|---|---|---|
| 2016/0309266 | A1 | 10/2016 | Olsen et al. |
| 2017/0095167 | A1 | 4/2017 | Facteau et al. |

FOREIGN PATENT DOCUMENTS

| | | | |
|---|---|---|---|
| DE | 3243850 | A1 | 5/1984 |
| DE | 3508830 | A1 | 9/1986 |
| EP | 0092822 | A2 | 11/1983 |
| EP | 0242038 | A2 | 10/1987 |
| EP | 0291325 | A2 | 11/1988 |
| EP | 0296092 | A2 | 12/1988 |
| EP | 0242038 | A3 | 5/1989 |
| EP | 0296092 | A3 | 8/1989 |
| EP | 0352954 | A2 | 1/1990 |
| EP | 0291325 | A3 | 6/1990 |
| EP | 0352954 | A3 | 8/1991 |
| EP | 1845919 | A1 | 10/2007 |
| EP | 1845919 | B1 | 9/2010 |
| FR | 2455820 | A1 | 11/1980 |
| JP | S60154800 | A | 8/1985 |
| JP | H09327098 | A | 12/1997 |
| JP | 2000504913 | A | 4/2000 |
| JP | 2004187953 | A | 7/2004 |
| KR | 100624445 | B1 | 9/2006 |
| WO | WO-9209181 | A1 | 5/1992 |
| WO | WO-9621334 | A1 | 7/1996 |
| WO | WO-9736457 | A1 | 10/1997 |
| WO | WO-9745074 | A1 | 12/1997 |
| WO | WO-9806236 | A1 | 2/1998 |
| WO | WO-9903146 | A1 | 1/1999 |
| WO | WO-9915111 | A1 | 4/1999 |
| WO | WO-0022875 | A2 | 4/2000 |
| WO | WO-0022875 | A3 | 7/2000 |
| WO | WO-0150815 | A1 | 7/2001 |
| WO | WO-0158206 | A2 | 8/2001 |
| WO | WO-0176059 | A2 | 10/2001 |
| WO | WO-0158206 | A3 | 2/2002 |
| WO | WO-0239874 | A2 | 5/2002 |
| WO | WO-0239874 | A3 | 2/2003 |
| WO | WO-03063542 | A2 | 7/2003 |
| WO | WO-03063542 | A3 | 1/2004 |
| WO | WO-2004010733 | A1 | 1/2004 |
| WO | WO-2005015952 | A1 | 2/2005 |
| WO | WO-2005107320 | A1 | 11/2005 |
| WO | WO-2006014915 | A2 | 2/2006 |
| WO | WO-2006037156 | A1 | 4/2006 |
| WO | WO-2006042298 | A2 | 4/2006 |
| WO | WO-2006075169 | A1 | 7/2006 |
| WO | WO-2006075175 | A1 | 7/2006 |
| WO | WO-2006042298 | A3 | 12/2006 |
| WO | WO-2009047370 | A2 | 4/2009 |
| WO | WO-2009056167 | A1 | 5/2009 |
| WO | WO-2009047370 | A3 | 7/2009 |
| WO | WO-2009145842 | A2 | 12/2009 |
| WO | WO-2009146151 | A2 | 12/2009 |
| WO | WO-2010033933 | A1 | 3/2010 |
| WO | WO-2012149970 | A1 | 11/2012 |

OTHER PUBLICATIONS

Fritsch, et al. EarLens transducer behavior in high-field strength MRI scanners. Otolaryngol Head Neck Surg. Mar. 2009;140(3):426-8. doi: 10.1016/j.otohns.2008.10.016.

Gantz, et al. Broad Spectrum Amplification with a Light Driven Hearing System. Combined Otolaryngology Spring Meetings, 2016 (Chicago).

Gantz, et al. Light Driven Hearing Aid: A Multi-Center Clinical Study. Association for Research in Otolaryngology Annual Meeting, 2016 (San Diego).

Gantz, et al. Light-Driven Contact Hearing Aid for Broad Spectrum Amplification: Safety and Effectiveness Pivotal Study. Otology & Neurotology Journal, 2016 (in review).

Gantz, et al. Light-Driven Contact Hearing Aid for Broad-Spectrum Amplification: Safety and Effectiveness Pivotal Study. Otology & Neurotology. Copyright 2016. 7 pages.

Khaleghi, et al. Attenuating the ear canal feedback pressure of a laser-driven hearing aid. J Acoust Soc Am. Mar. 2017;141(3):1683.

Khaleghi, et al. Characterization of Ear-Canal Feedback Pressure due to Umbo-Drive Forces: Finite-Element vs. Circuit Models. ARO Midwinter Meeting 2016, (San Diego).

Killion, et al. The case of the missing dots: AI and SNR loss. The Hearing Journal, 1998. 51(5), 32-47.

Levy, et al. Characterization of the available feedback gain margin at two device microphone locations, in the fossa triangularis and Behind the Ear, for the light-based contact hearing device. Acoustical Society of America (ASA) meeting, 2013 (San Francisco).

Levy, et al. Extended High-Frequency Bandwidth Improves Speech Reception in the Presence of Spatially Separated Masking Speech. Ear Hear. Sep.-Oct. 2015;36(5):e214-24. doi: 10.1097/AUD.0000000000000161.

Moore, et al. Perceived naturalness of spectrally distorted speech and music. J Acoust Soc Am. Jul. 2003;114(1):408-19.

Moore, et al. Spectro-temporal characteristics of speech at high frequencies, and the potential for restoration of audibility to people with mild-to-moderate hearing loss. Ear Hear. Dec. 2008;29(6):907-22. doi: 10.1097/AUD.0b013e31818246f6.

Perkins, et al. Light-based Contact Hearing Device: Characterization of available Feedback Gain Margin at two device microphone locations. Presented at AAO-HNSF Annual Meeting, 2013 (Vancouver).

Perkins, et al. The EarLens Photonic Transducer: Extended bandwidth. Presented at AAO-HNSF Annual Meeting, 2011 (San Francisco).

Perkins, R. Earlens tympanic contact transducer: a new method of sound transduction to the human ear. Otolaryngol Head Neck Surg. Jun. 1996;114(6):720-8.

Puria, et al. Cues above 4 kilohertz can improve spatially separated speech recognition. The Journal of the Acoustical Society of America, 2011, 129, 2384.

Puria, et al. Extending bandwidth above 4 kHz improves speech understanding in the presence of masking speech. Association for Research in Otolaryngology Annual Meeting, 2012 (San Diego).

Puria, et al. Extending bandwidth provides the brain what it needs to improve hearing in noise. First international conference on cognitive hearing science for communication, 2011 (Linkoping, Sweden).

Puria, et al. Hearing Restoration: Improved Multi-talker Speech Understanding. 5th International Symposium on Middle Ear Mechanics in Research and Otology (MEMRO), Jun. 2009 (Stanford University).

Puria, et al. Imaging, Physiology and Biomechanics of the middle ear: Towards understating the functional consequences of anatomy. Stanford Mechanics and Computation Symposium, 2005, ed Fong J.

Puria, et al. Temporal-Bone Measurements of the Maximum Equivalent Pressure Output and Maximum Stable Gain of a Light-Driven Hearing System That Mechanically Stimulates the Umbo. Otol Neurotol. Feb. 2016;37(2):160-6. doi: 10.1097/MAO.0000000000000941.

Puria, et al. The EarLens Photonic Hearing Aid. Association for Research in Otolaryngology Annual Meeting, 2012 (San Diego).

Puria, et al. The Effects of bandwidth and microphone location on understanding of masked speech by normal-hearing and hearing-impaired listeners. International Conference for Hearing Aid Research (IHCON) meeting, 2012 (Tahoe City).

Puria, et al. Tympanic-membrane and malleus-incus-complex co-adaptations for high-frequency hearing in mammals. Hear Res. May 2010;263(1-2):183-90. doi: 10.1016/j.heares.2009.10.013. Epub Oct. 28, 2009.

Puria. Measurements of human middle ear forward and reverse acoustics: implications for otoacoustic emissions. J Acoust Soc Am. May 2003;113(5):2773-89.

Puria, S. Middle Ear Hearing Devices. Chapter 10. Part of the series Springer Handbook of Auditory Research pp. 273-308. Date: Feb. 9, 2013.

(56) References Cited

OTHER PUBLICATIONS

Struck, et al. Comparison of Real-world Bandwidth in Hearing Aids vs Earlens Light-driven Hearing Aid System. The Hearing Review. TechTopic: EarLens. Hearingreview.com. Mar. 14, 2017. pp. 24-28.
Asbeck, et al. Scaling Hard Vertical Surfaces with Compliant Microspine Arrays, The International Journal of Robotics Research 2006; 25; 1165-79.
Atasoy [Paper] Opto-acoustic Imaging. for BYM504E Biomedical Imaging Systems class at ITU, downloaded from the Internet www2.itu.edu.td—cilesiz/courses/BYM504-2005-OA 504041413.pdf, 14 pages.
Athanassiou, et al. Laser controlled photomechanical actuation of photochromic polymers Microsystems. Rev. Adv. Mater. Sci. 2003; 5:245-251.
Autumn, et al. Dynamics of geckos running vertically, The Journal of Experimental Biology 209, 260-272, (2006).
Autumn, et al., Evidence for van der Waals adhesion in gecko setae, www.pnas.orgycgiydoiy10.1073ypnas.192252799 (2002).
Ayatollahi, et al. Design and Modeling of Micromachined Condenser MEMS Loudspeaker using Permanent Magnet Neodymium-Iron-Boron (Nd—Fe—B). IEEE International Conference on Semiconductor Electronics, 2006. ICSE '06, Oct. 29, 2006-Dec. 1, 2006; 160-166.
Baer, et al. Effects of Low Pass Filtering on the Intelligibility of Speech in Noise for People With and Without Dead Regions at High Frequencies. J. Acost. Soc. Am 112 (3), pt. 1, (Sep. 2002), pp. 1133-1144.
Best, et al. The influence of high frequencies on speech localization. Abstract 981 (Feb. 24, 2003) from www.aro.org/abstracts/abstracts.html.
Birch, et al. Microengineered systems for the hearing impaired. IEE Colloquium on Medical Applications of Microengineering, Jan. 31, 1996; pp. 2/1-2/5.
Boedts. Tympanic epithelial migration, Clinical Otolaryngology 1978, 3, 249-253.
Burkhard, et al. Anthropometric Manikin for Acoustic Research. J. Acoust. Soc. Am., vol. 58, No. 1, (Jul. 1975), pp. 214-222.
Camacho-Lopez, et al. Fast Liquid Crystal Elastomer Swims Into the Dark, Electronic Liquid Crystal Communications. Nov. 26, 2003; 9 pages total.
Carlile, et al. Spatialisation of talkers and the segregation of concurrent speech. Abstract 1264 (Feb. 24, 2004) from www.aro.org/abstracts/abstracts.html.
Cheng; et al., "A silicon microspeaker for hearing instruments. Journal of Micromechanics and Microengineering 14, No. 7 (2004): 859-866.".
Cheng, et al. A Silicon Microspeaker for Hearing Instruments. Journal of Micromechanics and Microengineering 2004; 14(7):859-866.
Datskos, et al. Photoinduced and thermal stress in silicon microcantilevers. Applied Physics Letters. Oct. 19, 1998; 73(16):2319-2321.
Decraemer, et al. A method for determining three-dimensional vibration in the ear. Hearing Res., 77:19-37 (1994).
Ear. Retrieved from the Internet: wwwmgs.bionet.nsc.ru/mgs/gnw/trrd/thesaurus/Se/ear.htm. 4 pages total.
Fay. Cat eardrum mechanics. Ph.D. thesis. Disseration submitted to Department of Aeronautics and Astronautics. Standford University. May 2001; 210 pages total.
Fay, et al. Cat eardrum response mechanics. Calladine Festschrift (2002), Ed. S. Pellegrino, The Netherlands, Kluwer Academic Publishers.
Fay, et al. The discordant eardrum, PNAS, Dec. 26, 2006, vol. 103, No. 52, p. 19743-19748.
Fletcher. Effects of Distortion on the Individual Speech Sounds. Chapter 18, ASA Edition of Speech and Hearing in Communication, Acoust Soc. of Am. (republished in 1995) pp. 415-423.
Freyman, et al. Spatial Release from Informational Masking in Speech Recognition. J. Acost. Soc. Am., vol. 109, No. 5, pt. 1, (May 2001); 2112-2122.
Freyman, et al. The Role of Perceived Spatial Separation in the Unmasking of Speech. J. Acoust. Soc. Am., vol. 106, No. 6, (Dec. 1999); 3578-3588.
Ge, et al., Carbon nanotube-based synthetic gecko tapes, p. 10792-10795, PNAS, Jun. 26, 2007, vol. 104, No. 26.
Gennum, GA3280 Preliminary Data Sheet: Voyageur TD Open Platform DSP System for Ultra Low Audio Processing, downloaded from the Internet: &It;&It;http://www.sounddesigntechnologies.com/products/pdf/37601DOC.pdf>>, Oct. 2006; 17 pages.
Gobin, et al. Comments on the physical basis of the active materials concept. Proc. SPIE 2003; 4512:84-92.
Gorb, et al. Structural Design and Biomechanics of Friction-Based Releasable Attachment Devices in Insects, Integr. Comp_Biol., 42:1127-1139 (2002).
Hato, et al. Three-dimensional stapes footplate motion in human temporal bones. Audiol. Neurootol., 8:140-152 (Jan. 30, 2003).
Headphones. Wikipedia Entry, downloaded from the Internet : en.wikipedia.org/wiki/Headphones. Accessed Oct. 27, 2008. 7 pages total.
Hofman, et al. Relearning Sound Localization With New Ears. Nature Neuroscience, vol. 1, No. 5, (Sep. 1998); 417-421.
International Preliminary Report on Patentability dated Mar. 22, 2011 for PCT/US2009/057716.
International search report and written opinion dated Nov. 19, 2009 for PCT/US2009/057716.
Izzo, et al. Laser Stimulation of Auditory Neurons: Effect of Shorter Pulse Duration and Penetration Depth. Biophys J. Apr. 15, 2008;94(8):3159-3166.
Izzo, et al. Laser Stimulation of the Auditory Nerve. Lasers Surg Med. Sep. 2006;38(8):745-753.
Izzo, et al. Selectivity of Neural Stimulation in the Auditory System: A Comparison of Optic and Electric Stimuli. J Biomed Opt. Mar.-Apr. 2007;12(2):021008.
Jin, et al. Speech Localization. J. Audio Eng. Soc. convention paper, presented at the AES 112th Convention, Munich, Germany, May 10-13, 2002, 13 pages total.
Killion. Myths About Hearing Noise and Directional Microphones. The Hearing Review. Feb. 2004; 11(2):14, 16, 18, 19, 72 & 73.
Killion. SNR loss: I can hear what people say but I can't understand them. The Hearing Review, 1997; 4(12):8-14.
Lee, et al. A Novel Opto-Electromagnetic Actuator Coupled to the tympanic Membrane. J Biomech. Dec. 5, 2008;41(16):3515-8. Epub Nov. 7, 2008.
Lee, et al. The optimal magnetic force for a novel actuator coupled to the tympanic membrane: a finite element analysis. Biomedical engineering: applications, basis and communications. 2007; 19(3):171-177.
Lezal. Chalcogenide glasses—survey and progress. Journal of Optoelectronics and Advanced Materials. Mar. 2003; 5(1):23-34.
Makino, et al. Epithelial migration in the healing process of tympanic membrane perforations. Eur Arch Otorhinolaryngol. 1990; 247: 352-355.
Makino, et al., Epithelial migration on the tympanic membrane and external canal, Arch Otorhinolaryngol (1986) 243:39-42.
Markoff. Intuition + Money: An Aha Moment. New York Times Oct. 11, 2008, p. BU4, 3 pages total.
Martin, et al. Utility of Monaural Spectral Cues is Enhanced in the Presence of Cues to Sound-Source Lateral Angle. JARO. 2004; 5:80-89.
Michaels, et al., Auditory Epithelial Migration on the Human Tympanic Membrane: II. The Existence of Two Discrete Migratory Pathways and Their Embryologic Correlates, The American Journal of Anatomy 189:189-200 (1990).
Moore. Loudness perception and intensity resolution. Cochlear Hearing Loss, Chapter 4, pp. 90-115, Whurr Publishers Ltd., London (1998).
Murphy M, Aksak B, Sitti M. Adhesion and anisotropic friction enhancements of angled heterogeneous micro-fiber arrays with spherical and spatula tips. J Adhesion Sci Technol, vol. 21, No. 12-13, p. 1281-1296, 2007.

(56) References Cited

OTHER PUBLICATIONS

Murugasu, et al. Malleus-to-footplate versus malleus-to-stapes-head ossicular reconstruction prostheses: temporal bone pressure gain measurements and clinical audiological data. Otol Neurotol. Jul. 2005; 2694):572-582.
Musicant, et al. Direction-Dependent Spectral Properties of Cat External Ear: New Data and Cross-Species Comparisons. J. Acostic. Soc. Am, May 10-13, 2002, vol. 87, No. 2, (Feb. 1990), pp. 757-781.
National Semiconductor, LM4673 Boomer: Filterless, 2.65W, Mono, Class D Audio Power Amplifier, [Data Sheet] downloaded from the Internet: &It;It;http://www.national.com/ds/LM/LM4673.pdf>>; Nov. 1, 2007; 24 pages.
Nishihara, et al. Effect of changes in mass on middle ear function. Otolaryngol Head Neck Surg. Nov. 1993;109(5):889-910.
O'Connor, et al. Middle ear Cavity and Ear Canal Pressure-Driven Stapes Velocity Responses in Human Cadaveric Temporal Bones. J Acoust Soc Am. Sep. 2006:120(3)1517-28.
Park, et al. Design and analysis of a microelectromagnetic vibration transducer used as an implantable middle ear hearing aid. J. Micromech. Microeng. vol. 12 (2002), pp. 505-511.
Perkins, et al. The EarLens System: New sound transduction methods. Hear Res. Feb. 2, 2010; 10 pages total.
Poosanaas, et al. Influence of sample thickness on the performance of photostrictive ceramics, J. App. Phys. Aug. 1, 1998; 84(3):1508-1512.
Puria et al. A gear in the middle ear. ARO Denver CO, 2007b.
Puria, et al. Malleus-to-footplate ossicular reconstruction prosthesis positioning: cochleovestibular pressure optimization. Otol Nerotol. May 2005; 2693):368-379.
Puria, et al. Measurements and model of the cat middle ear: Evidence of tympanic membrane acoustic delay. J. Acoust. Soc. Am., 104(6):3463-3481 (Dec. 1998).
Puria, et al., Mechano-Acoustical Transformations in A. Basbaum et al., eds., The Senses: A Comprehensive Reference, v3, p. 165-202, Academic Press (2008).
Puria, et al. Middle Ear Morphometry From Cadaveric Temporal Bone MicroCT Imaging. Proceedings of the 4th International Symposium, Zurich, Switzerland, Jul. 27-30, 2006, Middle Ear Mechanics in Research and Otology, pp. 259-268.
Puria, et al. Sound-Pressure Measurements in the Cochlear Vestibule of Human-Cadaver Ears. Journal of the Acoustical Society of America. 1997; 101 (5-1): 2754-2770.
Qu, et al. Carbon Nanotube Arrays with Strong Shear Binding-On and Easy Normal Lifting-Off, Oct. 10, 2008 vol. 322 Science. 238-242.
Roush. SiOnyx Brings "Black Silicon" into the Light; Material Could Upend Solar, Imaging Industries. Xconomy, Oct. 12, 2008, retrieved from the Internet: www.xconomy.com/boston/2008/10/12/sionyx-brings-black-silicon-into-the-light ¬ material-could-upend-solar-imaging-industries> 4 pages total.
R.P. Jackson, C. Chlebicki, T.B. Krasieva, R. Zalpuri, W.J. Triffo, S. Puria, "Multiphoton and Transmission Electron Microscopy of Collagen in Ex Vivo Tympanic Membranes," Biomedcal Computation at STandford, Oct. 2008.
Rubinstein. How Cochlear Implants Encode Speech, Curr Opin Otolaryngol Head Neck Surg. Oct. 2004;12(5):444-8; retrieved from the Internet: www.ohsu.edu/nod/documents/week3/Rubenstein.pdf.
Sekaric, et al. Nanomechanical resonant structures as tunable passive modulators. App. Phys. Lett. Nov. 2003; 80(19):3617-3619.
Shaw. Transformation of Sound Pressure Level From the Free Field to the Eardrum in the Horizontal Plane. J. Acoust. Soc. Am., vol. 56, No. 6, (Dec. 1974), 1848-1861.
Shih. Shape and displacement control of beams with various boundary conditions via photostrictive optical actuators. Proc. IMECE. Nov. 2003; 1-10.
Sound Design Technologies,—Voyager TDTM Open Platform DSP System for Ultra Low Power Audio Processing—GA3280 Data Sheet. Oct. 2007; retrieved from the Internet: &It&It;http://www.sounddes.com/pdf/37601DOC.pdf>gt;, 15 page total.
Spolenak, et al. Effects of contact shape on the scaling of biological attachments. Proc. R. Soc. A. 2005; 461:305-319.
Stenfelt, et al. Bone-Conducted Sound: Physiological and Clinical Aspects. Otology & Neurotology, Nov. 2005; 26 (6):1245-1261.
Stuchlik, et al. Micro-Nano Actuators Driven by Polarized Light. IEEE Proc. Sci. Meas. Techn. Mar. 2004; 151(2):131-136.
Suski, et al. Optically activated ZnO/Si02/Si cantilever beams. Sensors and Actuators A (Physical), 0 (nr: 24). 2003; 221-225.
Takagi, et al. Mechanochemical Synthesis of Piezoelectric PLZT Powder. KONA. 2003; 51(21):234-241.
Thakoor, et al. Optical microactuation in piezoceramics. Proc. SPIE. Jul. 1998; 3328:376-391.
The Scientist and Engineers Guide to Digital Signal Processing, copyright 01997-1998 by Steven W. Smith, available online at www.DSPguide.com.
Tzou, et al. Smart Materials, Precision Sensors/Actuators, Smart Structures, and Structronic Systems. Mechanics of Advanced Materials and Structures. 2004; 11:367-393.
Uchino, et al. Photostricitve actuators. Ferroelectrics. 2001; 258:147-158.
U.S. Appl. No. 60/702,532, filed Jul. 25, 2005.
U.S. Appl. No. 61/099,087, filed Sep. 22, 2008.
Vickers, et al. Effects of Low-Pass Filtering on the Intelligibility of Speech in Quiet for People With and Without Dead Regions at High Frequencies. J. Acoust. Soc. Am. Aug. 2001; 110(2):1164-1175.
Vinikman-Pinhasi, et al. Piezoelectric and Piezooptic Effects in Porous Silicon. Applied Physics Letters, Mar. 2006; 88(11): 11905-111906.
Wang, et al. Preliminary Assessment of Remote Photoelectric Excitation of an Actuator for a Hearing Implant. Proceeding of the 2005 IEEE, Engineering in Medicine and Biology 27th nnual Conference, Shanghai, China. Sep. 1-4, 2005; 6233-6234.
Wiener, et al. On the Sound Pressure Transformation by the Head and Auditory Meatus of the Cat. Acta Otolaryngol. Mar. 1966; 61(3):255-269.
Wightman, et al. Monaural Sound Localization Revisited. J Acoust Soc Am. Feb. 1997;101(2):1050-1063.
Yao, et al. Adhesion and sliding response of a biologically inspired fibrillar surface: experimental observations, J. R. Soc. Interface (2008) 5, 723-733 doi:10.1098/rsif.2007.1225 Published online Oct. 30, 2007.
Yao, et al. Maximum strength for intermolecular adhesion of nanospheres at an optimal size. J. R. Soc. Interface doi:10.10981rsif.2008.0066 Published online 2008.
Yi, et al. Piezoelectric Microspeaker with Compressive Nitride Diaphragm. The Fifteenth IEEE International Conference on Micro Electro Mechanical Systems, 2002; 260-263.
Yu, et al. Photomechanics: Directed bending of a polymer film by light. Nature. Sep. 2003; 425:145.
Fay, et al. Preliminary evaluation of a light-based contact hearing device for the hearing impaired. Otol Neurotol. Jul. 2013;34(5):912-21. doi: 10.1097/MAO.0b013e31827de4b1.
Jian, et al. A 0.6 V, 1.66 mW energy harvester and audio driver for tympanic membrane transducer with wirelessly optical signal and power transfer. InCircuits and Systems (ISCAS), 2014 IEEE International Symposium on Jun. 1, 2014. 874-7. IEEE.
Office action dated Feb. 12, 2014 for U.S. Appl. No. 13/069,282.
Office action dated Aug. 14, 2015 for U.S. Appl. No. 13/069,282.
Office action dated Nov. 6, 2014 for U.S. Appl. No. 13/069,282.
Song, et al. The development of a non-surgical direct drive hearing device with a wireless actuator coupled to the tympanic membrane. Applied Acoustics. Dec. 31, 2013;74(12):1511-8.
Thompson. Tutorial on microphone technologies for directional hearing aids. Hearing Journal. Nov. 2003; 56(11):14-16,18, 20-21.
U.S. Appl. No. 61/073,271, filed Jun. 17, 2008.
U.S. Appl. No. 61/073,281, filed Jun. 17, 2008.
European search report and opinion dated Feb. 6, 2013 for EP Application No. 09767670.4.
International search report and written opinion dated Nov. 23, 2009 for PCT/US2009/047685.

(56) References Cited

OTHER PUBLICATIONS

Notice of allowance dated Mar. 10, 2015 for U.S. Appl. No. 14/339,746.
Notice of allowance dated May 29, 2014 for U.S. Appl. No. 13/678,889.
Notice of allowance dated Aug. 21, 2012 for U.S. Appl. No. 12/486,100.
Office action dated Jan. 20, 2012 for U.S. Appl. No. 12/486,100.
Office action dated Nov. 10, 2014 for U.S. Appl. No. 14/339,746.
Office action dated Dec. 11, 2013 for U.S. Appl. No. 13/678,889.

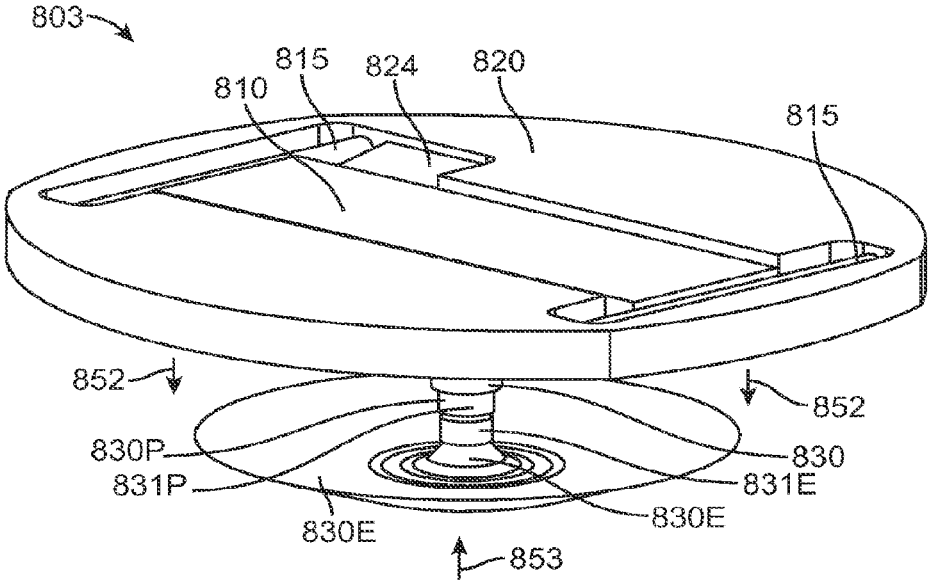
FIG. 8B1

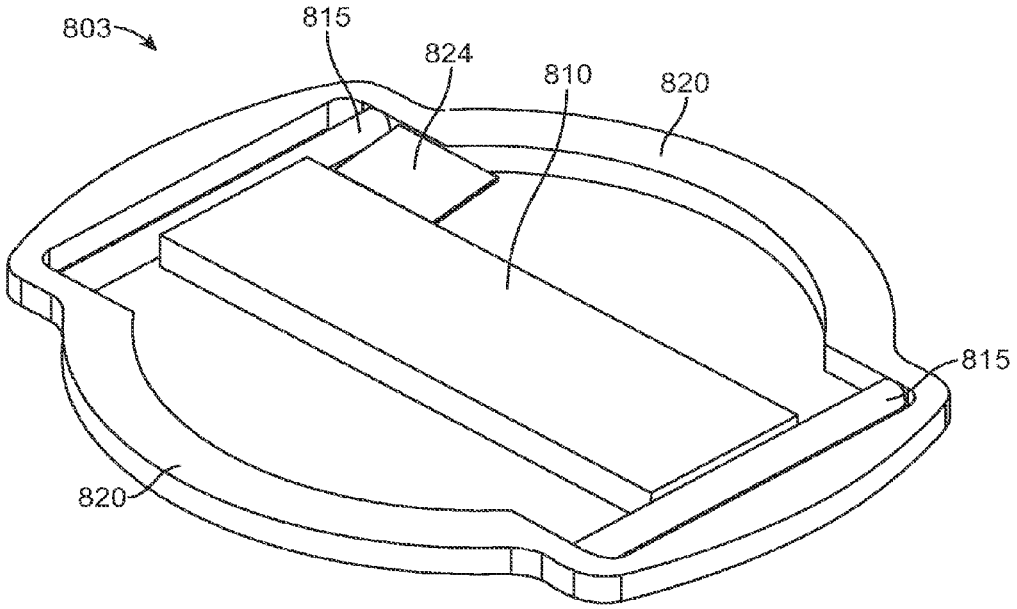
FIG. 8B2

TRANSDUCER DEVICES AND METHODS FOR HEARING

CROSS-REFERENCE TO RELATED APPLICATIONS

The present application is a continuation of U.S. patent application Ser. No. 13/069,282, filed Mar. 22, 2011, which is a continuation of PCT/US2009/057716, filed Sep. 22, 2009, which claims priority to U.S. Patent Application Nos.: 61/139,526 filed Dec. 19, 2008, entitled "Balanced Armature Devices and Methods for Hearing"; 61/217,801 filed on Jun. 3, 2009; 61/099,087 filed Sep. 22, 2008, entitled "Transducer Devices and Methods for Hearing"; and 61/109,785 filed Oct. 30, 2008, entitled "Transducer Devices and Methods for Hearing"; the full disclosures of which are incorporated herein by reference.

STATEMENT AS TO RIGHTS TO INVENTIONS MADE UNDER FEDERALLY SPONSORED RESEARCH AND DEVELOPMENT

This invention was supported by grants from the National Institutes of Health (Grant No. R44DC008499-02A1). The Government may have certain rights in this invention.

BACKGROUND OF THE INVENTION

1. Field of the Invention

The present invention is related to hearing systems, devices and methods. Although specific reference is made to hearing aid systems, embodiments of the present invention can be used in many applications in which a signal is used to stimulate the ear.

People like to hear. Hearing allows people to listen to and understand others. Natural hearing can include spatial cues that allow a user to hear a speaker, even when background noise is present.

Hearing devices can be used with communication systems to help the hearing impaired. Hearing impaired subjects need hearing aids to verbally communicate with those around them. Open canal hearing aids have proven to be successful in the marketplace because of increased comfort and an improved cosmetic appearance. Another reason why open canal hearing aides can be popular is reduced occlusion of the ear canal. Occlusion can result in an unnatural, tunnel-like hearing effect which can be caused by large hearing aids which block the ear canal. In at least some instances, occlusion be noticed by the user when he or she speaks and the occlusion results in an unnatural sound during speech. However, a problem that may occur with open canal hearing aids is feedback. The feedback may result from placement of the microphone in too close proximity with the speaker or the amplified sound being too great. Thus, feedback can limit the degree of sound amplification that a hearing aid can provide. Although feedback can be decreased by placing the microphone outside the ear canal, this placement can result in the device providing an unnatural sound that is devoice of the spatial location information cues present with natural hearing.

In some instances, feedback may be decreased by using non-acoustic means of stimulating the natural hearing transduction pathway, for example stimulating the tympanic membrane, bones of the ossicular chain and/or the cochlea. An output transducer may be placed on the eardrum, the ossicles in the middle ear, or the cochlea to stimulate the hearing pathway. Such an output transducer may be electro magnetically based. For example, the transducer may comprise a magnet and coil placed on the ossicles to stimulate the hearing pathway. Surgery is often needed to place a hearing device on the ossicles or cochlea, and such surgery can be somewhat invasive in at least some instances. At least some of the known methods of placing an electromagnetic transducer on the eardrum may result in occlusion in some instances.

One promising approach has been to place a magnet on the eardrum and drive the magnet with a coil positioned away from the eardrum. The magnets can be electromagnetically driven with a coil to cause motion in the hearing transduction pathway thereby causing neural impulses leading to the sensation of hearing. A permanent magnet may be coupled to the ear drum through the use of a fluid and surface tension, for example as described in U.S. Pat. Nos. 5,259,032 and 6,084,975.

However, there is still room for improvement. For example, with a magnet positioned on the eardrum and coil positioned away from the magnet, the strength of the magnetic field generated to drive the magnet may decrease rapidly with the distance from the driver coil to the permanent magnet. Because of this rapid decrease in strength over distance, efficiency of the energy to drive the magnet may be less than ideal. Also, placement of the driver coil near the magnet may cause discomfort for the user in some instances. There can also be a need to align the driver coil with the permanent magnet that may, in some instances, cause the performance to be less than ideal.

For the above reasons, it would be desirable to provide hearing systems which at least decrease, or even avoid, at least some of the above mentioned limitations of the current hearing devices. For example, there is a need to provide a comfortable hearing device which provides hearing with natural qualities, for example with spatial information cues, and which allow the user to hear with less occlusion, distortion and feedback than current devices.

2. Description of the Background Art

Patents and publications that may be relevant to the present application include: U.S. Pat. Nos. 3,585,416; 3,764,748; 3,882,285; 5,142,186; 5,554,096; 5,624,376; 5,795,287; 5,800,336; 5,825,122; 5,857,958; 5,859,916; 5,888,187; 5,897,486; 5,913,815; 5,949,895; 6,005,955; 6,068,590; 6,093,144; 6,139,488; 6,174,278; 6,190,305; 6,208,445; 6,217,508; 6,222,302; 6,241,767; 6,422,991; 6,475,134; 6,519,376; 6,620,110; 6,626,822; 6,676,592; 6,728,024; 6,735,318; 6,900,926; 6,920,340; 7,072,475; 7,095,981; 7,239,069; 7,289,639; D512,979; 2002/0086715; 2003/0142841; 2004/0234092; 2005/0020873; 2006/0107744; 2006/0233398; 2006/075175; 2007/0083078; 2007/0191673; 2008/0021518; 2008/0107292; commonly owned U.S. Pat. No. 5,259,032; U.S. Pat. No. 5,276,910; U.S. Pat. No. 5,425,104; U.S. Pat. No. 5,804,109; U.S. Pat. No. 6,084,975; U.S. Pat. No. 6,554,761; U.S. Pat. No. 6,629,922; U.S. Publication Nos. 2006/0023908; 2006/0189841; 2006/0251278; and 2007/0100197. Non-U.S. patents and publications that may be relevant include EP1845919 PCT Publication Nos. WO 03/063542; WO 2006/075175; U.S. Publication Nos. Journal publications that may be relevant include: Ayatollahi et al., "Design and Modeling of Micromachines Condenser MEMS Loudspeaker using Permanent Magnet Neodymium-Iron-Boron (Nd—Fe—B)", ISCE, Kuala Lampur, 2006; Birch et al, "Microengineered Systems for the Hearing Impaired", IEE, London, 1996; Cheng et al., "A silicon microspeaker for hearing instruments", J. Micromech. Microeng., 14(2004) 859-866; Yi et al., "Piezoelectric microspeaker with compressive nitride diaphragm", IEEE, 2006, and Zhigang Wang et al., "Preliminary Assessment of Remote Photoelectric Excitation of an Actuator for a Hearing Implant", IEEE Engineering in Medicine and Biology 27th Annual Conference, Shanghai, China, Sep. 1-4, 2005. Other publications of interest include: Gennum GA3280 Preliminary Data Sheet, "Voyager TDTM. Open Platform DSP System for Ultra Low Power Audio Processing" and National Semiconductor LM4673 Data Sheet, "LM4673 Filterless, 2.65 W, Mono, Class D audio Power Amplifier"; Puria, S. et al., Middle ear morphometry from cadaveric temporal bone microCT imaging, Invited Talk. MEMRO 2006, Zurich; Puria, S. et al, A gear in the middle ear ARO 2007, Baltimore, Md.

BRIEF SUMMARY OF THE INVENTION

The present invention is related to hearing systems, devices and methods. Although specific reference is made to hearing aid systems, embodiments of the present invention can be used in many applications in which a signal is used to stimulate the ear.

Embodiments of the present invention can provide improved hearing which overcomes at least some of the aforementioned limitations of current systems. In many embodiments, a device to transmit an audio signal to a user may comprise a transducer assembly comprising a mass, a piezoelectric transducer, and a support to support the mass and the piezoelectric transducer with the eardrum. The piezoelectric transducer can be configured to drive the support and the eardrum with a first force and the mass with a second force opposite the first force. This driving of the ear drum and support with a force opposite the mass can result in more direct driving of the eardrum, and can improve coupling of the vibration of transducer to the eardrum. The transducer assembly device may comprise circuitry configured to receive wireless power and wireless transmission of an audio signal, and the circuitry can be supported with the eardrum to drive the transducer in response to the audio signal, such that vibration between the circuitry and the transducer can be decreased. The wireless signal may comprise an electromagnetic signal produced with a coil, or an electromagnetic signal comprising light energy produce with a light source. In at least some embodiments, at least one of the transducer or the mass can be positioned on the support away from the umbo of the ear when the support is coupled to the eardrum to drive the eardrum, so as to decrease motion of the transducer and decrease user perceived occlusion, for example when the user speaks. This positioning of the transducer and/or the mass away from the umbo, for example on the short process of the malleus, may allow a transducer with a greater mass to be used and may even amplify the motion of the transducer with the malleus. In at least some embodiments, the transducer may comprise a plurality of transducers to drive the malleus with both a hinging rotational motion and a twisting motion, which can result in more natural motion of the malleus and can improve transmission of the audio signal to the user.

In a first aspect, embodiments of the present invention provide a device to transmit an audio signal to a user. The user has an ear comprising an ear drum. The device comprises a mass, a piezoelectric transducer, and a support to support the mass and the piezoelectric transducer with the eardrum. The piezoelectric transducer is configured to drive the support and the eardrum with a first force and the mass with a second force opposite the first force.

In many embodiments, the piezoelectric transducer is disposed between the mass and the support.

In many embodiments, the device further comprises at least one flexible structure disposed between the piezoelectric transducer and the mass.

In many embodiments, the piezoelectric transducer is magnetically coupled to the support.

In many embodiments, the piezoelectric transducer comprises a first portion connected to the mass and a second portion connected to the support to drive the mass opposite the support.

In many embodiments, the support comprises a first side shaped to conform with the eardrum. A protrusion can be disposed opposite the first side and affixed to the piezoelectric transducer.

In many embodiments, the device further comprises a fluid disposed between the first side and the eardrum to couple the support to the eardrum. The fluid may comprise a liquid composed of at least one of an oil, a mineral oil, a silicone oil or a hydrophobic liquid. In some embodiments, the support comprises a second side disposed opposite the first side and the protrusion extends from the second side to the piezoelectric transducer.

In many embodiments, the support comprises a first component and a second component. The first component may comprise a flexible material shaped to conform to the eardrum and flex with motion of the eardrum. The second component may comprise a rigid material extending from the transducer to the flexible material to transmit the first force to the flexible material and the eardrum. In at least some embodiments, the rigid material comprises at least one of a metal, titanium, a stainless steel or a rigid plastic, and the flexible material comprises at least one of a silicone, a flexible plastic or a gel.

In many embodiments, the device further comprises a housing, the housing rigidly affixed to the mass to move the housing and the mass opposite the support. In some embodiments, the support comprises a rigid material that extends through the housing to the transducer to move the mass and the housing opposite the support.

In many embodiments, the mass comprises circuitry coupled to the transducer and supported with the support and the transducer. The circuitry is configured to receive wireless power and wireless transmission of the audio signal to drive the transducer in response to the audio signal.

In many embodiments, the piezoelectric transducer comprises at least one of a piezoelectric unimorph transducer, a bimorph-bender piezoelectric transducer, a piezoelectric multimorph transducer, a stacked piezoelectric transducer with a mechanical multiplier or a ring piezoelectric transducer with a mechanical multiplier.

In some embodiments, the piezoelectric transducer comprises the bimorph-bender piezoelectric transducer and the mass comprises a first mass and a second mass. The bimorph bender comprises a cantilever extending from a first end supporting the first mass to a second end supporting the second mass. The support is coupled to the cantilever between the first end and the second end to drive the ear drum with the first force and drive the first mass and the second mass with the second force.

In some embodiments, the piezoelectric transducer comprises the stacked piezoelectric transducer with the mechanical multiplier. The mechanical multiplier comprises a first side coupled to the support to drive the eardrum with the first force and a second side coupled to the mass to drive the mass with the second force.

In some embodiments, the piezoelectric transducer comprises the ring piezoelectric transducer with the mechanical multiplier. The mechanical multiplier comprises a first side and a second side. The first side extends inwardly from the ring piezoelectric transducer to the mass. The second side extends inwardly toward a protrusion of the support. The mass moves away from the protrusion of the support when the ring contracts and toward the protrusion of the support when the ring expands. The ring piezoelectric multiplier may define a center having central axis extending there through. The central protrusion and the mass may be disposed along the central axis.

In some embodiments, the piezoelectric transducer comprises the bimorph bender. The mass comprises a ring having a central aperture formed thereon. The bimorph bender extends across the ring with a first end and a second end coupled to the ring. The support extends through the aperture and connects to the piezoelectric transducer between the first end and the second end to move the support opposite the ring when the bimorph bender bends. The bimorph bender can be connected to the ring with an adhesive on the first end and the second end such that the first end and the second end are configured to move relative to the ring with shear motion when the bimorph bender bends to drive the support opposite the ring.

In another aspect, embodiments of the present invention provide a device to transmit an audio signal to a user. The user has an ear comprising an eardrum. The device comprises a transducer, circuitry coupled to the transducer, and a support configured to couple to the eardrum and support the circuitry and the transducer with the eardrum. The circuitry is configured to receive at least one of wireless power or wireless transmission of the audio signal to drive the transducer in response to the audio signal.

In many embodiments, the transducer is configured to drive the support and the eardrum with a first force and drive the circuitry with a second force opposite the first force.

In many embodiments, the circuitry is rigidly attached to a mass and coupled to the transducer to drive the circuitry and the mass with the first force. In some embodiments, the circuitry is rigidly attached to the mass and coupled to the transducer to drive the circuitry and the mass with the second force.

In many embodiments, the circuitry is flexibly attached to a mass and coupled to the transducer to drive the circuitry and the mass with the first force. In some embodiments, the circuitry is flexibly attached to the mass and coupled to the transducer to drive the circuitry and the mass with the second force.

In many embodiments, the circuitry comprises at least one of a photodetector or a coil supported with the support and coupled to the transducer to drive the transducer with the at least one of the wireless power or wireless transmission of the audio signal.

In many embodiments, the transducer comprises at least one of a piezoelectric transducer, a magnetostrictive transducer, a magnet or a coil.

In another aspect, embodiments of the invention provide a device to transmit an audio signal to a user. The user has an ear comprising an eardrum having a mechanical impedance. The device comprises a transducer and a support to support the transducer with the eardrum. A combined mass of the support and the transducer supported thereon is configured to match the mechanical impedance of the eardrum for at least one audible frequency between about 0.8 kHz and about 10 kHz.

In many embodiments, the combined mass comprises no more than about 50 mg. In some embodiments, the combined mass is within a range from about 10 mg to about 40 mg.

In many embodiments, the combined mass comprises at least one of a mass from circuitry to drive the transducer, a mass from a housing disposed over the transducer or a metallic mass coupled to the transducer opposite the support. In some embodiments, the transducer, the circuitry to drive the transducer, the housing disposed over the transducer and the metallic mass are supported with the eardrum when the support is coupled to the eardrum.

In many embodiments, at least one audible frequency is between about 1 kHz and about 6 KHz.

In many embodiments, the transducer and the mass are positioned on the support to place at least one of the transducer or the mass away from an umbo of the eardrum when the support is placed on the eardrum. This positioning can decrease a mechanical impedance of the support to sound transmitted with the eardrum when the support is positioned on the eardrum.

In many embodiments, the piezoelectric transducer comprises a stiffness. The stiffness of the piezoelectric transducer is matched to the mechanical impedance of the eardrum for the at least one audible frequency.

In many embodiments, the eardrum comprises an umbo and the acoustic input impedance comprises an acoustic impedance of the umbo. The stiffness of the piezoelectric transducer is matched to the acoustic input impedance of the umbo.

In another aspect, embodiments of the present invention provide a device to transmit an audio signal to a user. The user has an ear comprising an eardrum and a malleus connected to the ear drum at an umbo. The device comprises a transducer and a support to support the transducer with the eardrum. The transducer is configured to drive the eardrum. The transducer is positioned on the support to extend away from the umbo when the support is placed on the eardrum.

In many embodiments, a mass is positioned on the support for placement away from the umbo when the support is placed against the eardrum, and the transducer extends between the mass and a position on the support that corresponds to the umbo so as to couple vibration of the transducer to the umbo. The mass can be positioned on the support to align the mass with the malleus away from the umbo when the support is placed against the eardrum.

In many embodiments, the transducer is positioned on the support so as to decrease a first movement of the transducer relative to a second movement of the umbo when the eardrum vibrates and to amplify the second movement of the umbo relative to the first movement of the transducer when the transducer vibrates. In some embodiments, the first movement of the transducer is no more than about 75% of the second movement of the umbo and the second movement of the umbo is at least about 25% more than the first movement of the transducer. The first movement of the transducer may be no more than about 67% of the second movement of the umbo and the second movement of the umbo may be at least about 50% more than the first movement of the transducer.

In many embodiments, the device further comprises a mass, and the transducer is disposed between the mass and the support.

In many embodiments, the support is shaped to the eardrum of the user to position the support on the eardrum in a pre-determined orientation. The transducer is positioned on the support to align the transducer with a malleus of the user with the eardrum disposed between the malleus and the support when the support is placed on the eardrum. In some embodiments, the support comprises a shape from a mold of the eardrum of the user.

In many embodiments, the transducer is positioned on the support to place the transducer away from a tip of the malleus when the support is placed on the eardrum.

In many embodiments, the transducer is positioned on the support to place the transducer away from the tip when the support is positioned on the eardrum. The malleus comprises a head and a handle. The handle extends from the head to a tip near the umbo of the eardrum.

In many embodiments, the transducer is positioned on the support to align the transducer with the lateral process of the malleus with the eardrum disposed between the lateral process and the support when the support is placed on the eardrum. In some embodiments, the support comprises a rigid material that extends from the transducer toward the lateral process to move the lateral process opposite the mass.

In many embodiments, the transducer comprises at least one of a piezoelectric transducer, a magnetostrictive transducer, a photostrictive transducer, a coil or a magnet.

In many embodiments, the transducer comprises the piezoelectric transducer. The piezoelectric transducer may comprise a cantilevered bimorph bender, which has a first end anchored to the support and a second end attached to a mass to drive the mass opposite the lateral process when the support is placed on the eardrum.

In many embodiments, the device further comprises a mass coupled to the transducer and circuitry coupled to the transducer to drive the transducer. The mass and the circuitry is supported with the eardrum when the support is placed on the ear. The support, the transducer, the mass and the circuitry comprise a combined mass of no more than about 60 mg, for example, a combined mass of no more than about 40 mg or even a combined mass of no more than 30 mg.

In another aspect, embodiments of the present invention provide a device to transmit an audio signal to a user. The user has an ear comprising an ear drum. The device comprises a first transducer, a second transducer, and a support to support the first transducer and the second transducer with the eardrum when the support is placed against the eardrum. The first transducer is positioned on the support to couple to a first side of the malleus. The second transducer positioned on the support to couple to a second side of the malleus.

In many embodiments, the first transducer is positioned on the support to couple to the first side of the malleus and the second transducer is positioned on the support to coupled to the second side of the malleus which is opposite the first side of the malleus.

In many embodiments, the support comprises a first protrusion extending to the first transducer to couple the first side of the malleus to the first transducer and a second protrusion extending to the second transducer to couple the second side of the malleus to the second transducer.

In many embodiments, the first transducer and second transducer are positioned on the support and configured to twist the malleus with a first rotation about a longitudinal axis of the malleus when the first transducer and second transducer move in opposite directions. The first transducer and second transducer can be positioned on the support and configured to rotate the malleus with a second hinged rotation when the first transducer and second transducer move in similar directions.

In many embodiments, the device further comprises circuitry coupled to the first transducer and the second transducer. The circuitry is configured to generate a first signal to drive the transducer and a second signal to drive the second transducer. In some embodiments, the circuitry is configured to generate the first signal at least partially out of phase with the second signal and drive the malleus with a twisting motion. The circuitry can be configured to drive the first transducer substantially in phase with the second transducer at a first frequency below about 1 kHz, and the circuitry can be configured to drive the first transducer at least about ten degrees out of phase with the second transducer at a second frequency above at least about 2 kHz.

In many embodiments, the first transducer comprises at least one of a first piezoelectric transducer, a first coil and magnet transducer, a first magnetostrictive transducer or a first photostrictive transducer, and the second transducer comprises at least one of a second piezoelectric transducer, a second coil and magnet transducer, a second magnetostrictive transducer or a second photostrictive transducer.

In another aspect, embodiments of the present invention provide a method of transmitting an audio signal to a user. The user has an ear comprising an eardrum. The method comprises supporting a mass and a piezoelectric transducer with a support on the eardrum of the user and driving the support and the eardrum with a first force and the mass with a second force, the second force opposite the first force.

In many embodiments, the ear comprises a mechanical impedance. The mass, the piezoelectric transducer and the support comprise a combined mechanical impedance. The combined mechanical impedance matches the mechanical impedance of the eardrum for at least one audible frequency within a range from about 1 kHz to about 6 KHz.

In another aspect, embodiments of the present invention provide a method of transmitting an audio signal to a user. The user has an ear comprising an eardrum. The method comprises supporting circuitry and a transducer coupled to the circuitry with the eardrum and transmitting the audio signal with a wireless signal to the circuitry to drive the transducer in response to the audio signal.

In another aspect, embodiments of the present invention provide a method of transmitting an audio signal to a user. The user has an ear comprising an eardrum having a mechanical impedance. The method comprises supporting a transducer and a support coupled to the eardrum with the eardrum. A combined mass of the support and the transducer supported thereon matches the mechanical impedance of the eardrum for at least one audible frequency between about 0.8 kHz and about 10 kHz.

In another aspect, embodiments of the present invention provide a method of transmitting an audio signal to a user. The user has an ear comprising an eardrum and a malleus connected to the ear drum at an umbo. The method comprises supporting a transducer with a support positioned on the eardrum and vibrating the support and the eardrum with the transducer positioned away from the umbo. In many embodiments, a first movement of the transducer is decreased relative to a second movement of the umbo when the eardrum is vibrated and the second movement of the umbo is amplified relative to the first movement of the transducer.

In another aspect, embodiments of the present invention provide a method of transmitting an audio signal to a user. The user has an ear comprising an eardrum and a malleus connected to the eardrum at an umbo. The method comprises supporting a first transducer and a second transducer with a support positioned on the eardrum. The first transducer and the second transducer are driven in response to the audio signal to the twist the malleus such that the malleus rotates about an elongate longitudinal axis of the malleus.

BRIEF DESCRIPTION OF THE DRAWINGS

A hearing aid system using wireless signal transduction is shown in FIG. 1, according to embodiments of the present invention;

FIGS. 8B1 and 8B2 shows a perspective view of ring mass with a bimorph piezo with flexible structures to couple the bimorph piezo to the ring mass, in accordance with the system of FIGS. 1A to 3;

FIG. 12 FIGS. 12A-12I show an exemplary graph of simulation results for an output transducers in accordance with the systems of FIGS. 1A to 3;

DETAILED DESCRIPTION OF THE INVENTION

Embodiments of the present invention can provide optically coupled hearing devices with improved audio signal transmission. The systems, devices, and methods described herein may find application for hearing devices, for example open ear canal hearing aides. Although specific reference is made to hearing aid systems, embodiments of the present invention can be used in any application in which a signal is wirelessly received and converted into a mechanical output.

As used herein, the umbo of the eardrum encompasses a portion of the eardrum that extends most medially along the ear canal, so as to include a tip, or vertex of the ear canal. As used herein, a twisting motion and/or twisting encompass a rotation of an elongate body about an elongate axis extending along the elongate body, for example rotation of a rigid elongate bone about an elongate axis of the bone. Twisting as used herein encompasses rotation of the elongate body both with torsion of the elongate body about the elongate axis and also without torsion of the elongate body about the elongate axis. As used herein torsion encompasses a strain, or deformation, that can occur with twisting, such that one part of the elongate body twists, or rotates, more than another part of the elongate body.

Figure 1:
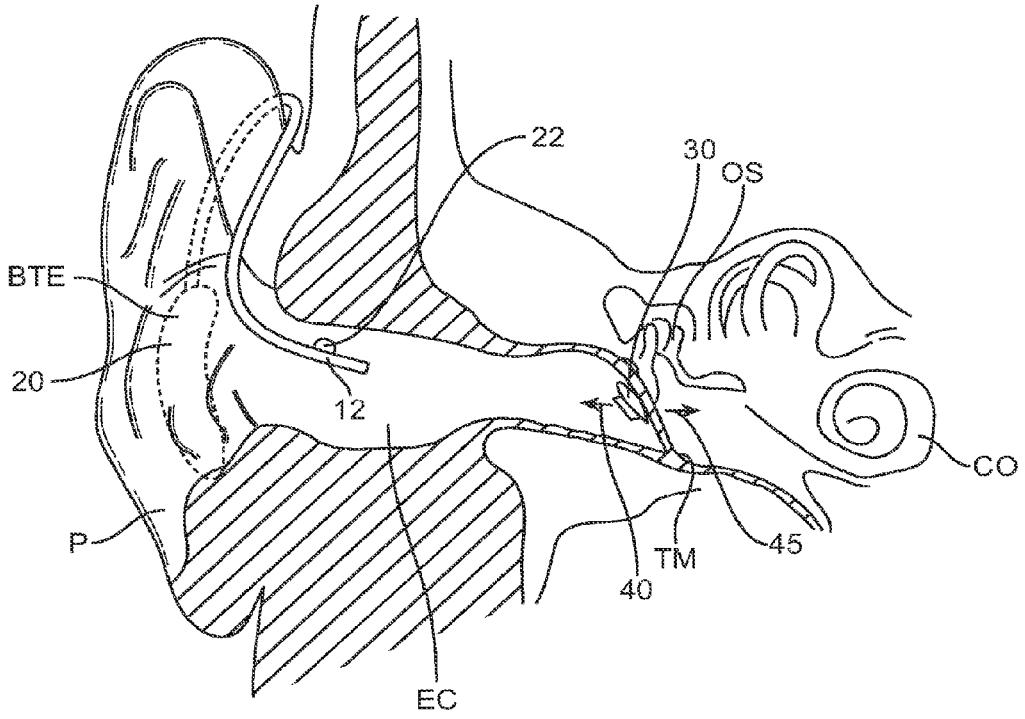

FIG. 1 shows a hearing aid system using wireless signal transduction. The hearing system 10 includes an input transducer assembly 20 and an output transducer assembly 30. Hearing system 10 may comprise a behind the ear unit BTE. Behind the ear unit BTE may comprise many components of system 10 such as a speech processor, battery, wireless transmission circuitry and input transducer assembly 10. Behind the ear unit BTE may comprise many component as described in U.S. Pat. Pub. Nos. 2007/0100197, entitled "Output transducers for hearing systems"; and 2006/0251278, entitled "Hearing system having improved high frequency response". The input transducer assembly 20 is located at least partially behind the pinna P, although an input transducer assembly may be located at many sites such as in pinna P or entirely within ear canal EC. The input transducer assembly 20 can receive a sound input, for example an audio sound. With hearing aids for hearing impaired individuals, the input can be ambient sound. The input transducer assembly comprises an input transducer, for example a microphone 22. Microphone 22 can be positioned in many locations such as behind the ear, if appropriate. Microphone 22 is shown positioned within ear canal near the opening to detect spatial localization cues from the ambient sound. The input transducer assembly can include a suitable amplifier or other electronic interface. In some embodiments, the input may comprise an electronic sound signal from a sound producing or receiving device, such as a telephone, a cellular telephone, a Bluetooth connection, a radio, a digital audio unit, and the like.

Input transducer assembly 20 includes a signal output source 12 which may comprise an electromagnetic source such as a light source such as an LED or a laser diode, an electromagnet, an RF source, or the like. Alternatively, an amplifier of the input assembly may be coupled to the output transducer assembly with a conductor such as a flexible wire, conductive trace on a flex printed circuitry board, or the like. The signal output source can produce an output signal based on the sound input. Output transducer assembly 30 can receive the output source signal and can produce mechanical vibrations in response. Output transducer assembly 30 may comprise a transducer responsive to the electromagnetic signal, for example at least one photodetector, a coil responsive to the electromagnet, a magenetostrictve element, a photostrictive element, a piezoelectric element, or the like. When properly coupled to the subject's hearing transduction pathway, the mechanical vibrations caused by output transducer assembly 30 can induce neural impulses in the subject which can be interpreted by the subject as the original sound input.

The output transducer assembly 30 can be configured to couple to a point along the hearing transduction pathway of the subject in order to induce neural impulses which can be interpreted as sound by the subject. As shown in FIG. 1, the output transducer assembly 30 may be coupled to the tympanic membrane or eardrum TM. Output transducer assembly 30 may be supported on the eardrum TM by a support, housing, mold, or the like shaped to conform with the shape of the eardrum TM. A fluid may be disposed between the eardrum TM and the output transducer assembly 30 such as an oil, a mineral oil, a silicone oil, a hydrophobic liquid, or the like. Output transducer assembly 30 can cause the eardrum TM to move in a first direction 40 and in a second direction 45 opposite the first direction 40, such that output transducer assembly 30 may cause the eardrum TM to vibrate. Specific points of attachment are described in prior U.S. Pat. Nos. 5,259,032; and 6,084,975, the full disclosures of which are incorporated herein by reference and may be suitable for combination with some embodiments of the present invention.

Figure 1A:
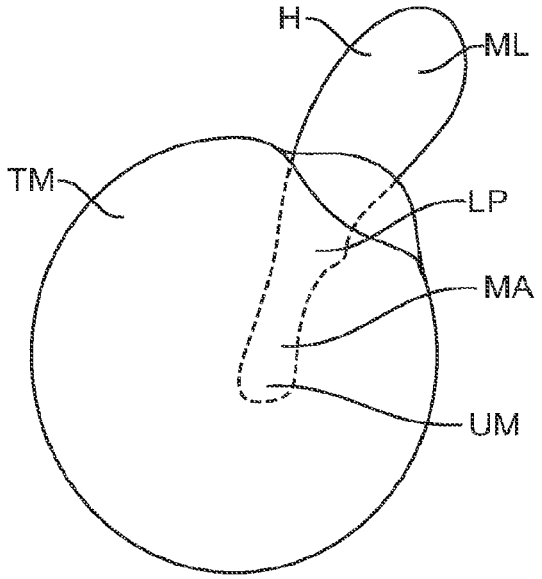
FIG. 1A shows the lateral side of the eardrum and FIG. 1B shows the medial side of the eardrum, suitable for incorporation of the hearing aid system of FIG. 1.
Figure 1B:
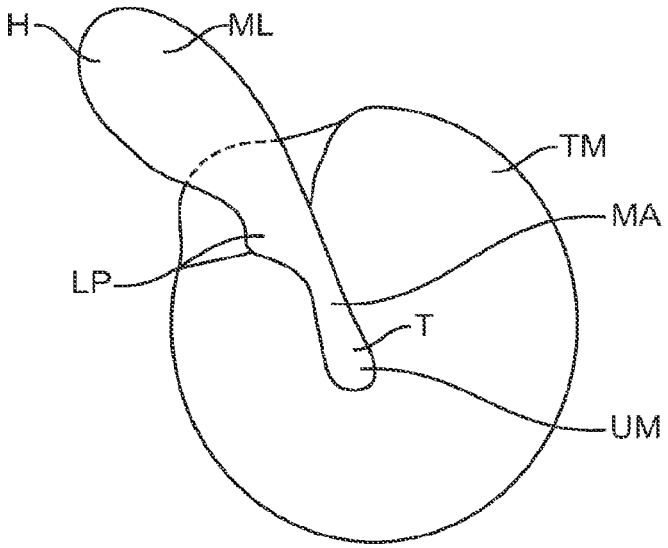

FIG. 1A shows structures of the ear suitable for placement of the output transducer assembly from the lateral side of the eardrum TM, and FIG. 1B shows structures of the ear from the medial side of the eardrum TM. The eardrum TM is connected to a malleus ML. Malleus ML comprises a head H, a manubrium MA, a lateral process LP, and a tip T. Manubrium MA is disposed between head H and tip T and coupled to eardrum TM, such that the malleus ML vibrates with vibration of eardrum TM.

Figure 1C:
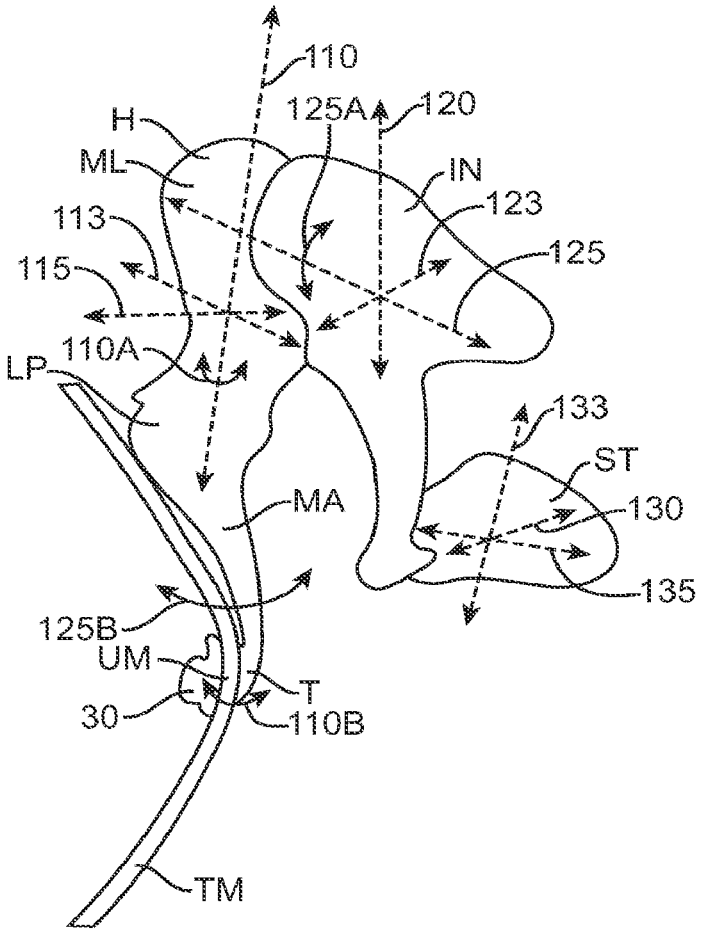
FIGS. 1C and 1D show the eardrum coupled to the ossicles including the malleus, incus, and stapes, and locations of attachment for the hearing aid system shown in FIG. 1.

FIG. 1C. shows output transducer assembly 30 coupled to the eardrum TM on the umbo UM to transmit vibration so that the user can perceive sound. Eardrum TM is coupled to the ossicles including the malleus ML, incus IN, and stapes ST. The manubrium MA of the malleus ML can be firmly attached to eardrum TM. The most depressed or concaved point of the eardrum TM comprises the umbo UM. Malleus ML comprises a first axis 110, a second axis 113 and a third axis 115. Incus IN comprises a first axis 120, a second axis 123 and a third axis 125. Stapes ST comprises a first axis 130, a second axis 133 and a third axis 135.

The axes of the malleus ML, incus IN and stapes ST can be defined based on moments of inertia. The first axis may comprise a minimum moment of inertia for each bone. The second axis comprises a maximum moment of inertia for each bone. The first axis can be orthogonal to the second axis. The third axis extends between the first and second axes, for example such that the first, second and third axes comprise a right handed triple. For example first axis 110 of malleus ML may comprise the minimum moment of inertia of the malleus. Second axis 113 of malleus ML may comprise the maximum moment of inertia of malleus ML. Third axis 115 of malleus ML can extend perpendicular to the first and second axis, for example as the third component of a right handed triple defined by first axis 110 and second axis 113. Further first axis 120 of incus IN may comprise the minimum moment of inertia of the incus. Second axis 123 of incus IN may comprise the maximum moment of inertia of incus IN. Third axis 125 of incus IN can extend perpendicular to the first and second axis, for example as the third component of a right handed triple defined by first axis 120 and second axis 123. First axis 130 of stapes ST may comprise the minimum moment of inertia of the stapes. Second axis 133 of stapes ST may comprise the maximum moment of inertia of stapes ST. Third axis 135 of stapes ST can extend perpendicular to the first and second axis, for example as the third component of a right handed triple defined by first axis 130 and second axis 133.

Vibration of the output transducer system induces vibration of eardrum TM and malleus ML that is transmitted to stapes ST via Incus IN, such that the user perceives sound. Low frequency vibration of eardrum TM at umbo UM can cause hinged rotational movement 125A of malleus ML and incus IN about axis 125. Translation at umbo UM and causes a hinged rotational movement 125B of the tip T of malleus ML and hinged rotational movement 125A of malleus ML and incus IN about axis 125, which causes the stapes to translate along axis 135 and transmits vibration to the cochlea. Vibration of eardrum TM, for example at higher frequencies, may also cause malleus ML to twist about elongate first malleus axis 110 in a twisting movement 110A. Such twisting may comprise twisting movement 1108 on the tip T of the malleus ML. The twisting of malleus ML about first malleus axis 110 may cause the incus IN to twist about first incus axis 120. Such rotation of the incus can cause the stapes to transmit the vibration to the cochlea where the vibration is perceived as sound by the user.

With the output transducer assembly positioned over the eardrum TM on the umbo UM, the combined mass of the output transducer assembly can be from about 10 to about 60 mg, for example from about 10 to about 40 mg. In some embodiments, the combined mass comprises no more than about 50 mg. The combined mass may comprise the mass of the support, the transducer, a mass opposite the support and/or the circuitry to receive a wireless signal and drive the transducer. The support can be configured to support the transducer, a mass opposite the support and/or the circuitry to receive a wireless signal and drive the transducer with the eardrum when the support is placed against the eardrum.

Figure 1D:
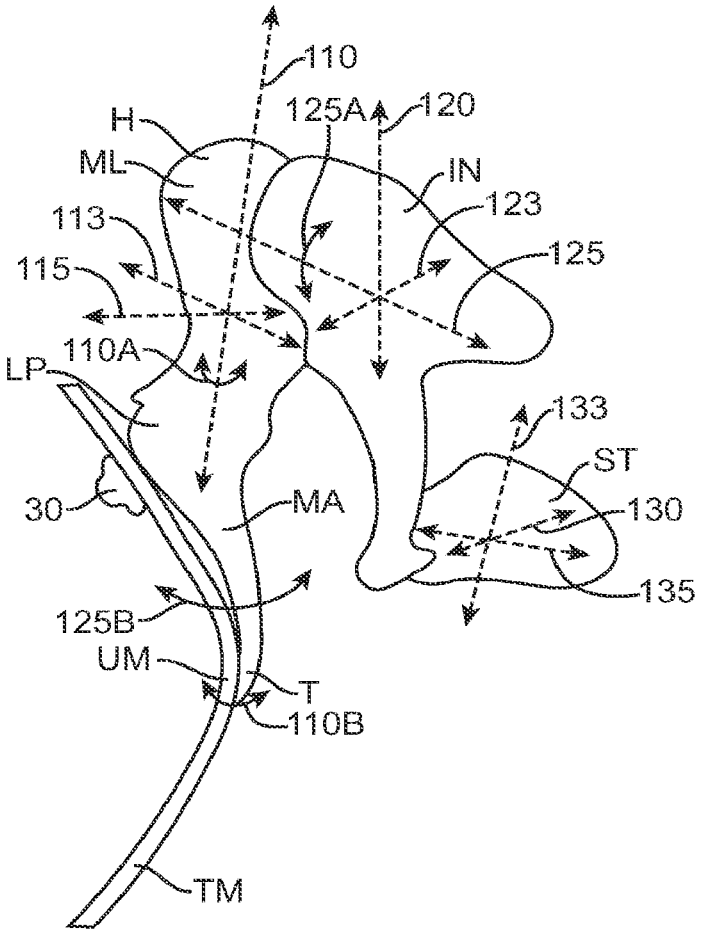

FIG. 1D shows output transducer assembly 30 coupled on the TM away from umbo UM, for example over the lateral process LP of the malleus ML. Output transducer assembly 30 may be placed on other parts of the eardrum as well. Depending on the placement of output transducer assembly 30 on the eardrum TM, the mechanical impedance of the output transducer assembly 30 and the eardrum TM may vary. Placement of output transducer assembly 30 away from the umbo UM allows for increased mass of the lateral process while minimizing occlusion. For example, with placement over the lateral process, the mass of the output transducer assembly may comprise approximately twice the mass as when placed over the umbo without causing occlusion. For example, an output transducer assembly comprising a mass of 60 mg positioned over the lateral process will provide a mechanical impedance and occlusion similar to a 30 mg mass positioned over the umbo. Further the vibration of the transducer at the lateral process is amplified from the lateral process to the umbo, for example by a factor of two due to leverage of the malleus with hinged rotation from the head of the malleus to the tip near the umbo.

The mass of transducer assembly 30 for placement away from the umbo can be similar to ranges described above for the configuration placed over the umbo, and may be scaled accordingly. For example, with the output transducer assembly positioned over the eardrum TM away from the umbo UM, for example over the lateral process, the combined mass of the output transducer assembly can be from about 20 to about 120 mg, for example from about 40 to about 80 mg. In many embodiments, the combined mass of output transducer assembly 30 over the lateral process can be from about 20 mg to about 60 mg to provide occlusion and transmission losses similar to a mass of about 10 mg to about 30 mg over the umbo.

Output transducer assembly 30 may have a number of exemplary specifications for maximum output. Output transducer assembly 30 may produce a sound pressure level of up to 106 dB. For example, a sound pressure level of up to at least about 90 dB can be sufficient to provide quality hearing for many hearing impaired users. The "center" of the eardrum, or the umbo, may move at 0.1 um/Pa at 1 kHz and 0.01 um/Pa at 10 kHz. The velocity can be 630 um/s/Pa from about 1 kHz and 10 kHz. The area of the eardrum may be about 100 $mm^2$. The ear drum may have an impedance of about 0.2 Ns/m for frequencies greater than 1 kHz, which may be damping in nature, and an impedance of about 1000 N/m for frequencies less than 1 kHz in nature, which may be stiffening in nature. Thus, the power input into the ear at up to 106 dB SPL may be up to about 1 uW.

Output transducer assembly 30 may comprise a number of exemplary specifications for frequency response. Output transducer assembly 30 can have a frequency response of 100 Hz to 10 kHz. For an open canal system, it may be acceptable if low frequency response rolls off below 1 kHz since most hearing impaired subjects have relatively good low frequency hearing and the natural sound pathway can provide this portion of the sound spectrum. A relatively flat response may be good and it may be ideal if a resonance is generated at 2-3 kHz without affecting response at other frequencies. Variability between subjects may be +/−3 dB. This includes variability due to variable insertions and movement of the transducer with jaw movements. Variability across subjects may be +1-6 dB. Even in low responding subjects may need to have adequate output above their thresholds at all frequencies. Subject based calibrations may likely be problematic for clinicians and best avoided if possible.

Output transducer assembly 30 may further comprise a number of other exemplary specifications. For example, output transducer assembly 30 may have less than 1 percent harmonic distortion of up to 100 db SPL and less than 10 percent distortion of up to 106 db SPL. Output transducer may have less than 30 dB SPL noise equivalent pressure at the input. Output transducer may provide 15 dB of gain up to 1 kHz and 30 dB of gain above 1 kHz.

I. Power Sources

Both power and signal may be transmitted to the output transducer assembly 30. 1 uW of power into the ear may need to be generated to meet maximum output specifications. Methods of transmitting power may include light (photovoltaic), ultrasound, radio frequency, magnetic resonant circuits.

In exemplary embodiments, a piezoelectric transducer driven by a photovoltaic (PV) cell or a number of photovoltaic (PV) in placed in series. The maximum voltage and current provided by the cells can be limited by the area and the amount of incident light upon them. 70 mW may be a good upper limit for the amount of electrical power available for the output transducer at its maximum output. This power can be limited by the amount of heat that can be dissipated as well as battery life considerations.

LEDs may be about 5% efficient in their conversion of electrical power into light power. The maximum light power coming out of the LEDs may be near 3.5 mW. The light coming out of the LED can cover a broader area than the area of the photovoltaic cell. The broader area may be set based on the movement of the ear canal and the ability to point the light directly at the photovoltaic cells. For example, a spot with a diameter that is twice a wide as a square 3.16 mm×3.16 mm photocell may be used. This spot size would have an area of 31.4 $mm^2$ (leading to an optical efficiency of 32%). The photodetector area may comprise two parts—one part to move the transducer in a first direction and another part to move the transducer in a second direction, for example as described in U.S. Pat. App. No. 61/073,271, filed on Jun. 17, 2008, entitled "OPTICAL ELECTRO-MECHANICAL HEARING DEVICES WITH COMBINED POWER AND SIGNAL ARCHITECTURES", the full disclosure of which is incorporated herein by reference. This two part photodetector area may further reduce the efficiency by a factor of two to 16%. This efficiency may be improved depending on the result of studies showing how much the motion of the ear canal moves the light as well as the ability to initially point the light down the ear canal. With a 16% efficiency, 560 uW of light power impinges on the surface of each of the two photovoltaics. The device may comprise at least one photo detector, for example as described in U.S. Pat. App. No. 61/073,281, filed Jun. 17, 2008, entitled "OPTICAL ELECTRO-MECHANICAL HEARING DEVICES WITH SEPARATE POWER AND SIGNAL COMPONENTS", the full disclosure of which is incorporated by reference.

Figure 2:
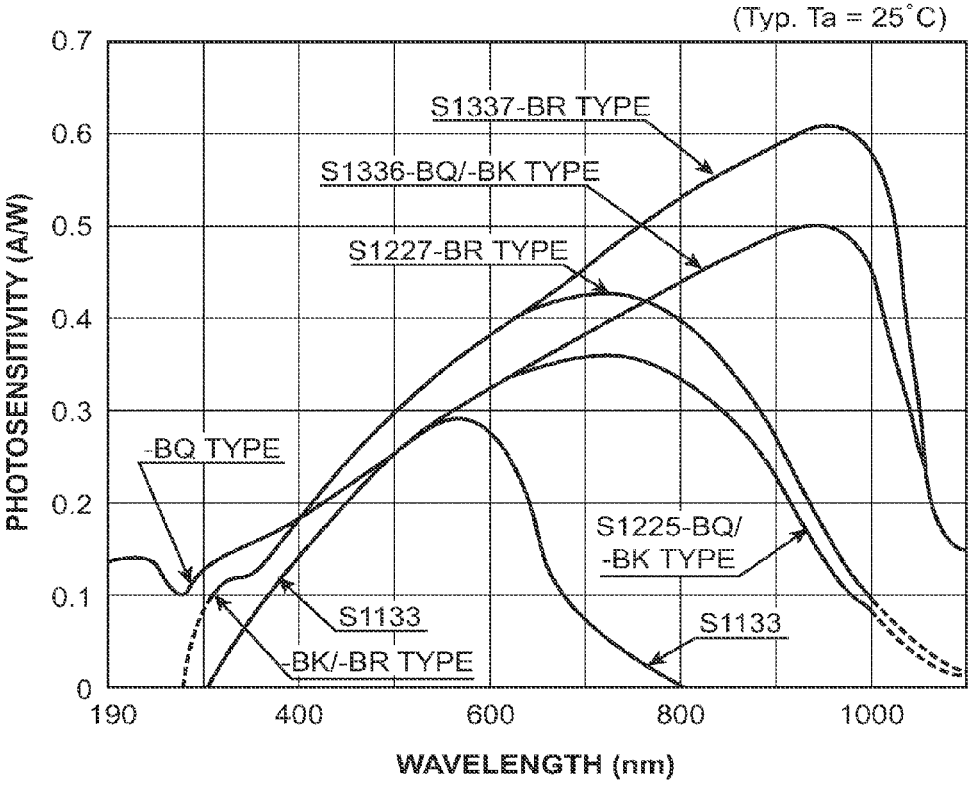
FIG. 2 shows the sensitivity of silicon photovoltaics to different wavelengths of light, suitable for incorporation with the system of FIGS. 1A to 1D.

FIG. 2 shows the sensitivity of silicon photovoltaics to different wavelengths of light. The sensitivity of a photodetector is how much current is produced per unit power of incident light (A/W). In FIG. 2, maximum light intensity of 560 uW may be 336 uA at infrared wavelengths (S=0.6 A/W @ 900-1000 nm) or 224 uA in the "red" range (S=0.4 A/W @ 650 nm). Red LEDs may be more efficient than infrared LEDs, so the increased efficiency of the LEDs may overcome the decreased sensitivity of the photodetector at those wavelengths. The maximum available currents may be in the 220-340 uA range. The voltage characteristic of the photodetector is set by the "diode" action of the junction. Starting a 0.3 V, an increasingly non-linear voltage response may be encountered. Hence the maximum effective voltage of the photodetector for our application may be 0.4V. Multiplying this 0.4V by the 224 uA one obtains 90 uW. Taking this 90 uW and dividing by the 560 uW of light power in gives an efficiency of 16%. One may also use the photocells in series to increase the amount of voltage available. However, the area of each photocell may need to be reduced to keep the total area the same. This may have the effect that voltage may be traded for current and vice versa, however the total amount of power remains fixed.

The LED/photovoltaic system may supply approximately 224 uA of current and 0.4V. Voltage can be increased by putting cells in series but the voltage increase may be at the proportional cost of current. 90 uW of power may be available to the transducer for producing motion of the eardrum. However, the amount of power utilized can depend on the load characteristics. The optimal load may be a 1800 ohm resistor (0.4V/224 uA). In either the piezoelectric case (capacitive load) or the voice coil case (inductive load), the load impedance may change as a function of frequency. A frequency at which this optimal impedance is matched may be chosen. For the capacitive load case, the system may be current limited above this frequency and voltage limited below this frequency. For the inductive load case, the situation may reverse. In the current limited cases, one may not be able to reach the desired maximum output levels. In the voltage limited regions, driving the system too hard may highly distort the output. If 2 kHz is chosen as the optimal frequency, this impedance may correspond to a capacitance of 44 nF or an inductance of 143 mH. Even with an optimal load attached, the overall efficiency of the optical power transfer is 0.04%. Yet even with this efficiency, the amount of power produced by the PV is 90× greater than what we expect to need to input into the ear.

Table 1 below summarizes the above-mentioned exemplary power specifications.

TABLE 1

EXEMPLARY POWER SPECIFICATIONS FOR OUTPUT TRANSDUCER

| Parameter | Formula | Value | Comment |
|---|---|---|---|
| Input Power Maximum | | 70 mW | May be chosen based on magnetic system experience with heat and battery life. |
| LED efficiency | | 5% | May be based on literature and experimental data |
| Area of illumination | $pR^2$ | R = 3.16 mm<br>A = 31.4 $mm^2$ | May be a reasonable guess based on what will be required for robust illumination of photodetectors |
| Area of photodetectors | $\frac{b^2}{2}$ | b = 3.16 mm<br>A = 5 $mm^2$ | May be based on what area of the eardrum is easily viewable from a mid ear canal location. Remember that only half of the area is available for each photodetectors (hence the divide by 2). |
| Optical efficiency | $\frac{A_{illium}}{A_{pv}} \times 100\%$ | 16% | |
| Maximum optical power incident on photodetectors | $E_{optical}E_{LED}P_{max}$ | 560 mW | |
| Sensitivity of PV @ IR (~950 nm) | | 0.6 A/W | |
| Sensitivity of PV @ Red (~650 nm) | | 0.4 A/W | |
| Maximum PV current @ IR | $S_{pv}P_{\lambda PV}$ | 336 mA | |
| Maximum PV current @ Red | $S_{PV}P_{\lambda PV}$ | 224 mA | |
| Maximum PV voltage | | 0.4 V | Maximum voltage for ~10% distortion. (0.3 V for ~1%) |
| Maximum PV power @ Red | $V_{PVmax}I_{PVmax}$ | 90 mW | |
| Optimal Load for PV | $\frac{V_{PV_{max}}}{I_{PV_{max}}}$ | 1800 ohms | |
| Overall efficiency | $\frac{P_{PV}}{P_{max\square}} \times 100\%$ | 0.13% | |

Other power transmission potions may include ultrasonic power transmission, magnetic resonant circuits, and radiofrequency power transmission. For magnetic resonant circuits, the basic concept is to produce two circuits that resonant with each other. The "far" coil should only draw enough power from the magnetic fields to perform its task. Power transfer may be in the 30-40% efficient range.

II. Output Transducer Specifications

In exemplary embodiments, an output transducer may comprise two major characteristics; the physics used to generate motion and the type of reference method used. The choices for the physics used to generate motion can include electromagnetic (voice coils, speakers, and the like), piezoelectric, electrostatic, pryomechanical, photostrictive, magnetostrictive, and the like. Regardless of what physics are used to generate motion, the energy of the motion can be turned into useful motion of the eardrum. In order to produce motion, forces or moments that act against the impedance of the eardrum may be generated. To generate forces or moments, the reaction force or moment is resisted. To resist such forces or movements, a fixed anchor point may be introduced, a floating inertia may be used, for example, utilizing translational and rotational inertia, or deforming an object so that the boundaries produce a net force that moves the object, i.e., using a deformation transducer.

Figure 3:
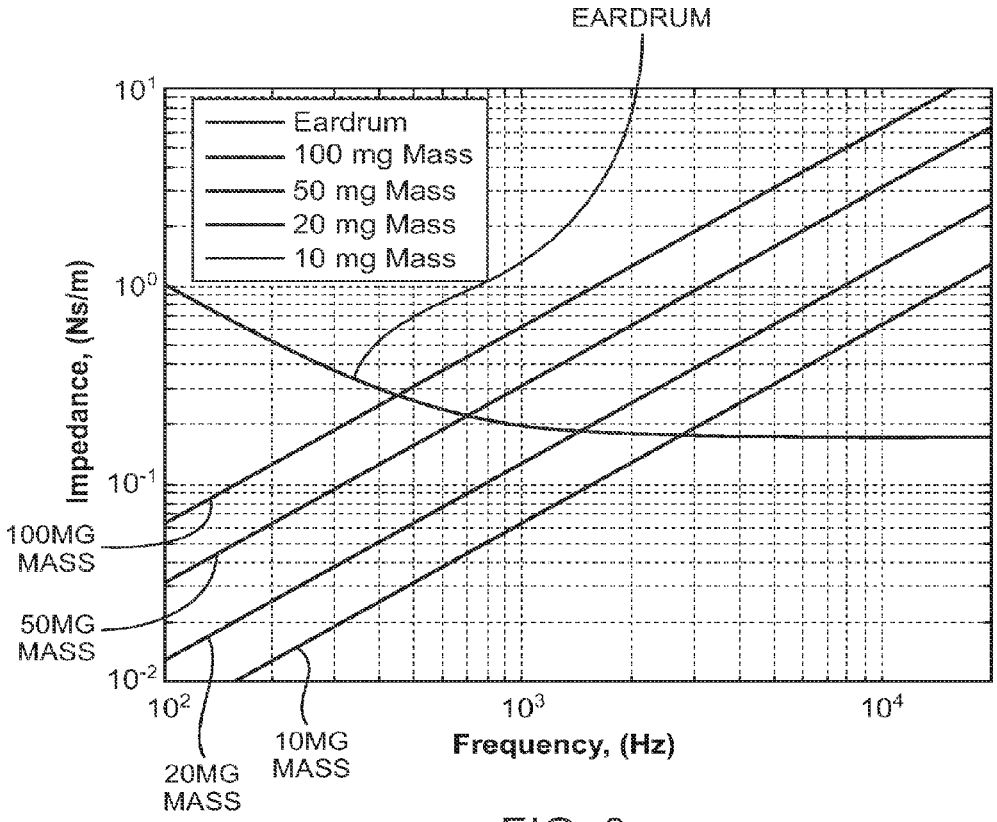
FIG. 3 shows the mechanical impedance of the eardrum in relation to that of various masses, in accordance with the system of FIGS. 1A to 2.

FIG. 3 is a graph showing the mechanical impedance of the eardrum in relation to that of various masses of 100 mg, 50 mg, 20 mg, and 10 mg. The impedance of the eardrum matches the masses of 100 mg, 50 mg, 20 mg, and 10 mg at frequencies of about 450 Hz, 700 Hz, 1.5 kHz, 3 kHz, respectively. The impedance of the mass can be dependent on the location of the eardrum. By placing the mass away from the umbo, the impedance can be decreased, for example halved, when the mass is positioned on the short or lateral process of the malleus, for example. For example, a mass of 40 mg can have an impedance at 1.5 kHz that is similar to a 20 mg mass so as to match the impedance of the eardrum TM.

Exemplary physical specifications may be placed on the transducer based on the size of the ear canal, the ability of an output transducer to remain in position and the perception of occlusion resulting from having a mass present on the eardrum. Table 2 below show these specifications.

TABLE 2

EXEMPLARY PHYSICAL SPECIFICATIONS FOR OUTPUT TRANSDUCER

| Parameter | Value | Comment |
|---|---|---|
| Maximum dimension in plane with annular ligament of TM | <5 mm | If the dimension gets larger, then manipulating the transducer into place may become difficult for physicians and may not fit down some ear canals. |
| Maximum dimension perpendicular to TM | <2 mm | If the dimension gets larger, then the anterior wall that "hangs" over the TM may begin to get in the way. |
| Maximum mass | 60 mg | A mass of 46 mg may result in significant "occlusion". Other embodiments may be able to hold more weight. There may be evidence that at even this weight gravity may shift the position of the transducer depending on the orientation of the head and the support to TM coupling. |

Output transducer assembly 30 may use a piezoelectric element to generate motion. Material properties of exemplary piezoelectric elements are shown in the table 3 below.

TABLE 3

MATERIAL PROPERTIES OF EXEMPLARY PIEZOELECTRIC ELEMENTS

| | APC disk bender | APC Tapecast | APC stacked | STEMinc | TRS single crystal | APC single crystal |
|---|---|---|---|---|---|---|
| Material | APC 855 | APC 850 | APC PST 150 | 7 × 7 × .2 SMQA | TRS PMN-PT | APC PMN-PT |
| Density (kg/m3) | 7600 | 7700 | 8000 | 7900 | 7900 | 8200 |
| Curie Temperature | 200 | 360 | 155 | 250 | 166 | |
| k33 | 0.76 | 0.72 | | | 0.91 | 0.92 |
| d31 (×10-12 m/V) | 276 | 175 | 290 | 140 | 1000 | 930 |
| d33 (×10-12 m/V) | 600 | 400 | 640 | 310 | 1900 | 2000 |
| E33 (N/m2) | 5.10E+10 | 5.40E+10 | 5.56E+10 | 7.30E+10 | 1.16E+10 | |
| relative dielectric constant (Er33) | 3400 | 1900 | 5400 | 1400 | 7700 | 4600 |
| E11 (N/m2) | 5.90E+10 | 6.30E+10 | | 8.40E+10 | | 2.48E+10 |
| kp | 0.68 | 0.63 | | 0.58 | | 0.92 |
| kt | | | | 0.45 | 0.55 | 0.6 |
| k31 | 0.4 | 0.36 | | 0.34 | 0.51 | 0.72 |

III. Exemplary Output Transducers

Figure 6:
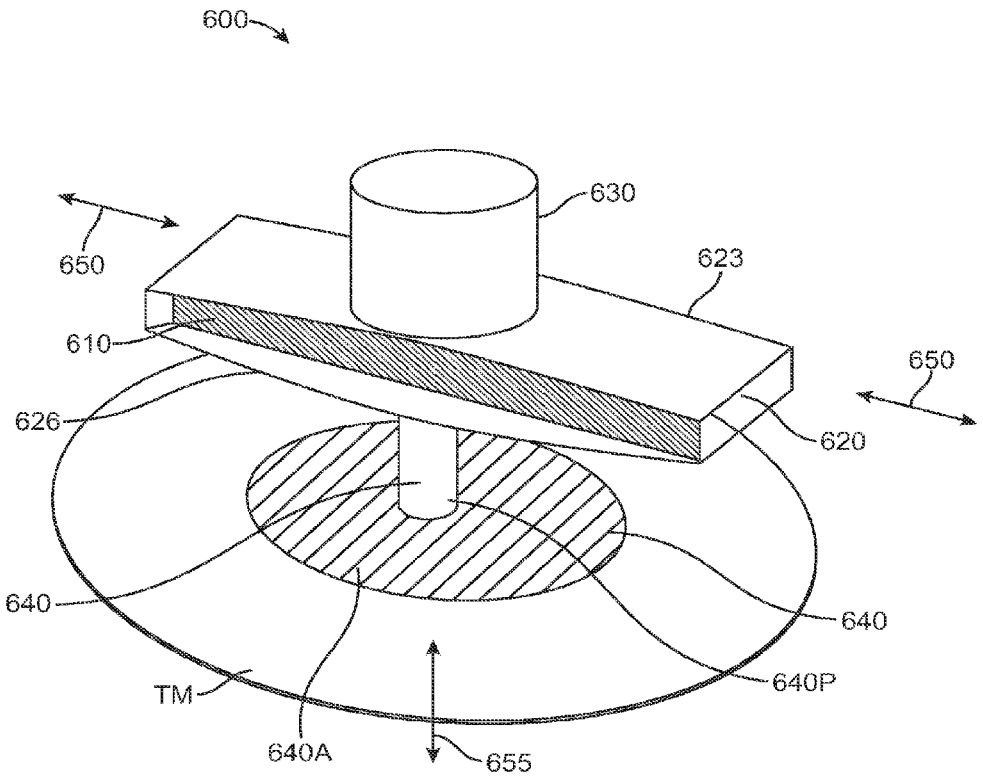
FIG. 6 shows a stacked piezo with mechanical multiplier, in accordance with the system of FIGS. 1A to 3.
Figure 7:
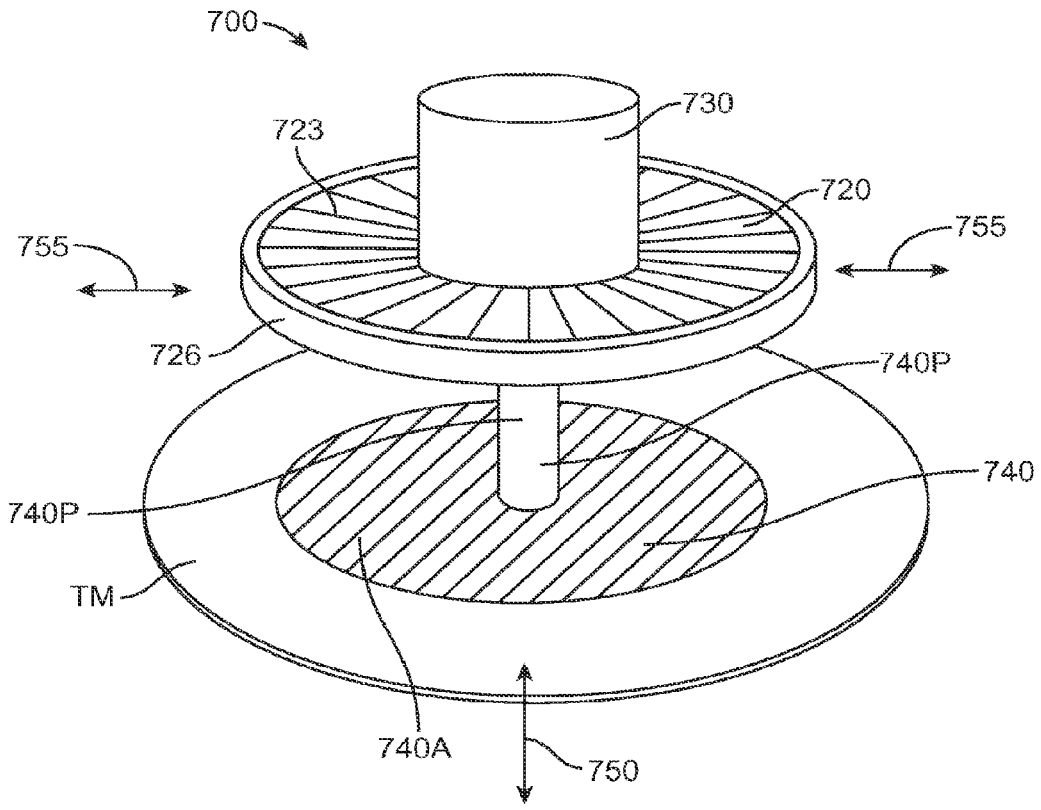
FIG. 7 shows a narrow ring piezo with a mechanical multiplier, in accordance with the system of FIGS. 1A to 3.
Figure 8:
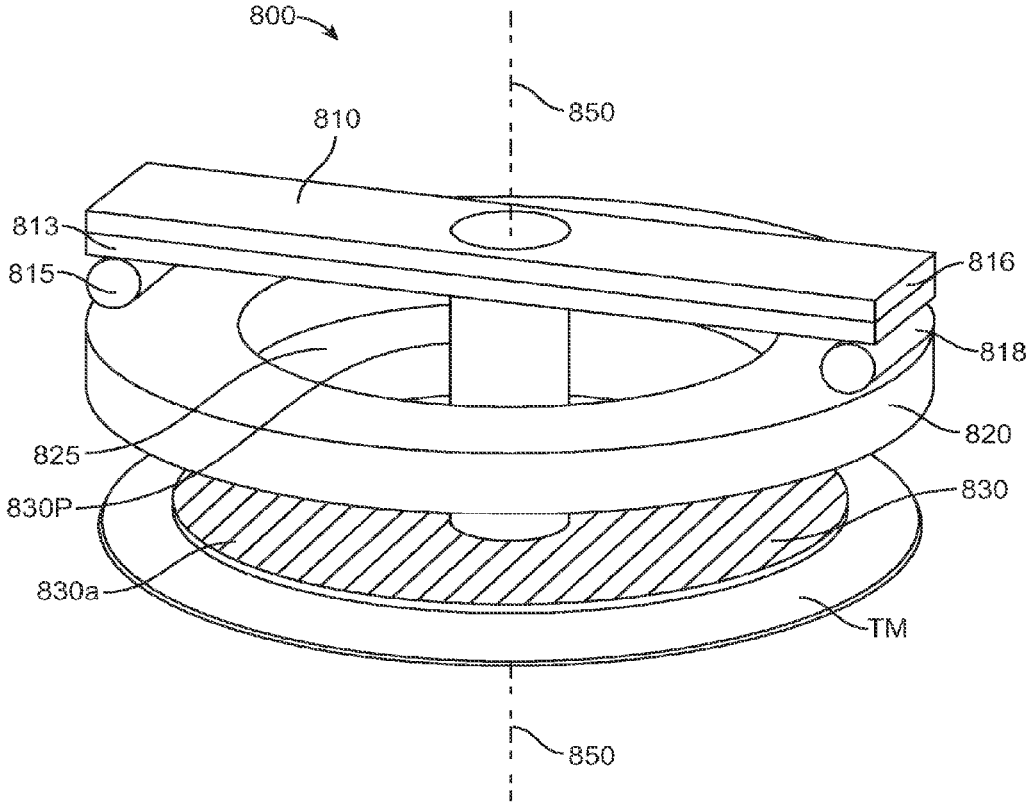
FIG. 8 shows a ring mass with bimorph piezo, in accordance with the system of FIGS. 1A to 3.

Output transducer assembly 30 may comprise a piezoelectric based output transducer, for example, a transducer comprising a piezoelectric unimorph, piezoelectric bimorph, or a piezoelectric multimorph. Exemplary output transducers may comprise a simply supported bimorph bender 400 as shown in FIG. 4, a cantilevered bimorph bender 500 as shown in FIG. 5, a stacked piezo with mechanical multiplier 600 as shown in FIG. 6, a disk or narrow ring piezo with a mechanical multiplier 700 as shown in FIG. 7 or a ring mass with bimorph piezoelectric transducer 800 as shown in FIG. 8.

Figure 4:
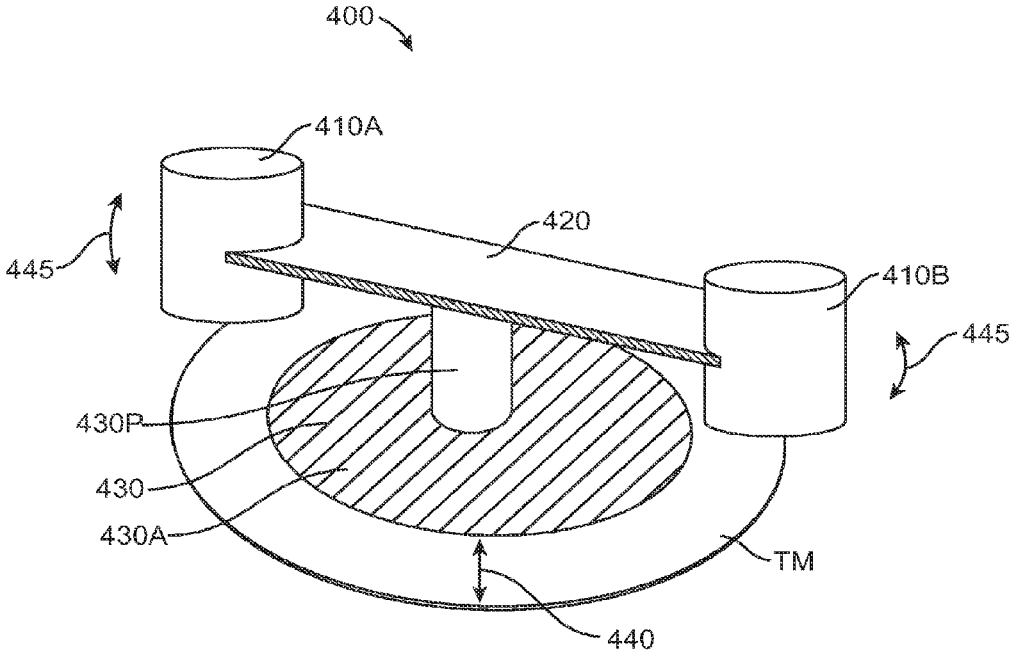
FIG. 4 shows a simply supported bimorph bender, in accordance with the systems of FIGS. 1A to 3.

FIG. 4 shows a simply supported bimorph bender 400 suitable for incorporation with transducer assembly 30 as described above. Simply supported bimorph bender 400 comprises a first mass 410*a*, a second mass 410*b*, a bimorph piezoelectric cantilever 420, and a support 430. Cantilever 420 extends from a first end supporting first mass 410*a* to a second end supporting second mass 410*b*. Cantilever 420 is coupled with the support 430 comprising a protrusion 430*p* extending from the support to the transducer to couple the support to the transducer between the first and second ends. Support 430 may be configured to support the first and second masses 410*a*, 410*b* and the bimorph cantilever 420 on the eardrum TM. For example, support 430 may comprise a mold shaped to conform with the eardrum TM, for example support 430 can be shaped with known molding techniques. The portion 430*a* of support 430 which is in contact with the fluid that couples to the eardrum TM can be flexible, for example, by comprising a flexible material such as silicone, flexible plastic, a gel, or the like. Other portions of support 430, for example protrusion 430P may be rigid, for example, by comprising a metal, titanium, a rigid plastic, or the like. Simply supported bimorph bender 400 may comprise circuitry which receives an external, wireless signal and causes cantilever 420 to change shape. Cantilever 420 may push against masses 410*a*, 410*b* causing a force on the masses 410*a*, 410*b* in a direction 445 and also cause a force on support 430 in a direction 440 opposite direction 445. The force on support 430 drives the eardrum TM to produce sensations of sound.

Figure 5A:
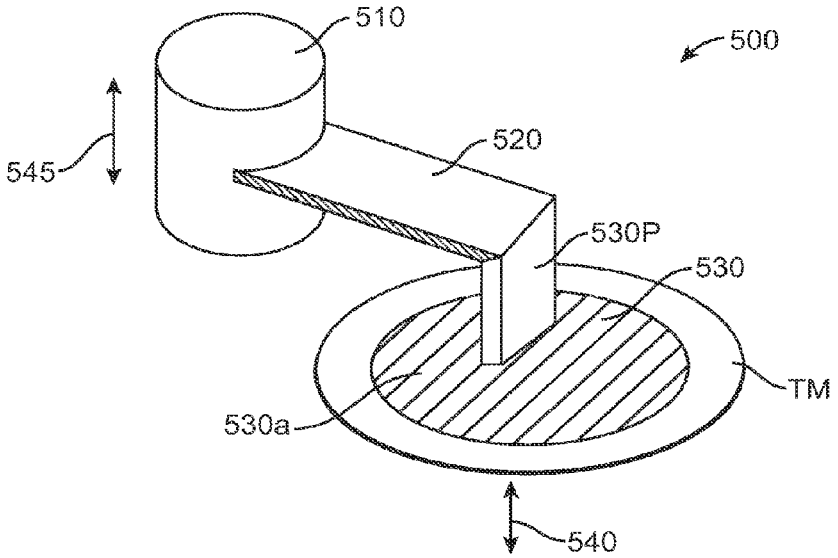
FIG. 5A shows a cantilevered bimorph bender, in accordance with the system of FIGS. 1A to 3.

FIG. 5A shows a cantilevered bimorph bender 500 suitable for incorporation with transducer assembly 30 as described above. Cantilevered bimorph bender 500 includes a mass 510, a bimorph cantilever 520 extending from mass 510, and a support 530 coupled with cantilever 520. Support 530 may be configured to support mass 510 and bimorph cantilever 520 on the eardrum TM, which may not be drawn to scale in FIG. 5A. For example, support 530 may comprise a mold shaped to conform with the eardrum TM. Cantilever 520 is coupled with the support 530 comprising a protrusion 530*p* extending from the support to the transducer. The portion 530*a* of support 530 which is in contact with the eardrum TM can be flexible, for example, by comprising a flexible material such as silicone, flexible plastic, a gel, or the like. Other portions of support 530 may be rigid, for example, by comprising a metal, titanium, a rigid plastic, or the like. Cantilevered bimorph bender 500 may comprise circuitry configured to receive an external, wireless signal and cause cantilever 520 to bend and thus push against mass 510. The pushing action causes a force in a direction 545 on the mass 510 and also a force on the support 530 in a direction 540 opposite the direction 545. The force on the support 530 drives the eardrum TM to produce sensations of sound.

Figure 5B:
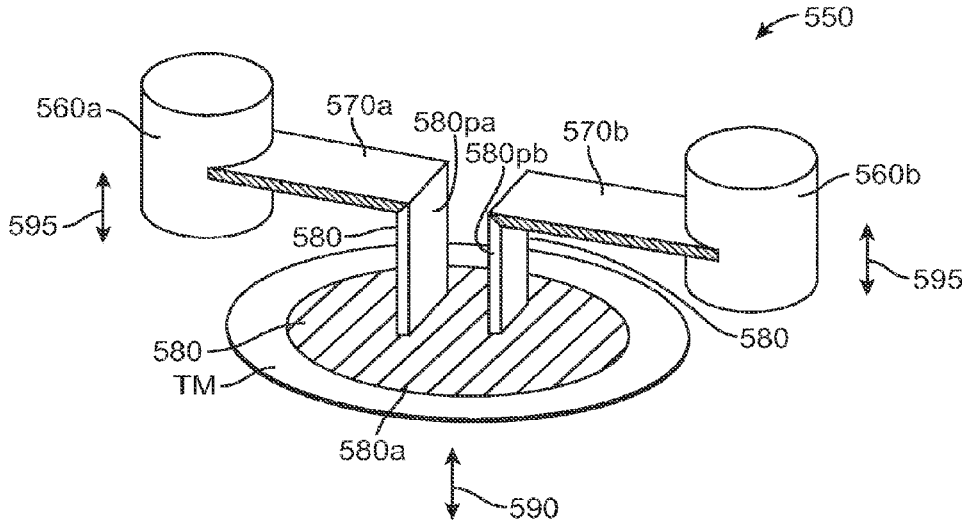
FIG. 5B shows cantilevered bimorph bender which includes a first mass and a second mass, in accordance with the system of FIGS. 1A to 3.

Cantilevered bimorph bender 500 includes mass 510 and cantilever 520. Some embodiments may include more than one mass, cantilever, and/or support. FIG. 5B shows cantilevered bimorph bender 550 suitable for incorporation with transducer assembly 30 as described above. Bimorph bender 550 includes a first mass 560*a* and a second mass 560*b*. A first cantilevered bimorph 570*a* is coupled to first mass 560*a*. A second cantilevered bimorph 570*b* is coupled to second mass 560*b*. A support 580 is coupled to the first cantilevered bimorph 570*a* and second cantilevered bimorphs 570*b*. First cantilevered bimorph 570*a* is coupled with the support 580 comprising a protrusion 580*p*. Second cantilevered bimorph 570*b* is coupled with the support 580 comprising a protrusion 580*pb*. Support 580 may be configured to support masses 560*a*, 560*b* and bimorph cantilevers 570*a*, 5706 on the eardrum TM, which may not be drawn to scale on FIG. 5B. For example, support 580 may comprise a mold shaped to conform with the eardrum TM. The portion 580*a* of support 580 which is in contact with the eardrum TM can be flexible, for example, by comprising a flexible material such as silicone, flexible plastic, a gel, or the like. Other portions of support 580 may be rigid, for example, by comprising a metal, titanium, a rigid plastic, or the like. Cantilevered bimorph bender 550 may comprise circuitry configured to receive an external, wireless signal and cause cantilevers 570*a*, 570*b* to bend and thus push against masses 560*a*, 560*b*, respectively. The pushing action causes force in a direction 595 on the masses 560*a*, 560*b* and also a force on the support 580 in a direction 590 opposite the direction 595. The force on the support 580 causes a translational movement which drives the eardrum TM to produce sensations of sound. Cantilevers 570*a*, 570*b* may push masses 560*a*, 560*b* in tandem to cause support 540 to translate and drive the eardrum TM. Cantilevers 570*a*, 570*b* may also push masses 560*a*, 5706 in different orders as to cause a rotational or twisting movement of the support 580 and the eardrum TM.

FIG. 6 shows a stacked piezo with mechanical multiplier 600 suitable for incorporation with transducer assembly 30 as described above. The stacked piezo 600 comprises a plurality of piezoelectric elements or a stacked piezoelectric array 610, mechanical multiplier 620, a mass 630, and a support 640. The piezoelectric array 610 may be held by mechanical multiplier 620. Mechanical multiplier 620 is coupled to mass 630 on side 623 and support 640 on side 626. Mechanical multiplier 620 is coupled with the support 640 comprising a protrusion 640*p* extending from the support to the transducer. Support 640 may be configured to support mechanical multiplier 620 and the piezoelectric array 610 and the mass 630 on the eardrum TM, which may not be drawn to scale in FIG. 6. For example, support 640 may comprise a mold shaped to conform with the eardrum TM. The portion 630*a* of support 630 which is in contact with the eardrum TM can be flexible, for example, by comprising a flexible material such as silicone, flexible plastic, a gel, or the like. Other portions of support 640 may be rigid, for example, by comprising a metal, titanium, a rigid plastic, or the like. Stacked piezo 600 may comprise circuitry configured to receive an external, wireless signal and cause the piezoelectric array 610 to expand or contract along axis 650. Mechanical multiplier 620 uses leverage to multiply this expansion and contraction and change its direction to a direction along axis 655, thereby producing a force against mass 630 and support 640. The force on support 640 drives the eardrum TM to produce sensations of sound.

FIG. 7 shows a narrow ring piezo with a mechanical multiplier 700 suitable for incorporation with transducer assembly 30 as described above. The narrow ring piezo 700 comprises a piezoelectric ring 710, disc-shaped mechanical multiplier 720, a mass 730, and a support 740. Mechanical multiplier 720 is coupled to mass 730 and support 740. Mechanical multiplier 720 is coupled with the support 740 comprising a protrusion 740*p* extending from the support to the transducer. Support 740 may be configured to support mechanical multiplier 720 and the piezoelectric ring 710 and the mass 730 on the eardrum TM. For example, support 740 may comprise a mold shaped to conform with the eardrum TM. The portion 740*a* of support 740 which is in contact with the eardrum TM can be flexible, for example, by comprising a flexible material such as silicone, flexible plastic, a gel, or the like. Other portions of support 740 may be rigid, for example protrusion 740P that extends to the bimorph, by comprising a metal, titanium, a rigid plastic, or the like. Mechanical multiplier 720 comprises a first side 723 and a second side 726, the first side 723 extends inwardly from piezoelectric ring 710 to mass 730 and the second side 726 extends inwardly from piezoelectric ring 710 to support 740. Narrow ring piezo 700 may comprise circuitry configured to receive an external, wireless signal and cause the piezoelectric ring 710 to expand or contract along axis 750. Mechanical multiplier 720 uses leverage to multiply this expansion and contraction and change its direction to that along axis 755, producing a force against mass 730 and support 740. The force on support 740 drives the eardrum TM to produce sensations of sound.

FIG. 8 shows a ring mass with bimorph piezoelectric transducer 800 suitable for incorporation with transducer assembly 30 as described above. Piezoelectric transducer 800 comprises contact elements contact elements 815 and 818 to connect a washer ring 820 to a piezoelectric bimorph 810. Ring mass with bimorph piezoelectric transducer 800 comprises a piezoelectric bimorph 810, contact elements 815, 818, a washer ring 820 which can serve as a mass and which defines an aperture 825, and a support 830 coupled to the bimorph 810, the support 830 coupled with bimorph 810 and passing through aperture 825 at least in part. Bimorph 810 may comprise a single crystal bimorph. Support 830 may be configured to support bimorph 810 on the eardrum TM. For example, support 830 may comprise a mold shaped to conform with the eardrum TM. The portion 830*a* of support 830 which is in contact with the eardrum TM can be flexible, for example, by comprising a flexible material such as silicone, flexible plastic, a gel, or the like. Other portions of support 830, for example protrusion 830*p*, may be rigid, for example, by comprising a metal, titanium, a rigid plastic, or the like. Bimorph 810 comprises a first end 813 and a second end 816. First end 813 and second end 816 are respectively coupled to ring 820 through contact elements 815 and 818, for example, through the use of an adhesive. Ring mass with bimorph piezoelectric transducer 800 may be coupled to circuitry configured to receive an external, wireless signal and cause bimorph 810 to flex in response. Flexion of bimorph 810 produces a shearing force or shear motion of first end 813 and second end 816 relative to washer ring 820 and produces a translational force along axis 850 so as to drive support 830 against the eardrum TM, producing sensations of sound.

Figure 8A:
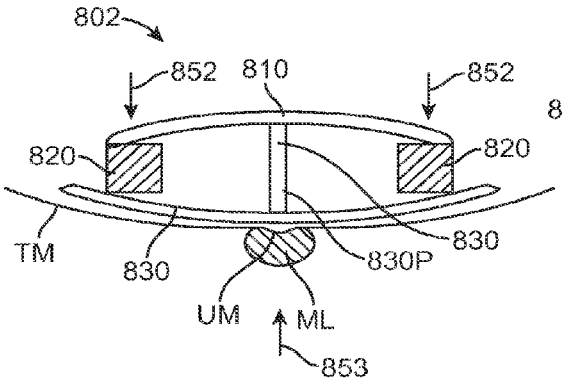
FIGS. 8A and 8B show a cross-sectional view and a top view, respectively, of a ring mass with bimorph piezo, in accordance with the system of FIGS. 1A to 3.
Figure 8B:
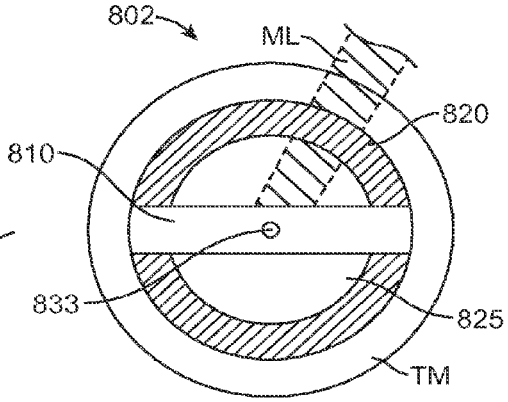

FIGS. 8A and 8B show a ring mass with bimorph piezoelectric transducer 802 suitable for incorporation with transducer assembly 30 as described above. FIG. 8*a* shows a cross-sectional view of ring mass with bimorph piezoelectric transducer 802. FIG. 8*b* shows a top view of ring mass with bimorph piezoelectric transducer 802. Bimorph 810 can be directly connected to washer ring 820 which can serve as a mass. Bimorph 810 is coupled with a support 830 comprising a protrusion 830*p* extending from the support to the transducer. Support 830 may be configured to support washer bimorph 810 and washer 820 on the eardrum TM. The portion of support 830 which is in contact with the eardrum TM can be flexible, for example, by comprising a flexible material such as silicone, flexible plastic, a gel, or the like. Other portions of support 830 may be rigid, for example, the portions may comprise a metal, titanium, a rigid plastic, or the like. For example, support 830 may comprise a mold shaped to conform with the eardrum TM. Support 830 may be configured so that protrusion 830*p* is directly over the umbo UM. Ring mass with bimorph piezoelectric transducer 802 may comprise circuitry configured to receive an external, wireless signal and cause bimorph 810 to bend or flex and thus push against washer 820. The pushing action causes a force in a direction 852 on washer 820 and also a force on the support 830 in a direction 853. The force on the support 830 causes a translational movement of the umbo UM which can rotate malleus ML to produce sensations of sound.

FIGS. 8B1 and 8B2 show perspective views of mass, for example a ring mass, with a piezoelectric transducer, for example a bimorph piezoelectric transducer 803, in which the mass is coupled to the piezoelectric transducer with a flexible intermediate structure, for example intermediate element 815, suitable for incorporation with transducer assembly 30 as described above. The flexible intermediate structure can relax a boundary condition at the edge of the piezoelectric transducer so as to improve performance of the piezoelectric transducer coupled to the mass. Although an elongate rod is shown, the flexible intermediate structure may comprise many known flexible shapes such as coils, spheres and leafs. Bimorph 810 is indirectly and flexibly connected to washer ring 820. The ends of bimorph 810 can be directly connected to intermediate elements 815. Intermediate elements 815 can in turn be directly connected to washer ring 820. Washer ring 820 can serve as a mass. The ends of bimorph 810 may be rigidly attached to intermediate elements 815, for example, via an adhesive or glue. Intermediate elements 815 may be rigidly attached to intermediate elements 815, for example, via an adhesive or glue. Intermediate elements 815 is flexible so as to provide a flexible boundary condition or a flexible connection between bimorph 810 and washer ring 820. For example, intermediate elements 815 may comprise a rod made of a flexible material such as carbon fiber or a similar composite material. Such a flexible material may be more prone to twisting than bending. By providing such a flexible boundary condition, the force outputted by transducer 803 can be greater, for example, twice as great, as the force outputted if bimorph 810 were instead directly and rigidly connected to washer ring 820.

Bimorph 810 is coupled with a support 830. Support 830 comprises a protrusion 830P protruding from the bimorph 810 and a support member 830E adapted to conform with the eardrum TM. Protrusion 830P is coupled to support member 830E. For example, protrusion 830P can comprise a first magnetic member 831P and support member 830E may comprise a complementary second magnetic member 831E so that protrusion 830P and support member 830E are magnetically coupled. Both first magnetic member 831P and second magnetic member 831E may comprise magnets. Alternatively, one of first magnetic member 831P or second magnetic member 831E may comprise a magnet while the other comprises a ferromagnetic material. To position transducer 803 on the eardrum TM, support member 830E may first be placed on the eardrum TM, followed by the remainder of the transducer 803 as guided by first magnetic member 831P and second magnetic member 831E. The use of magnetism to guide the positioning of transducer 803 can reduce a hearing professional's reliance on vision to position transducer 803 on the eardrum TM.

Support member 830E may comprise a mold shaped to conform with the eardrum TM. Support member 830E can comprise a flexible material such as silicone, flexible plastic, a gel, or the like. The portion of support member 830E in contact with protrusion 830P may be rigid, for example, the portions may comprise a metal, titanium, a rigid plastic, or the like. Support 830 may be configured so that protrusion 830P is directly over the umbo UM. Transducer 803 may also comprise circuitry 824. Circuitry 824 may be configured to receive an signal, for example, an external, wireless signal. Circuitry 824 can cause bimorph 810 to bend or flex and thus push against washer 820. The pushing action causes a force in a direction 852 on washer 820 and also a force on the support 830 in a direction 853. The force on the support 830 causes a translational movement of the umbo UM which can rotate malleus ML to produce sensations of sound.

Figure 8C:
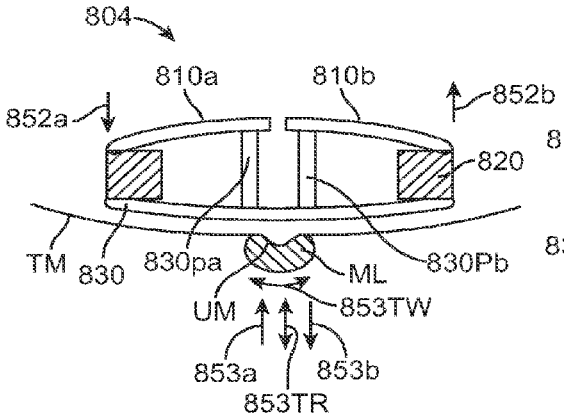
FIGS. 8C and 8D show a cross-sectional view and a top view, respectively, of a ring mass with dual bimorph piezo, in accordance with the systems of FIGS. 1A to 3.
Figure 8D:
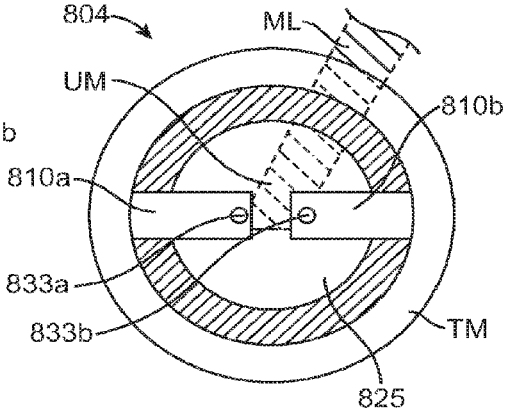

FIGS. 8C and 8D show embodiments that comprise more than one bimorph, for example a ring mass dual bimorph piezoelectric transducer 804, suitable for incorporation with transducer assembly 30 as described above. Transducer 804 may comprise a mass from about 20 mg to about 60 mg, for example about 40 mg. Ring mass with double bimorph piezoelectric transducer 804 comprises first transducer, for example first bimorph 810*a* and second transducer, for example second bimorph 810*b*. Malleus ML extends into the ear canal, and first bimorph 810*a* and second bimorph 810*b* may extend along a line substantially perpendicular to malleus ML, or first bimorph 810*a* and second bimorph 810*b* may extend along a line oblique to Malleus ML. Bimorph 810*a* and bimorph 810*b* are coupled to a ring or washer 820 which comprises a mass. Bimorph 810*a* and bimorph 810*b* are supported by support 830 comprising protrusions 830*pa* and 830*pb*, which are coupled to bimorph 810*a* and bimorph 810*b*, respectively. The portion of support 830 which is in contact with the eardrum TM can be flexible, for example, by comprising a flexible material such as silicone, flexible plastic, a gel, or the like. Other portions of support 830 may be rigid, for example comprising a metal, titanium, a rigid plastic, or the like. For example, support 830 may comprise a mold shaped to conform with the eardrum TM.

Ring mass with double bimorph piezoelectric transducer 804 may comprise circuitry configured to receive an external, wireless signal and cause bimorph 810*a* and bimorph 810*b* to bend and/or flex and thus push against washer 820. The wireless signal may comprise a first signal configured to drive first bimorph 810*a* and a second signal configured to drive second bimorph 810*b*. The pushing action of the first transducer in response to the first signal causes a first force in a first direction 852*a* on washer 820 and an opposite force on the support 830 in an opposite direction 853*a*. The pushing action of the second transducer in response to the second signal causes a second force in a second direction 852*b* on washer 820 and an opposite force on the support 830 in an opposite direction 8536. The force on the support 830 in first direction 853*a* and second direction 853*b* causes a translational movement which drives the eardrum TM to produce sensations of sound.

The dual transducer 804 allows the malleus to be driven in more than one dimension, for example with a first translational motion to rotate the malleus with hinged motion about the head of the malleus and second rotational motion to twist the malleus about an elongate axis of the malleus extending from a head of the malleus toward the umbo. When bimorphs 810*a* and 810*b* are flexed at the same time and in the same direction, ring-mass-double-bimorph-piezoelectric-transducer 804 may work similar to same as ring-mass-double-bimorph-piezoelectric-transducer 804. However, flexion of bimorphs 810*a* and 810*b* at different times and/or in different directions or phase may produce a rotational twisting motion along the elongate axis of the malleus with support 830 and thus induce rotation at the umbo of eardrum TM. For example, the received external, wireless signal may cause only one of bimorph 810*a* and bimorph 810*b* to bend or flex. Alternatively or in combination, the received external, wireless signal may cause bimorph 810*a* to bend or flex more than bimorph 810*b*, or vice versa, so as to cause a rotational twisting motion of the malleus to occur along with the hinged rotation motion of the malleus to translate the umbo of eardrum TM. Arrows 853TW show twisting motion of the malleus at umbo UM with a first rotation of the malleus about an elongate axis of the malleus. Arrows 853TR show translational motion of the umbo UM with hinged rotation of the malleus comprising pivoting of the malleus about the head of the malleus. The first transducer and the second transducer can be driven with a signal having a time delay, for example a phase delay of 90 degrees, such that translation movement and twisting of the malleus and umbo occur. Thus, a first portion support 830 may translate in a first direction 853 and a second portion of support 830 may translate in a second direction 853*b* opposite first direction 853*a* so as to rotate the malleus with twisting motion. Thus, the first transducer and the second transducer comprising bimorphs 810*a* and 810*b* can be driven so as to cause translational movement and a rotational movement of eardrum TM. Hinged rotational movement of the malleus to effect translational movement of the umbo UM may be made at low frequencies less than about 5 kHz, for example frequencies less than about 1 kHz. Rotational twisting movement of the malleus may be made at frequencies greater than about 2 kHz, for example high frequencies greater than 5 kHz.

Figure 8E:
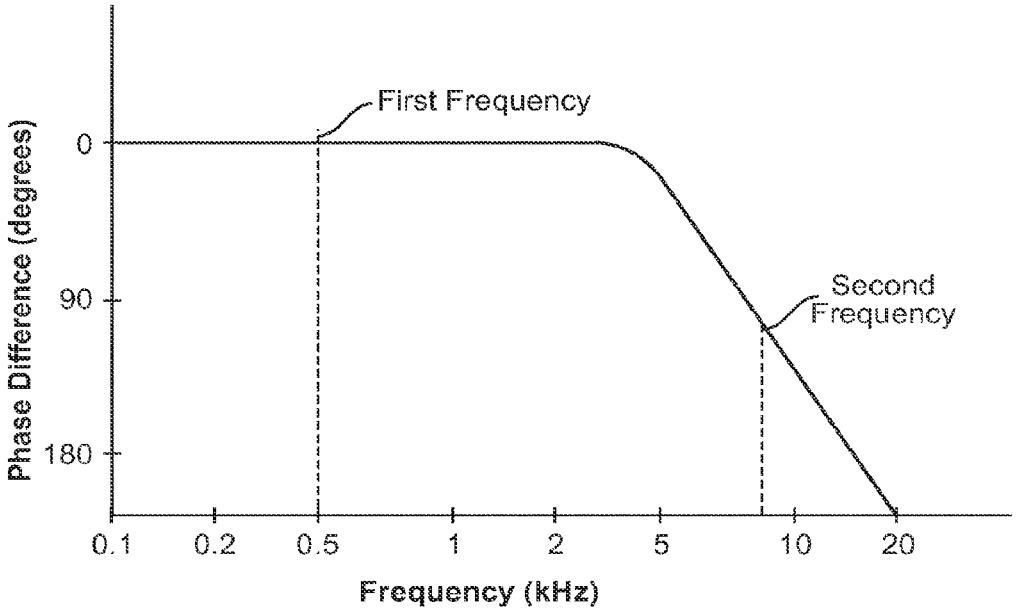
FIG. 8E shows a plot of phase difference versus frequency for the first and second transducers of the dual bimorph piezo of FIGS. 8C and 8D.

FIG. 8E shows a plot of phase difference versus frequency for the first and second transducers of the dual bimorph piezo of FIGS. 8C and 8D. This phase difference can result in increased frequency gain at high frequencies above about 5 kHz, such that the user can hear the high frequency sounds more clearly due to the twisting of the malleus. At a first frequency below about 1 kHz, for example 0.5 kHz, the phase difference between the first transducer and the second transducer is substantially zero. At a second frequency above from about 3 to 6 kHz, for example above about 5 KHz, the phase difference between the first transducer and the second transducer is at least about 10 degrees. For example, at about 9 kHz, the phase difference between the first transducer and the second transducer may comprise about 100 degrees. The phase difference between the first transducer and the second transducer can be provided in many ways, for example with the audio processor as described above, configured to output a first channel to the first transducer and a second channel to the second transducer. The circuitry coupled to the first transducer and the second transducer may be configured to provide the first signal phase shifted from the second signal in response to the audio signal, for example with circuitry comprising at least one of a capacitor, a resistor or an inductor configured to provide a phase shift of the audio signal such that the first signal is phase shifted from the second signal.

Figure 9:
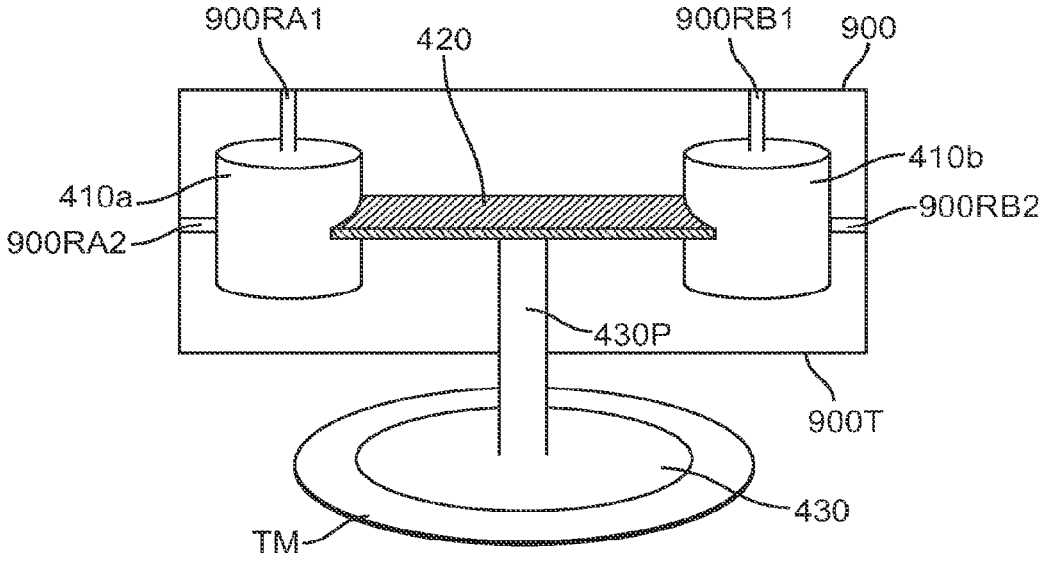
FIG. 9 shows a simply supported bimorph bender with a housing, in accordance with the systems of FIGS. 1A to 4.

FIG. 9 shows simply supported bimorph bender 400 housed in a hermetically sealed housing 900 suitable for incorporation with transducer assembly 30 as described above. Housing 900 may comprise many known biocompatible materials. In many embodiments, an output transducer may comprise a hermetically sealed housing. Housing 900 may be rigidly affixed to masses 410*a* and 410*b* with rigid connections. First mass 410*a* is connecting to housing 900 with rigid connections 900RA1 and 900RA2. Second mass 410*b* is connecting to housing 900 with rigid connections 900RB1 and 900RB2. Housing 900 can provide additional mass for bimorph 420 to push against. A rigid portion 430P of support 430 extends through housing 900 to bimorph 420. Hermitically sealed housing 900 may be configured for many of the above described transducers, for example piezoelectric at least one of cantilevered bimorph bender 500, 550, stacked piezo with mechanical multiplier 600, disk or narrow ring piezo with a mechanical multiplier 700, or transducer 800.

Figure 9A:
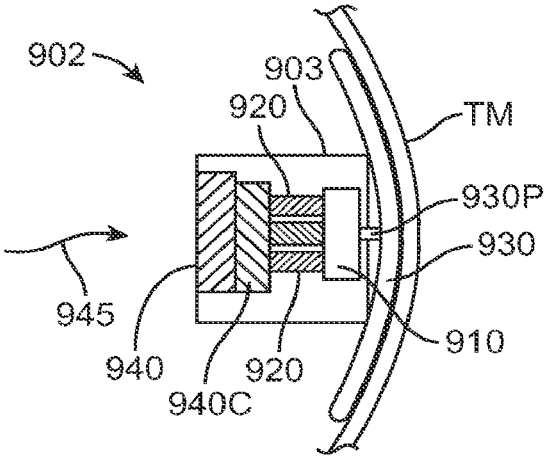
FIG. 9A shows an optically powered output transducer, in accordance with the systems of FIGS. 1A to 3.

FIG. 9A shows an output transducer 902 which receives power through optical transmission suitable for incorporation with transducer assembly 30 as described above. Output transducer 902 may comprise a piezoelectric transducer, a magnetostrictive transducer, a photostrictive transducer, a coil and a magnet, or the like. As shown in FIG. 9A, output transducer 902 comprises a piezoelectric transducer 910 which is coupled to annular mass 920. Piezoelectric transducer 910 and mass 920 are both supported by support 930. Piezoelectric transducer 910 may comprise many of the piezoelectric elements described above, for example at least one of a bimorph, a cantilevered bimorph, a stacked piezo, or a disc or ring piezo. Mass 920 may be similar to many of the masses as previously discussed. Piezoelectric transducer 910 can be powered by a photodetector 940 which receives light 945. Light 945 may comprise a signal, for example, a signal representative of sound as described above. Photodetector 940 can be coupled to circuitry 940*c*. Circuitry 940*c* can be supported with support 930, mass 920, piezoelectric transducer 930 and support 930. Circuitry 940 can be coupled to piezoelectric transducer 910 to convert light 945 into an electrical signal which can cause piezoelectric transducer 910 to move and cause vibrations on eardrum TM which may lead to a sensation of sound. A housing 903 extends around piezoelectric transducer 910, circuitry 940*c*, mass 920 and photodetector 940 to hermetically seal transducer 902.

Figure 9B:
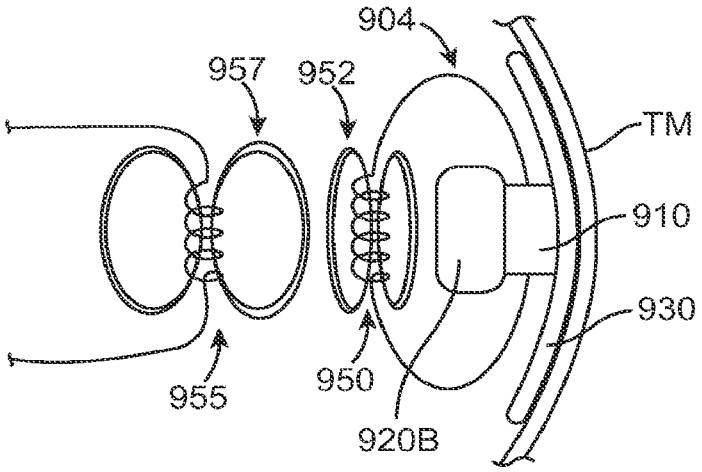
FIG. 9B shows a magnetically powered output transducer, in accordance with the systems of FIGS. 1A to 3.

FIG. 9B shows an output transducer 904 which receives power through magnet and/or electric power transmission suitable for incorporation with transducer assembly 30 as described above. Output transducer 904 may comprise a piezoelectric transducer, a magnetostrictive transducer, a photostrictive transducer, a coil and a magnet, or the like. Output transducer 904 comprises a piezoelectric transducer 910 coupled to a mass 920B. Piezoelectric transducer 910 and mass 920B are both supported by support 930. Piezoelectric transducer 910 may comprise many of the piezoelectric elements described above, for example at least one of a bimorph, a cantilevered bimorph, a stacked piezo, or a disc or ring piezo. Mass 920B may be similar to many of the masses as previously discussed. Piezoelectric transducer 910 can be powered by an external coil 955 which produces a magnetic field 957 which causes a magnetic field 952 and a voltage in coil 950. Coil 950 is coupled to and powers piezoelectric transducer 910. Coil 950 can be supported with mass 920B, transducer 910 and support 930. The electromagnetic field 957 produced by external coil 955 may provide a signal, for example, a signal representative of sound, to coil 950. Appropriate variations in magnetic field 957 and magnetic filed 952 can cause piezoelectric transducer 910 to cause vibrations on eardrum TM which may lead to a sensation of sound.

Tables 4 and 5 below show characteristics of exemplary piezoelectric output transducers as described above, including simply supported bimorph bender 400, cantilevered bimorph bender 500, stacked piezo with mechanical multiplier 600, disk or narrow ring piezo with a mechanical multiplier 700, and bimorph or wide ring piezo 800.

TABLE 4

EXEMPLARY PARAMETERS OF PIEZOELECTRIC OUTPUT TRANSDUCERS

| Variable | Symbol | Comments |
|---|---|---|
| Displacement at point of interest | w | Simply Supported Bimorph - Mid span<br>Cantilever Bimorph - Free end<br>Stack - Free end<br>Narrow Ring - Mid radius<br>Wide Ring - Outer radius |
| Beam or stack length | L | |
| Beam or stack width | b | Stack is assumed to have a square cross section |
| Wide ring outer radius | | |
| Wide ring inner radius | a | |
| Thickness | h | Bimorph - ½ total thickness<br>Stack - single layer thickness<br>Ring - total thickness |
| Number of layers | n | Bimorph - number of layers in ½ thickness<br>Stack - total number of layers<br>Ring - total number of layers |
| Piezoelectric constant | $d_{31}$, $d_{33}$ | |
| Elastic moduli | $E_{11}$, $E_{33}$ | |
| Density | ρ | |
| Permittivity of free space | $\varepsilon_o$ | 8.854E−12 (F/m) |
| Relative permittivity | $\bar{\epsilon}_{33}$ | |
| Applied voltage | ΔV | |
| Applied force | F | Simply Supported Bimorph - Force (N) at mid span<br>Cantilever Bimorph - Force (N) at free end<br>Stack - Force (N) at free end<br>Narrow Ring - Ring load (N/m) at mid radius<br>Wide Ring - Ring load (N/m) at outer radius |

TABLE 5

EXEMPLARY MECHANICAL FORMULAS FOR PIEZOELECTRIC OUTPUT TRANSDUCERS

| Type | Formulas | Comments |
|---|---|---|
| Simply Supported Bimorph Bender 400 | Displacement per Volt $\frac{w}{\Delta V} = \frac{3}{16} n d_{31} \left(\frac{L}{h}\right)^2$ <br> Capacitance $C = 2n^2 \varepsilon_0 \bar{\varepsilon}_{3a} b \left(\frac{L}{h}\right)$ <br> Stiffness $\frac{F}{w} = 32 E_{11} b \left(\frac{h}{L}\right)^a$ <br> $1^{st}$ Mechanical Resonance $f_1 = \frac{(\pi)^2}{2\pi} \sqrt{\frac{E_{11} h^2}{3\rho L^4}}$ | |
| Cantilevered Bimorph Bender 500 | Displacement per Volt $\frac{w}{\Delta V} = \frac{3}{4} n d_{31} \left(\frac{L}{h}\right)^2$ <br> Capacitance $C = 2n^2 \varepsilon_0 \bar{\varepsilon}_{33} b \left(\frac{L}{h}\right)$ <br> Stiffness $\frac{F}{w} = 2 E_{11} b \left(\frac{h}{L}\right)^a$ <br> $1^{st}$ Mechanical Resonance $f_1 = \frac{(1.875)^2}{2\pi} \sqrt{\frac{E_{11} h^2}{3\rho L^4}}$ | |
| Stack (shown with displacement amplifier) 600 | Displacement per Volt $\frac{w}{\Delta V} = n d_{33}$ <br> Stiffness $\frac{F}{w} = \frac{E_{33} b^2}{L}$ <br> Capacitance $C = \frac{n \varepsilon_0 \bar{\varepsilon}_{33} b^2}{h}$ <br> $1^{st}$ Mechanical Resonance $f_1 = \frac{1}{4L} \sqrt{\frac{E_{33}}{\rho}}$ | The $1^{st}$ mechanical resonance equation may be the ¼ wave "rod" resonance which can tend to be very high. This may not be the first resonance of the system. The most likely $1^{st}$ mode may be the mass of the piezo/ref mass in conjunction with the spring of the displacement amplifier or some kind of bending mode. |

TABLE 5-continued

EXEMPLARY MECHANICAL FORMULAS FOR PIEZOELECTRIC OUTPUT TRANSDUCERS

| Type | Formulas | Comments |
|---|---|---|
| Narrow Ring (shown with displacement amplifier) 700 | Displacement per Volt $\frac{w}{\Delta V} = nd_{31}\left(\frac{r_0}{h}\right)$ Stiffness $\frac{F}{w} = \frac{E_{11}t}{r_0\left(\frac{h}{r_0}\right)}$ Capacitance $C = n^2\varepsilon_0\bar{\varepsilon}_{33}2\pi t\left(\frac{r_0}{h}\right)$ $1^{st}$ Mechanical Resonance | Remember for ring cases that F is a ring load (N/m) that will be summed by the displacement amplifier. The appropriate $1^{st}$ mechanical resonance mode may not be clear. Likely the first resonance may either be a bending type mode or a cos(2θ) mode. |
| Wide Ring | Displacement per Volt $\frac{w}{\Delta V} = nd_{31}\left(\frac{b}{h}\right)$ Stiffness $\frac{F}{w} = \frac{E_{11}t}{b}\frac{(b^2 - a^2)}{(1+v)a^2 + (1-v)b^2}$ Capacitance $C = n^2\varepsilon_0\bar{\varepsilon}_{33}\frac{\pi(b^2 - a^2)}{h}$ $1^{st}$ Mechanical Resonance | |

Figure 10:
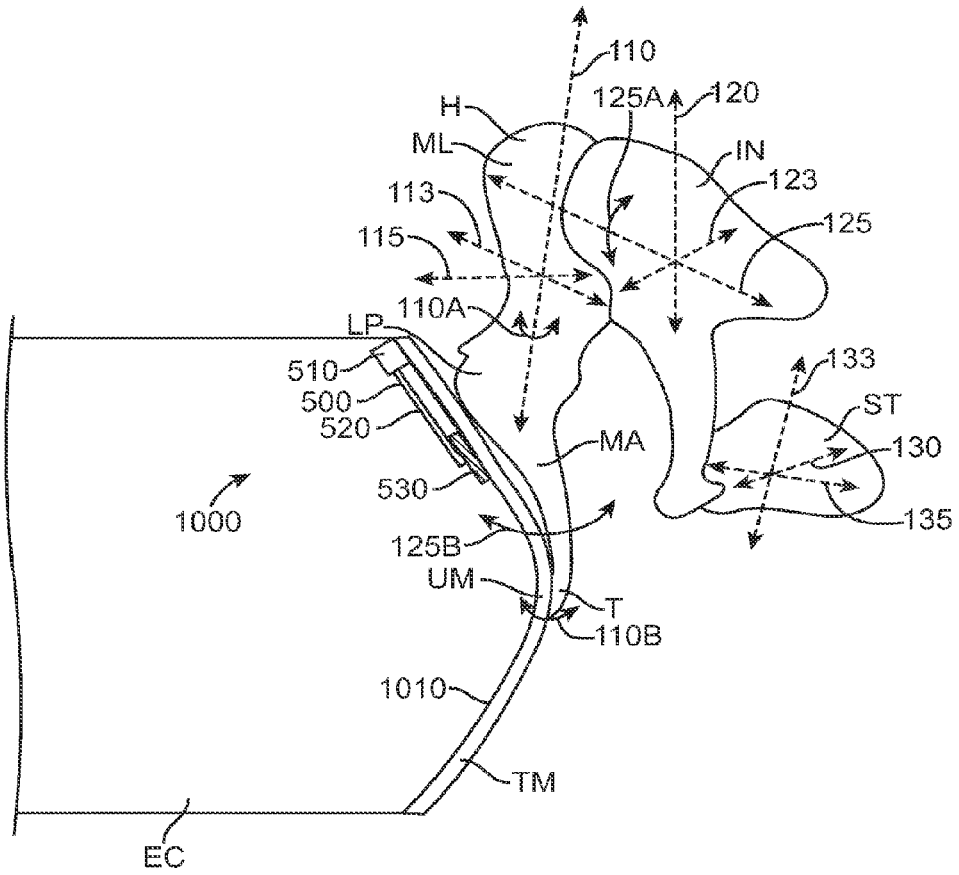
FIG. 10 shows a cantilevered bimorph bender placed on the eardrum away from the umbo and on the lateral process, in accordance with the systems of FIGS. 1A to 3.

FIG. 10 shows an output transducer assembly comprising 1000 a cantilevered bimorph bender positioned on a support 1010 such that the output transducer assembly is positioned over the lateral process and away from the umbo when the support is placed on the eardrum, suitable for incorporation with transducer assembly 30 as described above. Many of the output transducers as described above can be positioned on support 1010 so as to couple to the umbo of the eardrum TM with the transducer positioned away from the umbo, for example on the lateral process LP. The output transducer positioned on the support 1010 so as to couple to the umbo with the transducer positioned away from the umbo may comprise at least one of a piezoelectric transducer, a magnetostrictive transducer, a photostrictive transducer, a coil or a magnet. Support 1010 can be made with known methods of molding to manufacture a support customized to the ear of the user, for example as with the known EarLens. The transducers as described above, for example simply supported bimorph bender 400, cantilevered bimorph bender 500, cantilevered bimorph bender 550, stacked piezo with mechanical multiplier 600, ring piezo with mechanical multiplier 700 and ring mass with bimorph piezoelectric transducer 800 can be positioned on support 1010 so as to position the transducer at the desired location on the eardrum when support 1010 is placed against tympanic membrane TM. As shown in FIG. 10, the transducer may comprise cantilevered bimorph bender 500 on support 1010 and coupled to eardrum TM over the lateral process LP and away from the umbo UM. Cantilevered bimorph bender 500 can be placed on the support so as to align with malleus ML when the support is placed against the eardrum. For example, support 530 of cantilevered bimorph bender 500 can be positioned on support 1010 to conform to the portion of the eardrum TM over the lateral process LP when support 1010 is placed against the eardrum TM. In some embodiments, support 530 can be placed directly on the eardrum without support 1010, for example directly over the lateral process LP. Mass 510 of cantilevered bimorph bender 500 may be placed along the eardrum away from the umbo U of the eardrum TM so as to decrease a mechanical impedance of the support to sound transmitted with the eardrum TM. Cantilever 520 has a first end coupled to mass 510 and a second end coupled to support 530. Cantilever 520 may bend and push against mass 510 and cause a force on support 530 which drives the lateral process LP of the malleus ML to produce sensations of sound.

Figure 10A:
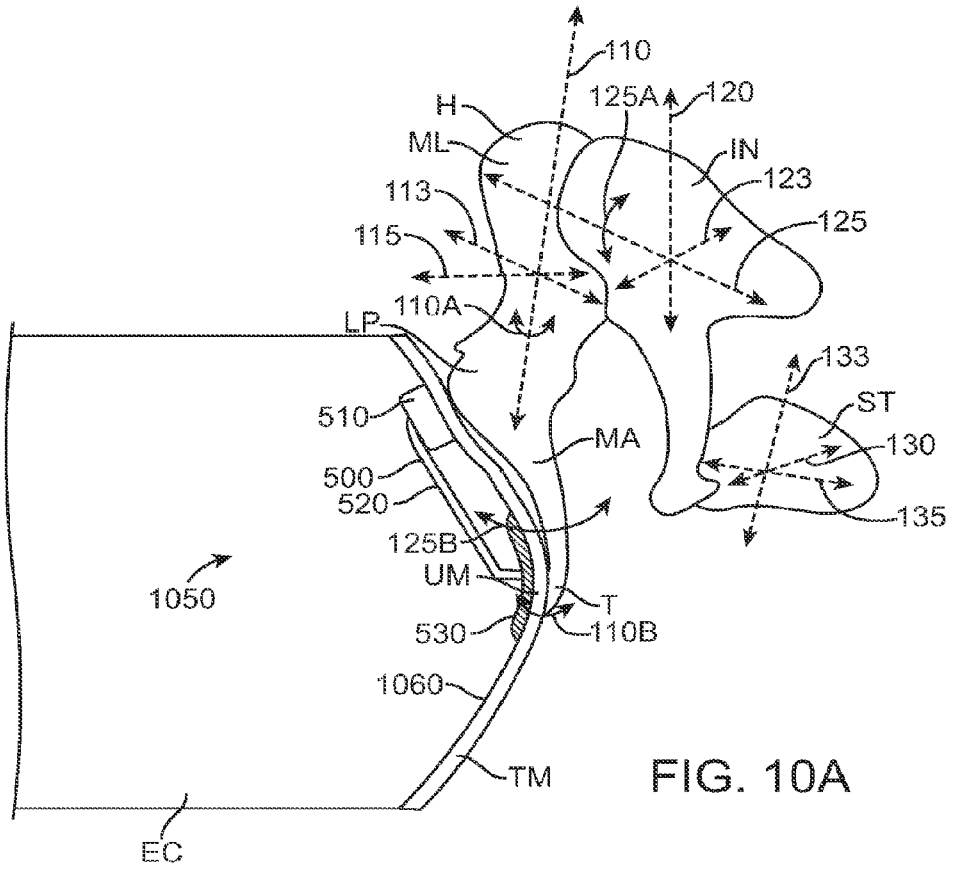
FIG. 10A shows an output transducer assembly comprising a cantilevered bimorph bender placed on the ear drum with a mass on the lateral process away from the umbo and an elongate member comprising a cantilever extending from the mass toward the umbo so as to couple to the eardrum at the umbo, in accordance with the systems of FIGS. 1A to 3.
Figure 10B:
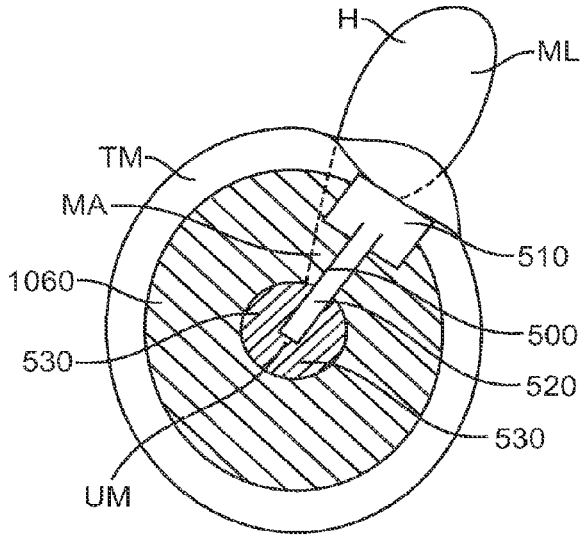
FIG. 10B shows the cantilevered bimorph bender of FIG. 10A from another view.

FIGS. 10A and 10B show an output transducer assembly 1050 suitable for incorporation with transducer assembly 30 as described above and comprising cantilevered bimorph bender 500 placed on a support 1060 which may be made from a mold of the user's ear. The output transducer positioned on the support 1060 may comprise at least one of a piezoelectric transducer, a magnetostrictive transducer, a photostrictive transducer, a coil or a magnet. Support 530, mass 510 and the elongate member comprising bimorph cantilever 520 of bimorph bender 500 are positioned on support 1060 such that mass 510 is positioned away from the umbo and the elongate member is coupled to the umbo when support 1060 is placed against eardrum TM. The elongate member, for example bimorph cantilever 520, extends from the mass supported on the lateral process to the umbo so as to couple to the motion of the transducer to the eardrum at the umbo. This configuration has the advantage of lowering the mechanical impedance with the mass positioned away from the umbo while providing mechanical leverage with coupling at the umbo.

The mass can be positioned away from the umbo and/or aligned with the malleus ML in many ways so as to reduce the input impedance of the transducer assembly. For example, mass 510 can be positioned on support 1060 such that mass 510 is supported with the lateral process LP when support 1060 is placed against the ear. Also cantilevered bimorph bender 500 and support 530 can be placed directly on the eardrum TM such that mass 510 is aligned with malleus ML, for example aligned with lateral process LP. As shown in FIGS. 10A and 10B, mass 510 is placed on support 1060 over the lateral process LP and support 530 is placed on support 1060 over the umbo U when support 1060 is placed against the eardrum TM. The elongate member comprising bimorph cantilever 520 has a first end coupled to mass 510 and a second end coupled to support 530. Cantilever 520 may bend and push against mass 510 and cause a force on support 530 which drives the tip T of the malleus ML to produce sensations of sound. The length of cantilever 520 may be provided with a longer length such that cantilever 520 can provide more mechanical leverage while reducing the input impedance of mass 510.

Figure 11:
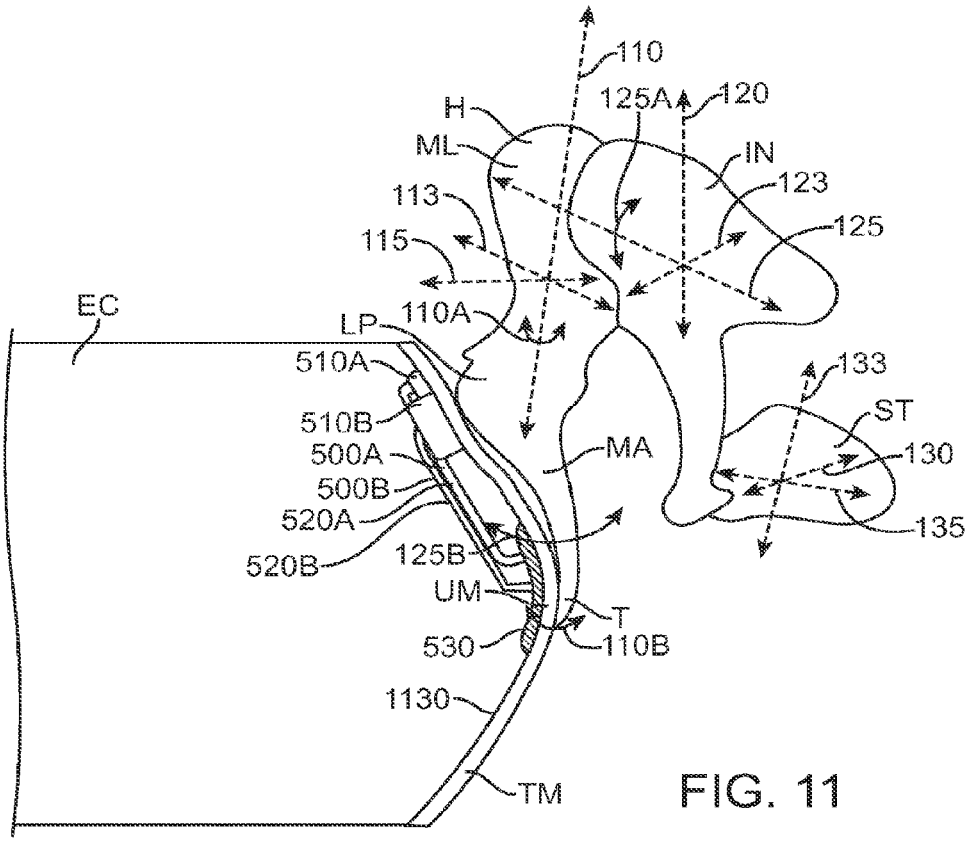
FIG. 11 shows a side view of a transducer comprising two cantilevered bimorph benders placed on different locations on the eardrum, in accordance with the systems of FIGS. 1A to 3.
Figure 11A:
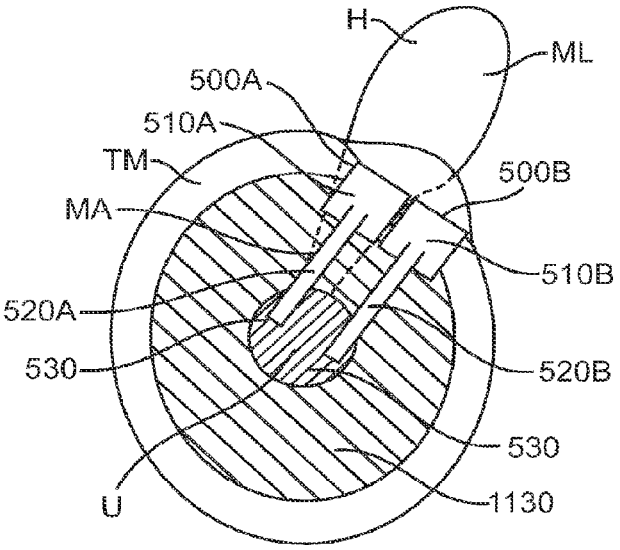
FIG. 11A shows two cantilevered bimorph benders placed on the ear drum over the umbo and the lateral process, in accordance with the systems of FIGS. 1A to 3.
Figure 12A:
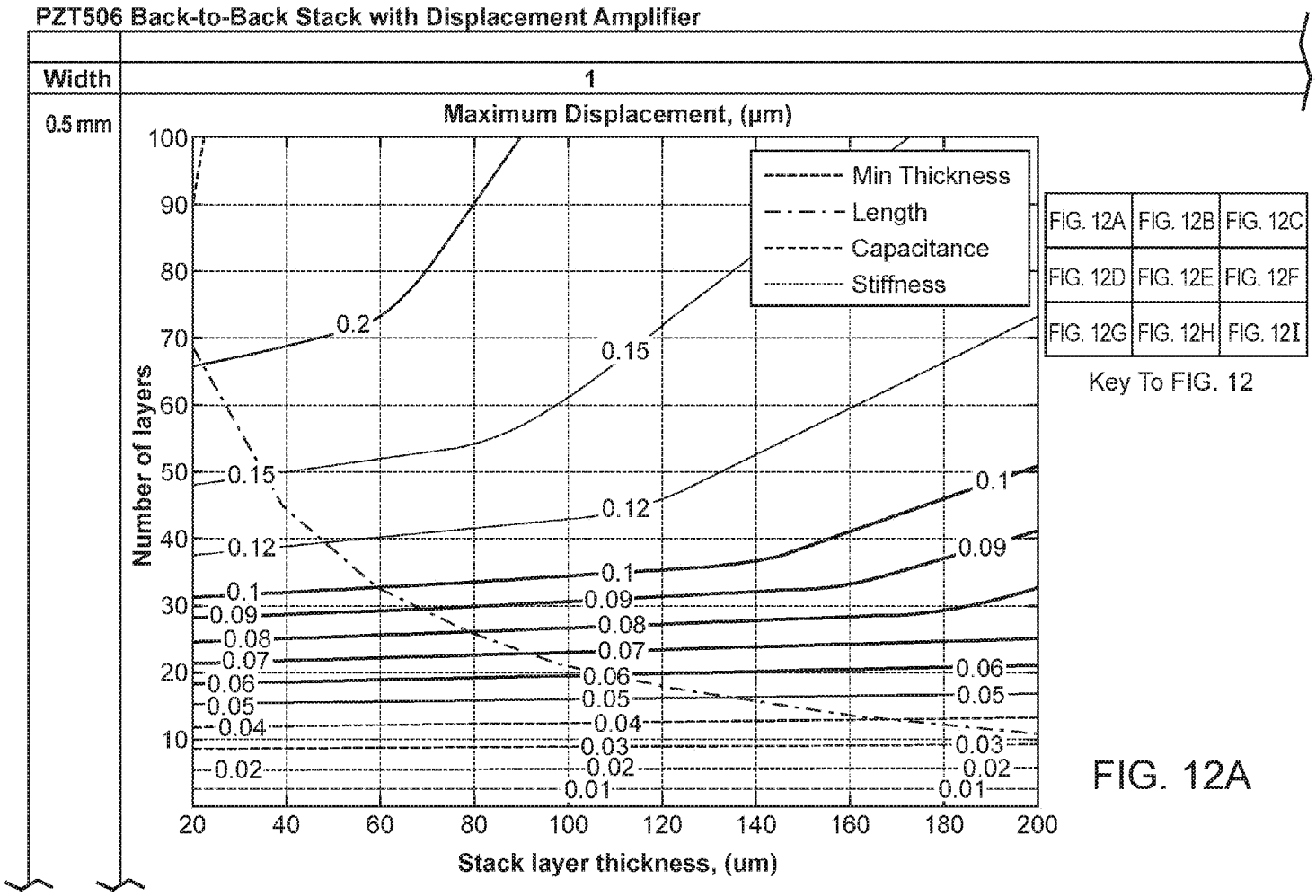
Figure 12B:
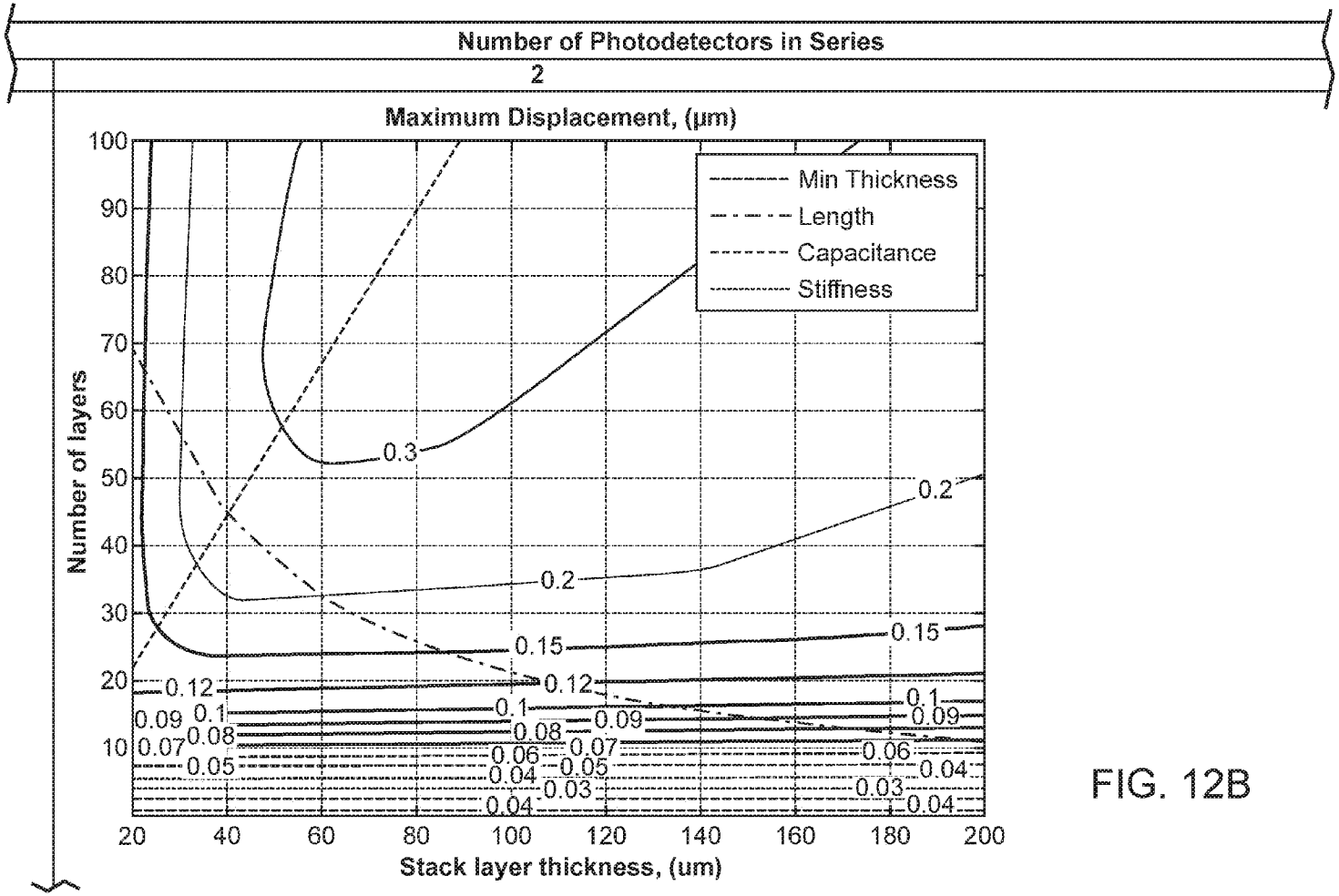
Figure 12C:
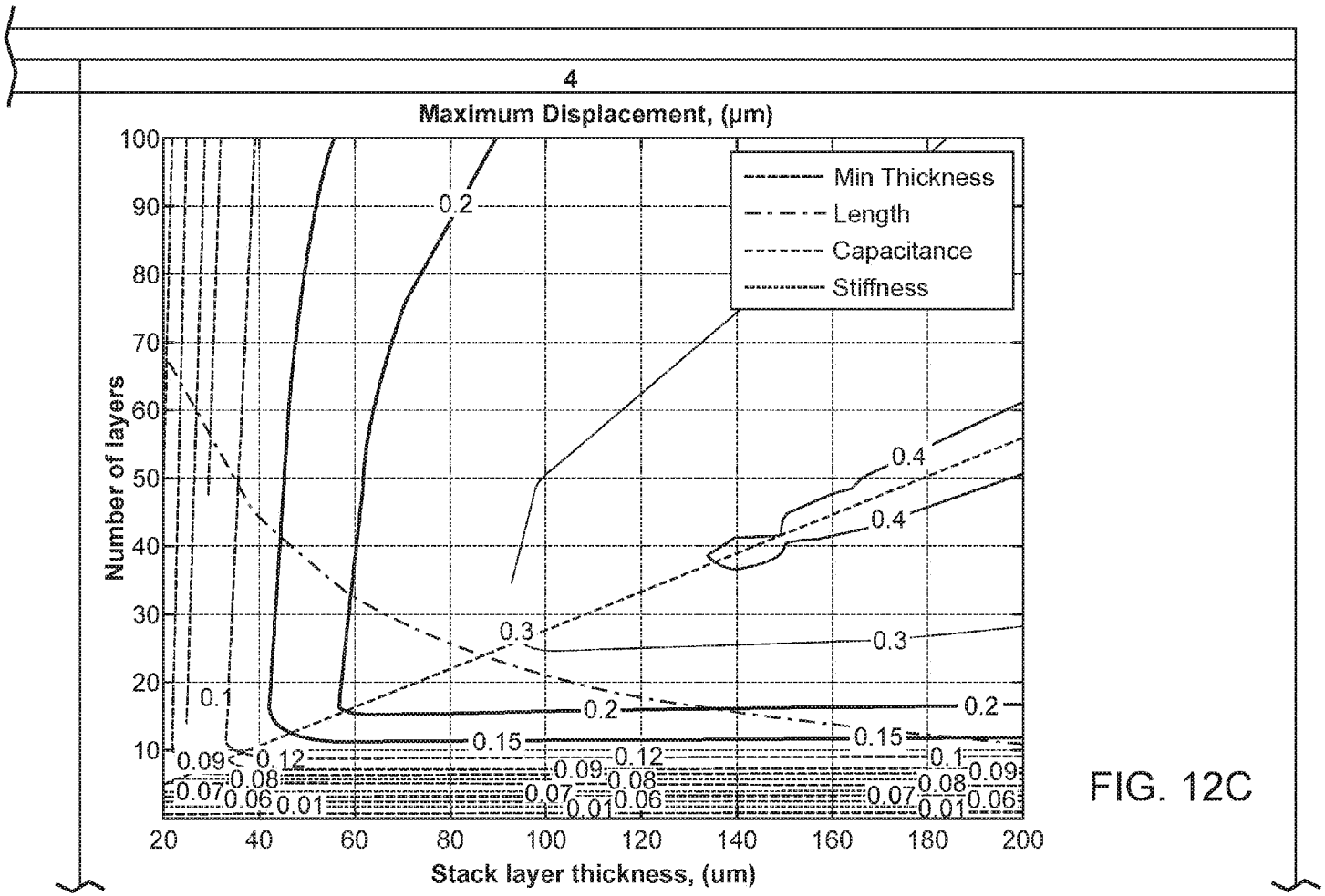
Figure 12D:
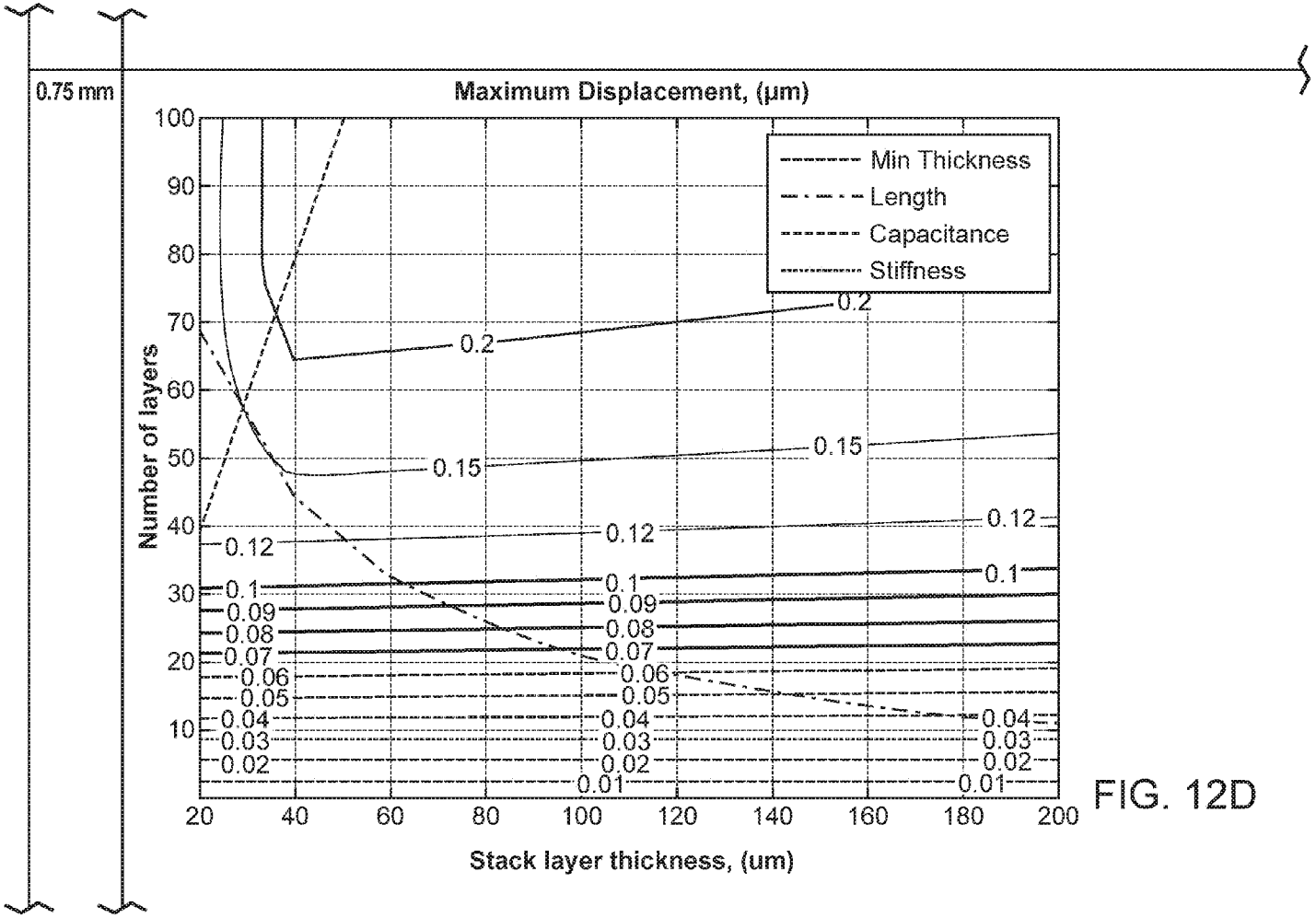
Figure 12E:
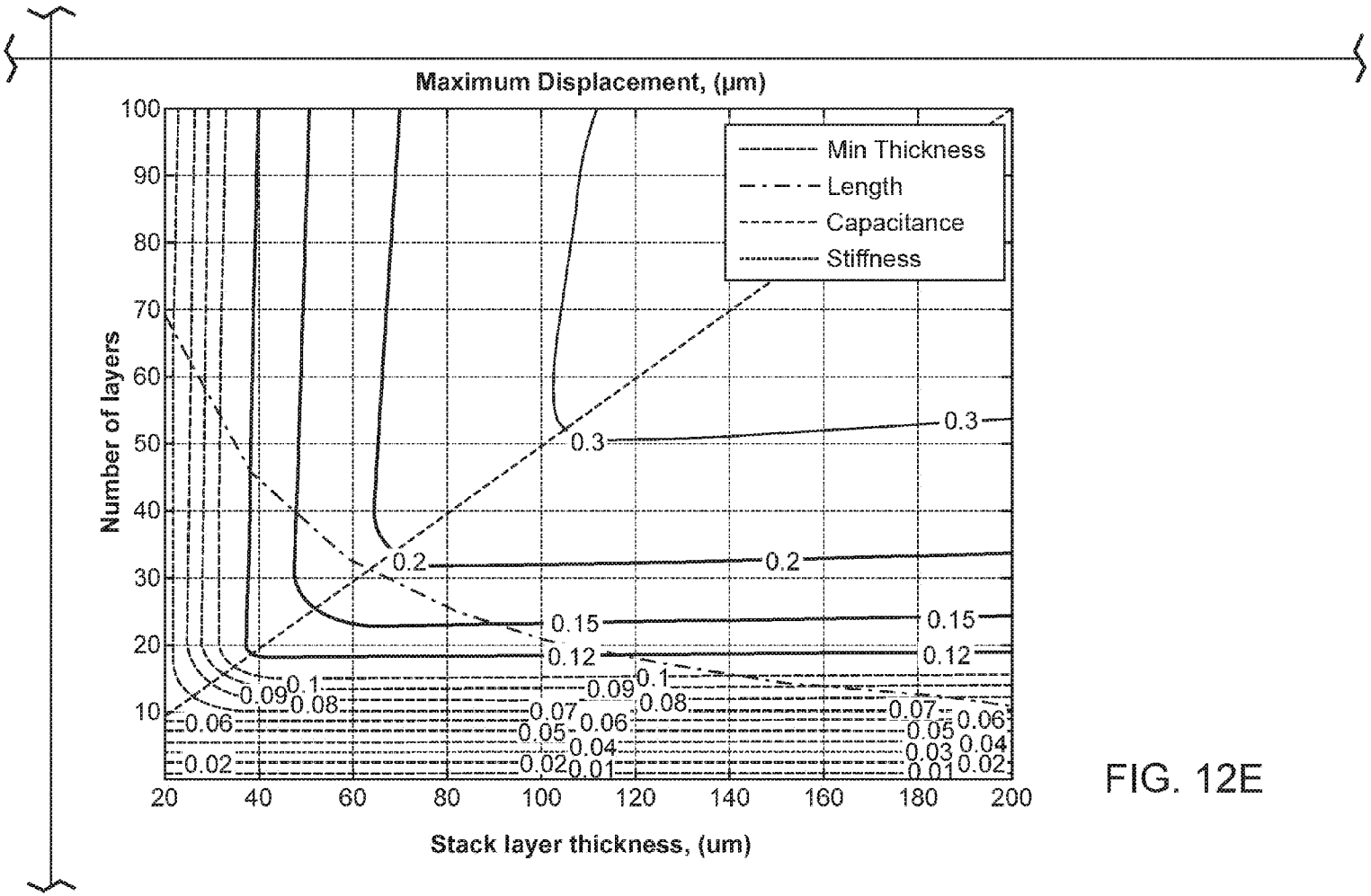
Figure 12F:
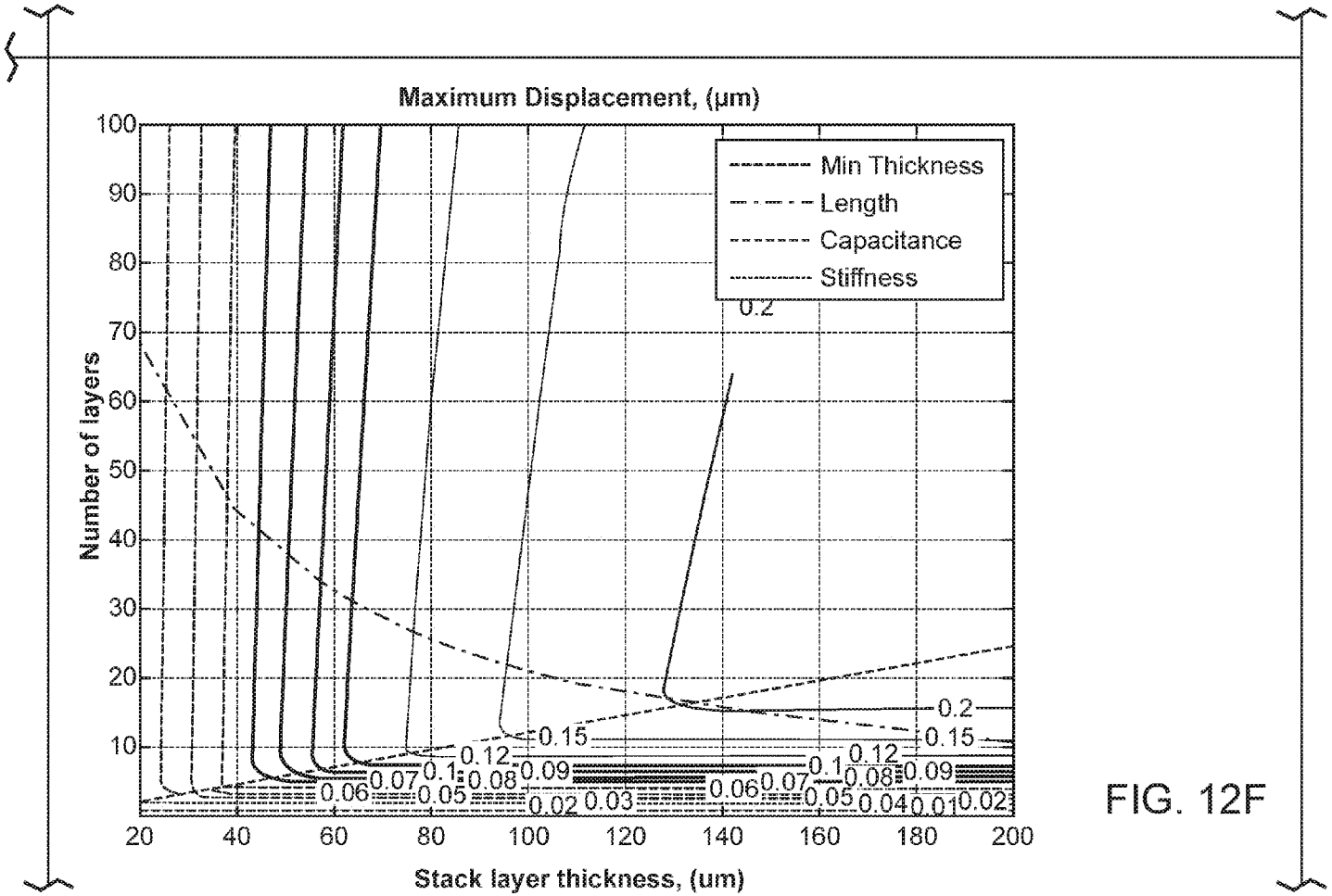
Figure 12G:
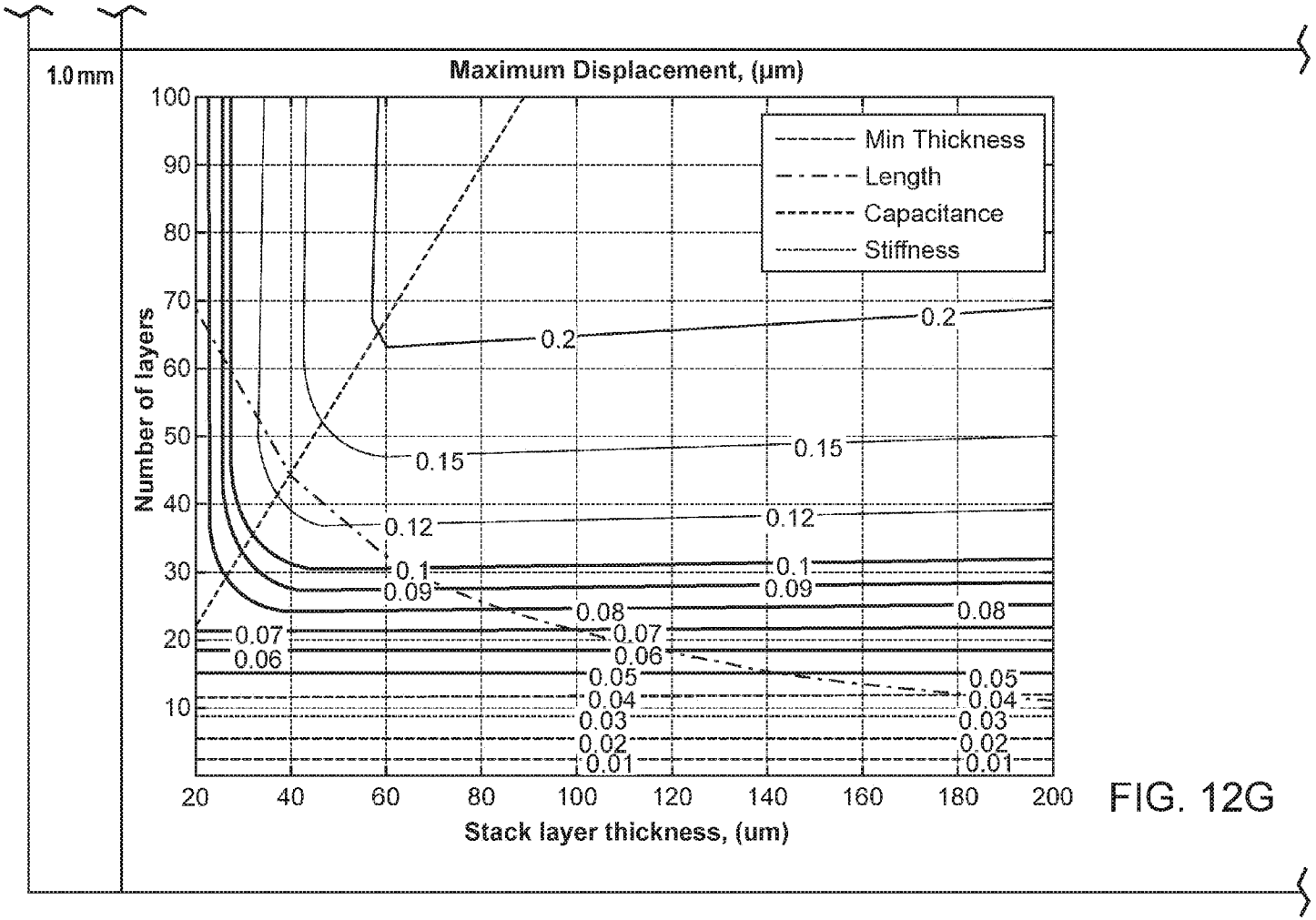
Figure 12H:
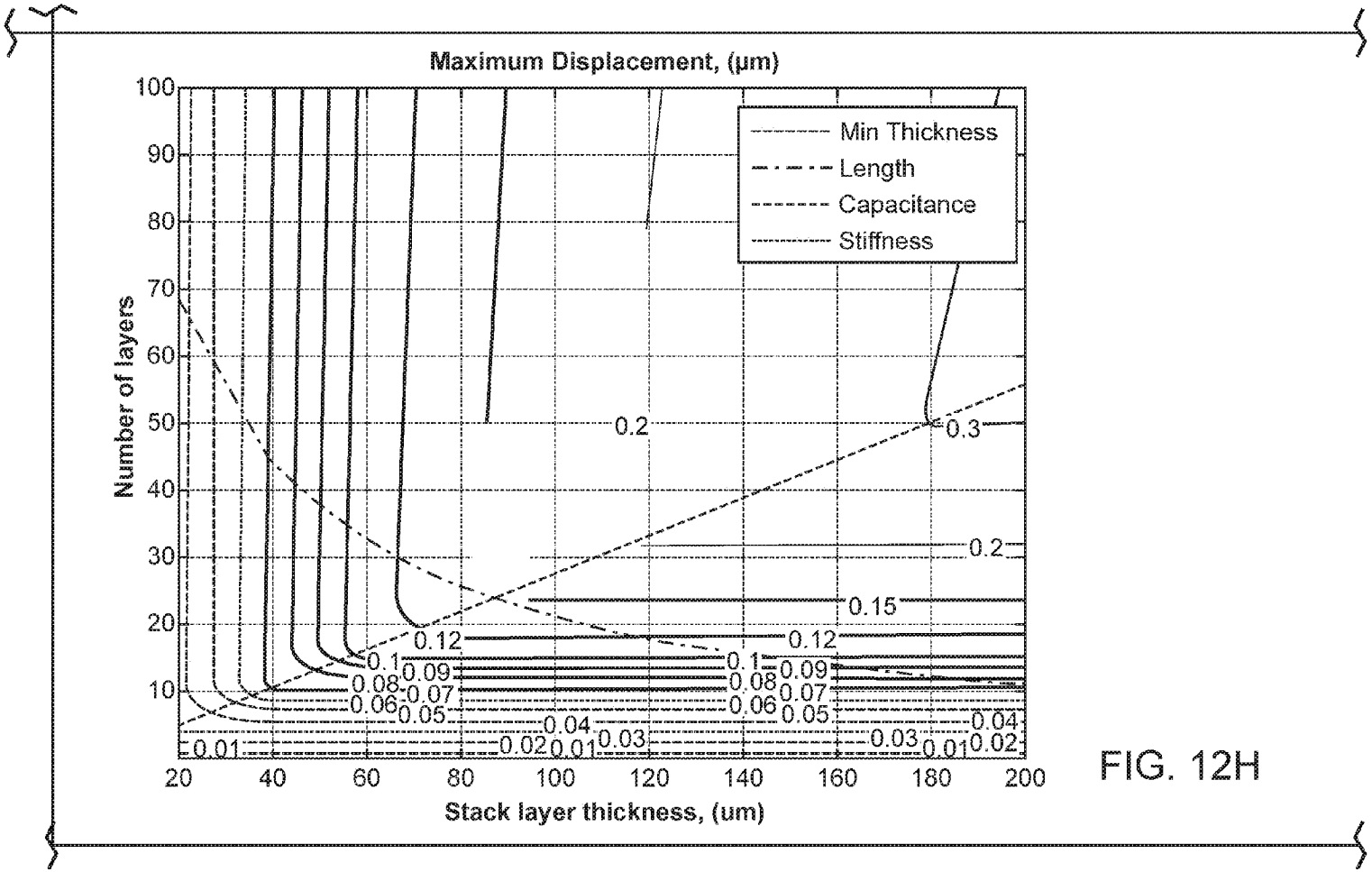
Figure 12I:
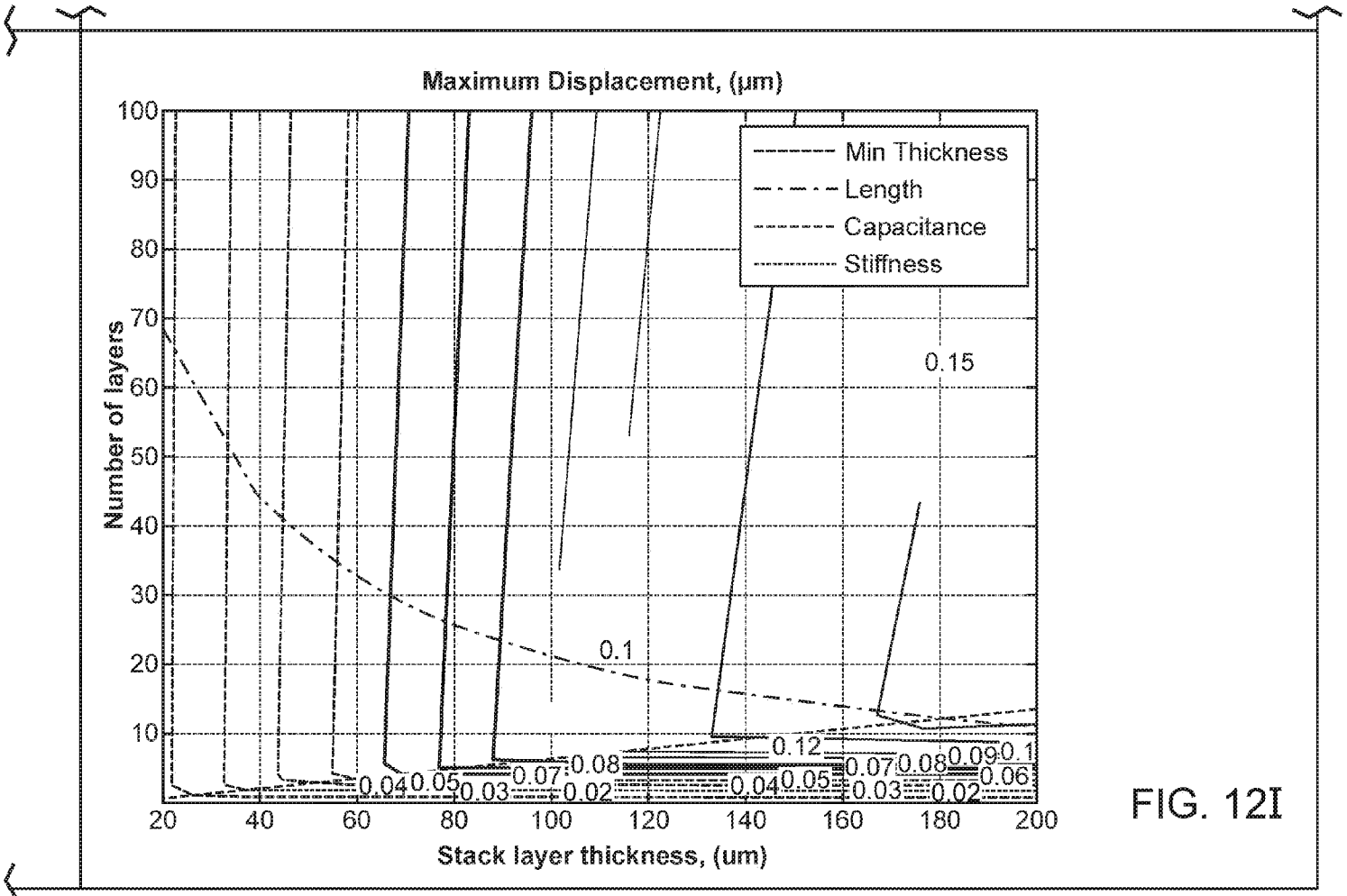

FIG. 11 shows two or more transducers positioned on a support 1130 so as to rotate the malleus with hinged rotation at low frequencies and twist the malleus at high frequencies and suitable for incorporation with transducer assembly 30 as described above. Many of the above described transducers can be placed on support 1130. For example, embodiments of cantilevered bimorph bender 550 and bimorph or wide ring piezo 800 may cause a twisting motion on the eardrum TM and thus the malleus ML. Placement of two or more output transducers, on different parts of the eardrum TM can also produce a rotational or twisting motion on the eardrum TM at the umbo and the malleus ML. The placed output transducers may comprise, for example, at least one of simply supported bimorph bender 400, cantilevered bimorph bender 500, stacked piezo with mechanical multiplier 600, disk or narrow ring piezo with a mechanical multiplier 700, and bimorph or wide ring piezo 800. For example, FIGS. 11 and 11A show two cantilevered bimorph benders 500A and 500B configured to couple to the umbo of the eardrum TM on opposite lateral sides over the tip T of malleus ML. Cantilevered bimorph benders 500A and 500B each comprise masses 510A and 510B, respectively, and bimorph cantilevers 520A and 520B, respectively, and may both be supported with a common support 530 and/or support 1130 which also supports masses 510A and 510B. Each of bimorph cantilevers 520A and 520B comprises an elongate member that extends from the mass to the umbo to couple to the eardrum at the umbo. A phase difference, as described above, between bimorphs 500A and 500B may cause malleus ML to twist. Masses 510A and 510B are positioned on support 1130 such that masses 510A and 510B are supported with the lateral process when support 1130 is placed against eardrum TM. Output transducers may be placed on other areas of the eardrum TM as well, for example at additional locations away from the umbo as described above. In some embodiments, support 530 can be coupled directly to eardrum TM, for example without support 1130.

Many of the above embodiments can be evaluated on an empirical number of patients, for example 10 patients to optimize the transducers, for example transducer mass, positioning, support and circuitry. For example, experiments can be conducted on an empirical number of ten patients to determine improved coupling of sound with differential movement of the first transducer and second transducer. In addition to testing with patients, the embodiments can be tested with computer simulations and laboratory testing. The below described experiments are merely examples of experiments that can be performed, and a person of ordinary skill in the art will recognize many variations and modifications that can be used to improve and optimize the performance of the transducer devices described herein.

IV. Experimental

For exemplary piezoelectric elements, five key characteristics were looked at as a function of geometric parameters. The five parameters were: 1) minimum manufacturable layer thickness, 2) electrical capacitance, 3) 1st mechanical resonant frequency (if available), 4) low frequency stiffness, and 5) maximum displacement achievable with a photodetector power source. For each exemplary piezoelectric element, a contour plot of the maximum displacement achievable at 2 kHz was made. FIGS. 12A-12I show an exemplary contour map for an embodiment of a back-to-back amplified stack piezoelectric elements, a PZT506 back-to-back stack with displacement amplifier. Similar plots can be made for additional embodiments comprising the simply supported bimorph piezoelectric elements, for example a PZT506 simply supported bimorph, a TRS singly crystal simply supported bimorph, and a PVDF simply supported bimorph piezoelectric elements. FIGS. 12A-12I include combinations of different numbers of photodetectors used to power the piezoelectric element and the width of the piezoelectric element. The displacement shown accounts for the electrical limitations of the photovoltaic power source as well as any mismatch between the impedance of the umbo and the stiffness of the driving piezo. Equation 1 and Table 6 below show the equation for the maximum displacement and the parameter definitions.

$$d_{max} = \left(\frac{d}{V}\right) R \left(\frac{K_{pz}}{K_{pz} + R^2 Z_{umbo}}\right) \min\left(N_{PD} V_{max}, \frac{\left(\frac{l_{max}}{N_{PD}}\right)}{2\pi f_1 C}\right) \quad \text{EQUATION 1}$$

TABLE 6

EXEMPLARY TEST PARAMETERS

| Parameter | Value |
|---|---|
| $f_{max}$ | Maximum frequency of interest (10 kHz) |
| $f_1$ | 2 kHz - frequency used to optimize design |
| R | Lever ratio |
| $K_{pz}$ | Low frequency stiffness of piezo |
| $Z_{umbo}$ | Impedance of umbo at $f_1$ |
| $\frac{d}{V}$ | Displacement per volt of a given design |
| $N_{PD}$ | Number of photocells in series |
| $V_{max}$ | Maximum voltage of single photocell (0.4 V) |

TABLE 6-continued

| EXEMPLARY TEST PARAMETERS | |
|---|---|
| Parameter | Value |
| $I_{max}$ | Maximum current of single photocell given the illumination constraints (224 uA) |
| C | Capacitance of a given design |
| min(x, y) | Minimum function which takes the minimum of the two arguments (x, y) |

On top of the contour map shown, other parameters are shown as "constraint lines". For example, the minimum manufacturable thickness is represented as a line. Any design point falling below or to the right of this line may be achievable. Any design point falling above or to the left calls for a layer thickness that is not currently available from any of the contacted vendors. Often, only integer numbers of layers are possible. Similarly, the capacitance is shown in a line. Any design falling below or to the right of this line has less than the optimal capacitance for 2 kHz. Any design above or to the left has a higher capacitance. At this point, one must remember that the displacement contours are shown at 2 kHz. At different frequencies, there will be a different optimal capacitance. (Optimizing for higher frequencies will require smaller capacitances.) Designs that have a $1^{st}$ mechanical resonance of 10 kHz are shown as a line. Designs to the right have higher resonant frequencies; designs to the left have lower resonant frequencies. Designs that have a low frequency stiffness equal to the umbo stiffness at 10 kHz are shown with a line. Designs to the right have higher stiffnesses; designs to the left have lower stiffnesses. In exemplary embodiments, piezoelectric element parameters that are below and to the right of all the constraint lines while at the same time maximizing location on the displacement contour are chosen. Contour maps can be made for embodiments of bimorph piezoelectric transducers using the parameters set forth in Table 7.

TABLE 7

| EXEMPLARY TEST PARAMETERS FOR BIMORPH PIEZOELECTRICS | | | |
|---|---|---|---|
| Parameter | PZT506 | TRS - Single Crystal | PVDF |
| $E_{11}$ | 64.5 GPa | 11.6 GPa | 3.0 GPa |
| $d_{31}$ | 225 pm/V | 1000 pm/V | 20 pm/V |
| $\bar{\epsilon}_{33}$ | 2250 | 7700 | 12 |
| ρ | 8000 Kg/m$^3$ | 7900 Kg/m$^3$ | 1780 Kg/m$^3$ |
| Minimum layer thickness | 20 um | 140 um | 2 um |
| Lever Ratio | 1.0 | 1.0 | 1.0 |
| L | 5 mm | 5 mm | 5 mm |

Contour maps can be made for embodiments of simply supported bimorph piezoelectrics using the parameters set forth in Table 8 The bimorph with the greatest displacement that meets all of the constraints may be selected. Exemplary embodiments SSBM1, SSBM2, SSBM3, SSBM4, SSBM5, SSBM6, SSBM7, SSBM8, SSBM12, SSBM15, and SSBM18 give displacements greater than 0.1 um at 2 kHz.

TABLE 8

| DISPLACEMENT MEASUREMENTS FOR EXEMPLARY BIMORPH PIEZOELECTRIC EMBODIMENTS | | | | | | | |
|---|---|---|---|---|---|---|---|
| Embodiment | Material | Beam width | Number of photodetectors | Beam ½ thickness | Number of layers | Layer thickness | Maximum displacement |
| SSBM1 | PZT506 | 0.5 mm | 1 | 120 um | 6 | 20 um | 0.15 um |
| SSBM2 | PZT506 | 0.5 mm | 2 | 120 um | 4 | 30 um | 0.16 um |
| SSBM3 | PZT506 | 0.5 mm | 3 | 120 um | 3 | 40 um | 0.15 um |
| SSBM4 | PZT506 | 1.0 mm | 1 | 100 um | 4 | 25 um | 0.15 um |
| SSBM5 | PZT506 | 1.0 mm | 2 | 100 um | 2 | 50 um | 0.15 um |
| SSBM6 | PZT506 | 1.0 mm | 3 | 100 um | 1 | 100 um | 0.12 um |
| SSBM7 | PZT506 | 1.5 mm | 1 | 100 um | 3 | 33 um | 0.12 um |
| SSBM8 | PZT506 | 1.5 mm | 2 | 100 um | 2 | 50 um | 0.14 um |
| SSBM9 | PZT506 | 1.5 mm | 3 | 100 um | 1 | 100 um | 0.09 um |
| SSBM10 | TRS-SC | 0.5 mm | 1 | 280 um | 2 | 140 um | 0.045 um |
| SSBM11 | TRS-SC | 0.5 mm | 2 | 280 um | 2 | 140 um | 0.09 um |
| SSBM12 | TRS-SC | 0.5 mm | 3 | 280 um | 2 | 140 um | 0.13 um |
| SSBM13 | TRS-SC | 1.0 mm | 1 | 280 um | 2 | 140 um | 0.05 um |
| SSBM14 | TRS-SC | 1.0 mm | 2 | 280 um | 2 | 140 um | 0.09 um |
| SSBM15 | TRS-SC | 1.0 mm | 3 | 230 um | 1 | 230 um | 0.10 um |
| SSBM16 | TRS-SC | 1.5 mm | 1 | 280 um | 2 | 140 um | 0.045 um |
| SSBM17 | TRS-SC | 1.5 mm | 2 | 230 um | 1 | 230 um | 0.07 um |
| SSBM18 | TRS-SC | 1.5 mm | 3 | 230 um | 1 | 230 um | 0.10 um |
| SSBM19 | PVDF | 2.0 mm | 2 | 210 um | 34 | 6.2 um | 0.045 um |
| SSBM20 | PVDF | 2.0 mm | 3 | 210 um | 16 | 13.1 um | 0.045 um |
| SSBM21 | PVDF | 3.0 mm | 2 | 210 um | 27 | 7.8 um | 0.04 um |
| SSBM22 | PVDF | 3.0 mm | 3 | 210 um | 14 | 15 um | 0.04 um |

The PZT506 material appears to be the suitable for making the bimorph. Its combination of thin layer thicknesses, high piezoelectric constants and moderate permittivity provides a suitable best output. Also, it appears that a wide range of beams all produce roughly the same output, 0.15 um. Choosing between these options can be based on tradeoffs of manufacturing. For example, layers in the bimorph can be traded-off against segmenting the photodetector.

Contour maps can be made for embodiments of back-to-back amplified stack piezoelectric elements, a TRS single crystal back-to-back stack with displacement amplifier, respectively. A displacement amplified stack piezoelectric elements may comprise a scissor jack with two stacks placed back-to-back pushing outwards. In this configuration, the centerline of the assembly does not move. Therefore, the maximum stack length to consider for displacement purposes is 2.5 mm or half of the maximum allowable dimension. However, the effective capacitance may be needed to account for both stacks. The lever ratio may be limited to be between 1 and 15. In between those limits, the stiffness of the stack can be matched to the impedance of the umbo at 10 kHz. Since the number of layers in a stack is high, the thickness of the glue/electrodes between layers may need to be considered. For example, a glue/electrode layer thickness of 16 um may be used. Like with simply supported bimorph piezoelectric elements above, amplified stack piezoelectric elements were analyzed at a variety of thicknesses and assuming various numbers of photodetectors in series. Neither the stiffness nor the $1^{st}$ resonance of the stack was a limiting factor while layer thickness, capacitance and length may be limiting factors.

Table 9 below shows some exemplary ranges of parameters for embodiments of back-to-back amplified stack piezoelectric elements.

TABLE 9

EXEMPLARY TEST PARAMETERS FOR BACK-TO-BACK STACK PIEZOELECTRICS

| Parameter | PZT506 | TRS - Single Crystal |
|---|---|---|
| $E_{11}$ | 64.5 GPa | 11.6 GPa |
| $d_{33}$ | 545 pm/V | 1900 pm/V |
| $\bar{\epsilon}_{33}$ | 2250 | 7700 |
| ρ | 8000 Kg/m$^3$ | 7900 Kg/m$^3$ |
| Minimum layer thickness | 20 um | 140 um |
| Lever Ratio | 1.0 to 15.0 | 1.0 to 15 |
| L | 2.5 mm | 2.5 mm |

Table 10 below shows parameters for several embodiments of back-to-back amplified stack piezoelectric elements Both the single crystal material and the PZT506 material appear to have maximum outputs near 0.3 um. Several embodiments of back-to-back amplified stack piezoelectric elements produce similar amounts of displacement. Thus, there may be flexibility in manufacturing.

TABLE 10

DISPLACEMENT MEASUREMENTS FOR EXEMPLARY BACK-TO-BACK STACK PIEZOELECTRIC EMBODIMENTS

| Material | Stack width | Number of photodetectors | Number of layers | Layer thickness | Maximum displacement |
|---|---|---|---|---|---|
| PZT506 | 0.5 mm | 1 | 65 | 20 um | 0.2 um |
| PZT506 | 0.5 mm | 2 | 45 | 40 um | 0.23 um |
| PZT506 | 0.5 mm | 4 | 25 | 90 um | 0.28 um |
| PZT506 | 0.75 mm | 1 | 58 | 30 um | 0.15 um |
| PZT506 | 0.75 mm | 2 | 32 | 65 um | 0.18 um |
| PZT506 | 0.75 mm | 4 | 16 | 135 um | 0.20 um |
| PZT506 | 1.0 mm | 1 | 45 | 40 um | 0.13 um |
| PZT506 | 1.0 mm | 2 | 25 | 70 um | 0.15 um |
| PZT506 | 1.0 mm | 4 | 12 | 180 um | 0.16 um |
| TRS-SC | 0.5 mm | 1 | 17 | 140 um | 0.1 um |
| TRS-SC | 0.5 mm | 2 | 17 | 140 um | 0.2 um |
| TRS-SC | 0.5 mm | 4 | 14 | 170 um | 0.31 um |
| TRS-SC | 0.75 mm | 1 | 17 | 140 um | 0.14 um |
| TRS-SC | 0.75 mm | 2 | 17 | 140 um | 0.28 um |
| TRS-SC | 0.75 mm | 4 | 9 | 260 um | 0.31 um |
| TRS-SC | 1.0 mm | 1 | 17 | 140 um | 0.15 um |
| TRS-SC | 1.0 mm | 2 | 14 | 175 um | 0.25 um |
| TRS-SC | 1.0 mm | 4 | 7 | 350 um | 0.28 um |

Embodiments of piezoelectric elements were also tested using a laser vibrometer to measure the velocity (and hence the displacement) of a target. Data was analyzed to yield displacement per volt and plotted versus frequency. Data was determined using the equations mentioned above and plotted alongside the test data.

Figure 13A:
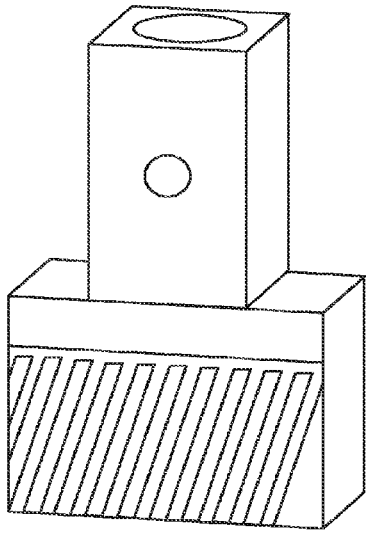
FIG. 13A shows a stacked piezo and FIG. 13B shows a plot of displacement per voltage for the stacked piezo of FIG. 13A.
Figure 13B:
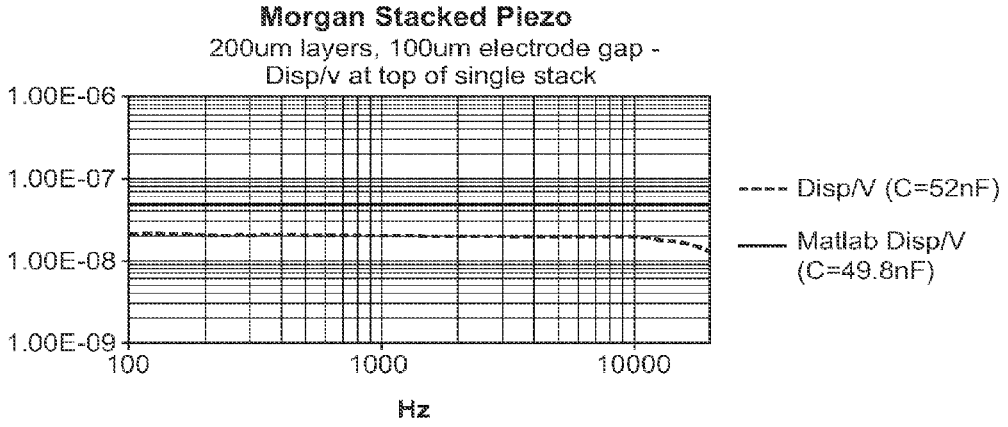

A single Morgan stacked as shown in FIG. 13A was tested. The parameters for the single Morgan stack piezo are shown in Table 11 below. A plot of the test data, including displacement versus voltage, is shown in FIG. 13B.

TABLE 11

EXEMPLARY PARAMETERS FOR MORGAN STACKED PIEZO

| Parameter | Value |
|---|---|
| Material | Morgan PZT506 |
| Piezo Dimensions | 1 × 1 × 1.8 mm |
| Layer Thickness | 20 μm |
| Number of Layers | 50 |
| E11 | 6.45e10 |
| d33 | 545e−12 |
| d31 | −225e−12 |
| Density | 8000 |
| Relative Permittivity | 2250 |
| Kp (coupling factor) | 0.70 |
| Input Voltage | 1 V |
| Input Frequency range | 100-20000 Hz |
| Measured capacitance | 52 nF |
| Calculated capacitance | 49.8 nF |

Figure 14A:
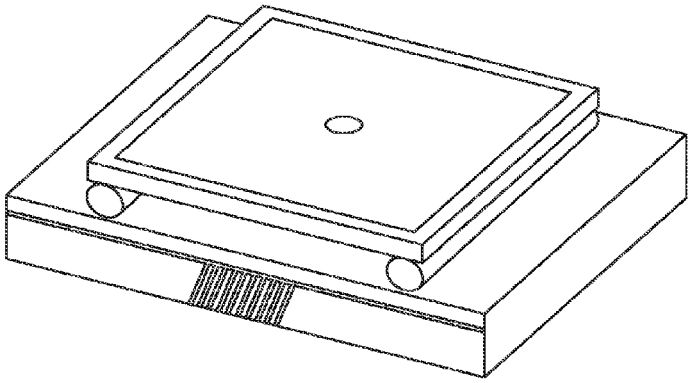
FIG. 14A shows a series bimorph and FIG. 14B shows a plot of displacement per voltage for the series bimorph of FIG. 14A.
Figure 14B:
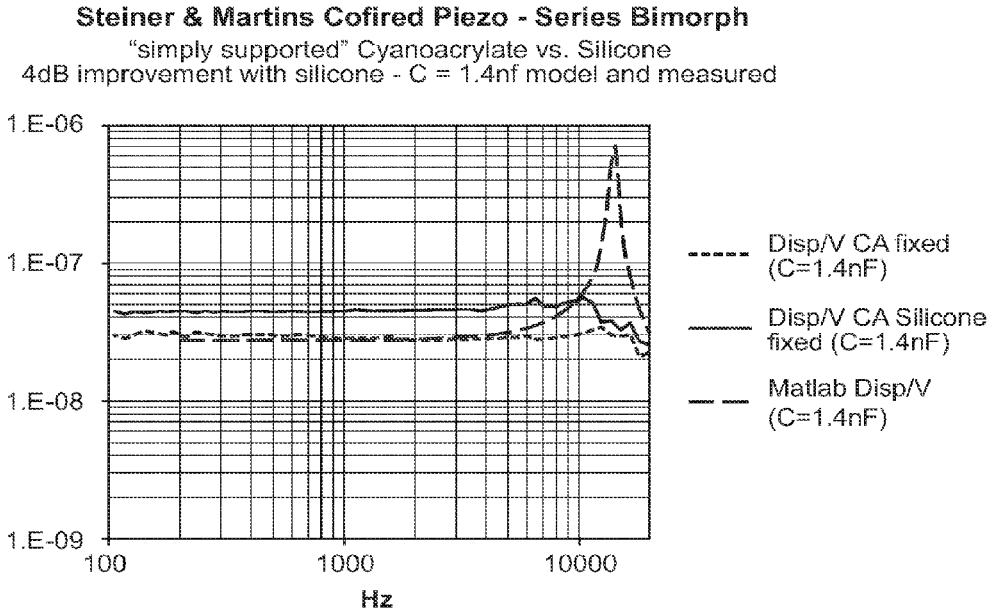

A Steiner and Martins cofired Piezo series bimorph as shown in FIG. 14A was tested. The parameters for the single Morgan stack are shown in Table 12 below. A plot of the test data, including displacement versus voltage, is shown in FIG. 14B. Affixing the piezo using a flexible material increased the vibrational displacement by a few dB.

TABLE 12

EXEMPLARY PARAMETERS FOR STEINER AND MARTINS COFIRED PIEZO - SERIES BIMORPH

| Parameter | Value |
|---|---|
| Material | STEMInc SMQA |
| Piezo Dimensions | 7 mm × 7 mm |
| Layer Thickness | 200 μm |
| E11 | 8.6e10 |
| d33 | 310e−12 |
| d31 | −140e−12 |
| Density | 7900 |
| Relative Permittivity | 1400 |
| Kp (coupling factor) | 0.58 |
| Input Voltage | 1 V |
| Input Frequency range | 100-20000 Hz |
| Measured capacitance | 1.4 nF |
| Calculated capacitance | 1.4 nF |

Figure 15A:
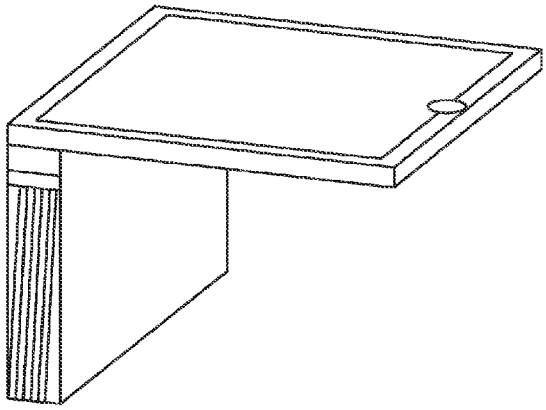
FIG. 15A shows a single crystal bimorph cantilever and FIG. 15B shows a plot of displacement per voltage for the single crystal bimorph cantilever of FIG. 15A.
Figure 15B:
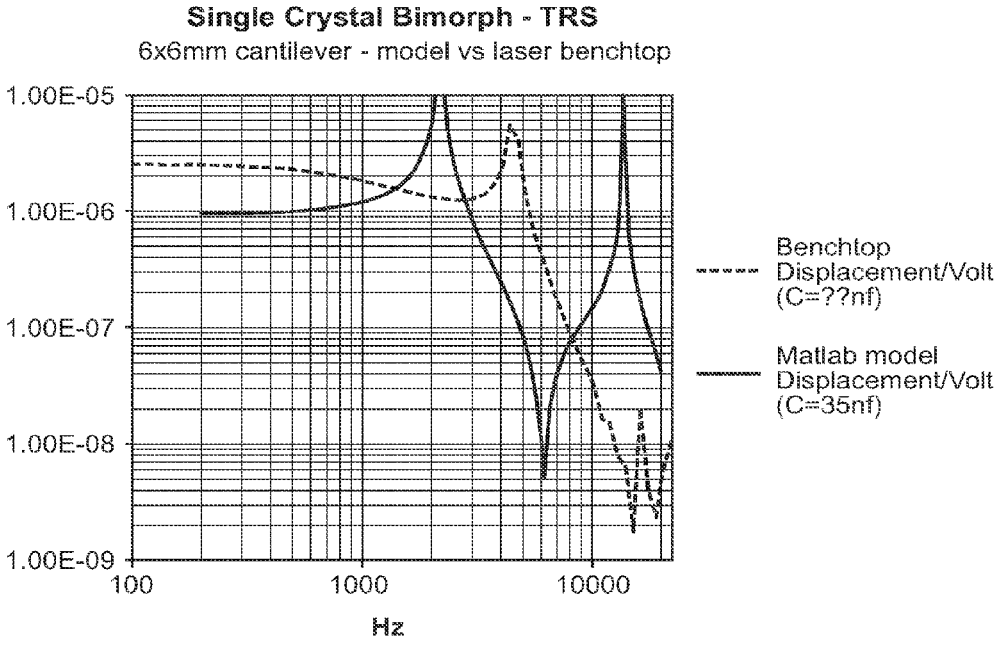

A TRS Single Crystal Bimorph Cantilever as shown in FIG. 15A was tested. The parameters for the single Morgan stack are shown in Table 13 below. The parameters may comprise known parameters and can be measured by one of ordinary skill in the art. A plot of the test data, including displacement versus voltage, is shown in FIG. 15B

TABLE 13

EXEMPLARY PARAMETERS FOR TRS SINGLE CRYSTAL BIMORPH CANTILEVER

| Parameter | Value |
|---|---|
| Material | TRS single crystal |
| Piezo Dimensions | 6 mm × 6 mm |
| Layer Thickness | 140 μm |
| E11 | 1.16e10 |
| d33 | 1900e−12 |
| d31 | −1000e−12 |
| Density | 7900 |
| Relative Permittivity | 7700 |
| Input Voltage | 1 V |
| Input Frequency range | 100-20000 Hz |
| Measured capacitance | nF |
| Calculated capacitance | 35 nF |

Figure 16A:
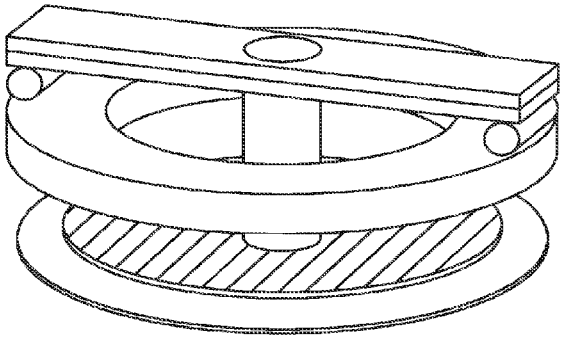
FIG. 16A shows a bimorph on a washer and FIG. 16B shows a plot of displacement per voltage for the bimorph on a washer of FIG. 16A.
Figure 16B:
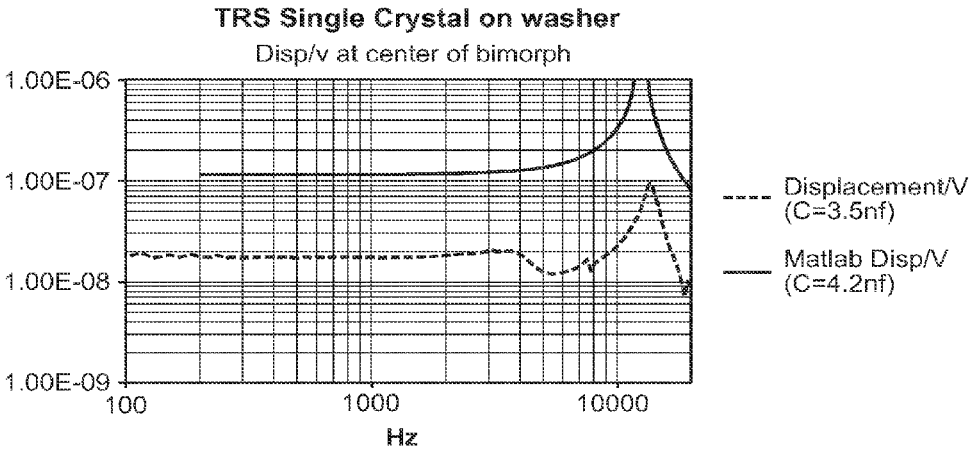

A TRS Single Crystal Bimorph on a washer as shown in FIG. 16A was tested. The parameters for the single Morgan stack are shown in Table 14 below. A plot of the test data, including displacement versus voltage, is shown in FIG. 16B In this test, the resonance is in the predicted frequency but the magnitude is off by nearly 20 dB. The capacitance is also off, so the piezo may be damaged.

TABLE 14

EXEMPLARY PARAMETERS FOR TRS SINGLE CRYSTAL ON WASHER

| Parameter | Value |
|---|---|
| Material | TRS single crystal |
| Piezo Dimensions | 1 mm × 5 mm |
| Layer Thickness | 140 μm |
| E11 | 1.16e10 |
| d33 | 1900e−12 |
| d31 | −1000e−12 |
| Density | 7900 |
| Relative Permittivity | 7700 |
| Input Voltage | 1 V |
| Input Frequency range | 100-20000 Hz |
| Measured capacitance | 3.6 nF |
| Calculated capacitance | 4.2 nF |

Figure 17A:
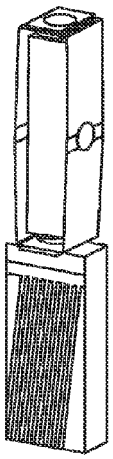
FIG. 17A shows a stacked piezo pair.
Figure 17B:
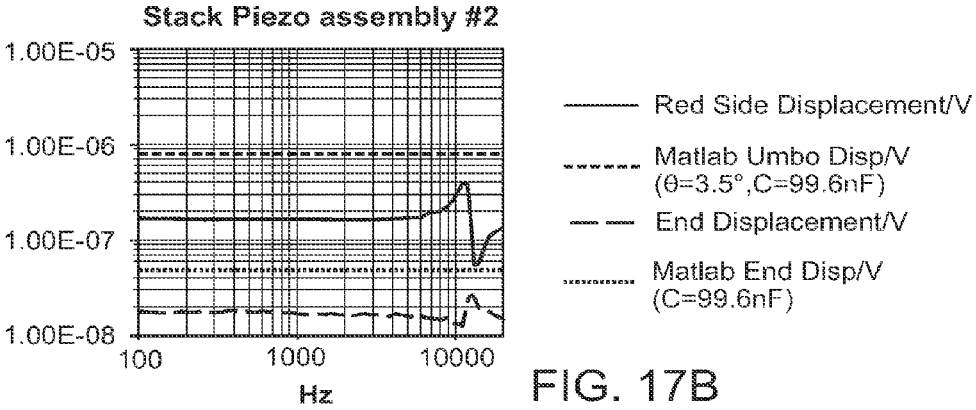
FIG. 17B shows a plot of displacement per voltage for the stacked piezo pair of FIG. 17A.
Figure 17C:
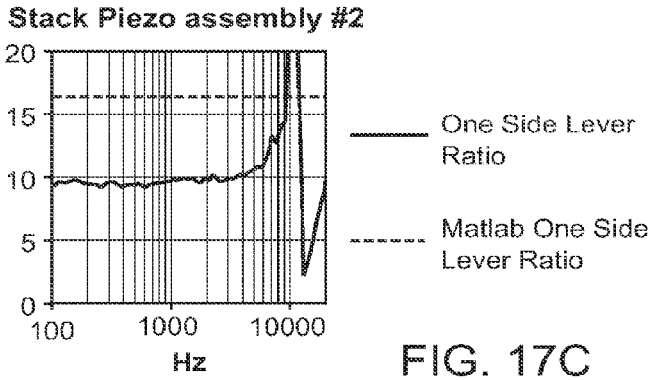
FIG. 17C shows a plot of lever ratio for the stacked piezo pair of FIG. 17C.

A stacked piezo pair with V-jack type displacement amplification as shown in FIG. 17A was tested. The parameters for the single Morgan stack are shown in Table 15 below. A plot of the test data, including displacement versus voltage, is shown in FIGS. 17B and 17C. In this test, an additional resonance appears which may most likely a resonance in the mechanical lever.

TABLE 15

EXEMPLARY PARAMETERS FOR STACKED PIEZO PAIR WITH V-JACK DISPLACEMENT AMPLIFICATION

| Parameter | Value |
|---|---|
| Material | Morgan PZT506 |
| Piezo Dimensions | 1 × 1 × 3.6 mm |
| Lever angle, lever ratio | 3.5°, 16X |
| Layer Thickness | 20 μm |
| Number of Layers | 100 |
| E11 | 6.45e10 |
| d33 | 545e−12 |
| d31 | −225e−12 |
| Density | 8000 |
| Relative Permittivity | 2250 |

TABLE 15-continued

EXEMPLARY PARAMETERS FOR STACKED PIEZO PAIR WITH V-JACK DISPLACEMENT AMPLIFICATION

| Parameter | Value |
|---|---|
| Kp (coupling factor) | 0.70 |
| Input Voltage | 1 V |
| Input Frequency range | 100-20000 Hz |
| Measured capacitance | 104 nF |
| Calculated capacitance | 99.6 nF |

Embodiments of output transducers which were placed on a subject's eardrum were tested. The transducer was wire driven, connected directly to the audiometer to determine the acoustic threshold. In order to reduce the effect of the wires, 48 AWG wire was used between the transducer and a location just outside the ear canal. The position of the transducer was verified by a physician using a video otoscope.

Once in place, the audiometer driven transducer was energized across a 12 kΩ load and the audiometer setting adjusted to reach threshold. The threshold was recorded at each frequency tested. After the testing was complete and the transducer removed from the subject's ear, the transducer was reconnected to the audiometer and the voltage measured. Often, the audiometer setting was increased by 40 dB to make a reliable measurement.

The data collected was converted to pressure equivalent using Minimum Audible Pressure curves and plotted against the specifications, bench-top data and average electromagnetic or EM system output. In all cases, the assumption is that the input to the transducer is 0.4V peak and 75 mW. The bench-top data was determined by measuring the unloaded displacement and comparing to the known displacement of the umbo at each frequency plotted.

In addition to the threshold measurements, the feedback pressure was measured at two locations: at the umbo and at the entrance to the ear canal. Often, the transducer was driven by a laptop running SYSid, and operated at IV peak, with the feedback measured with an ER-7c microphone. The resulting data gives a measure of the gain margin for each transducer design/location if the microphone is located either deep in the canal or at the canal entrance.

Figure 18A:
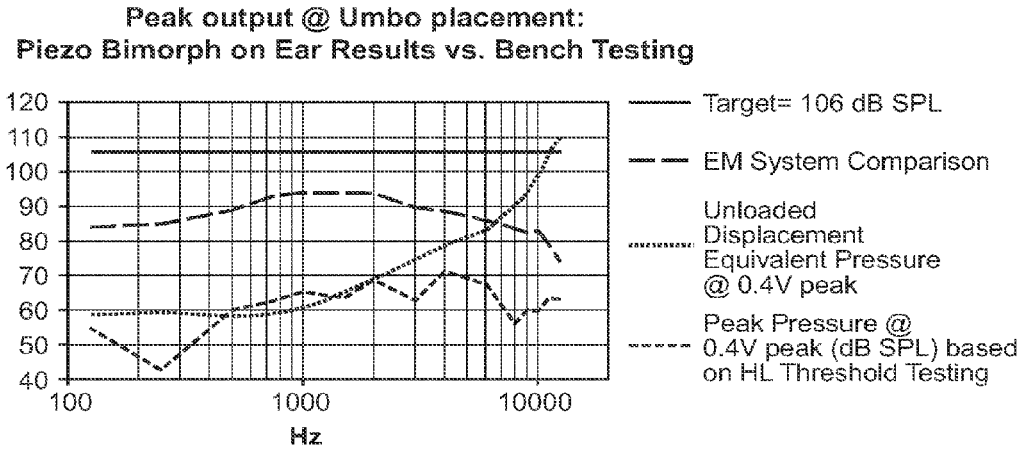
FIG. 18A shows a plot of peak output for a bimorph piezo placed on the umbo.
Figure 18B:
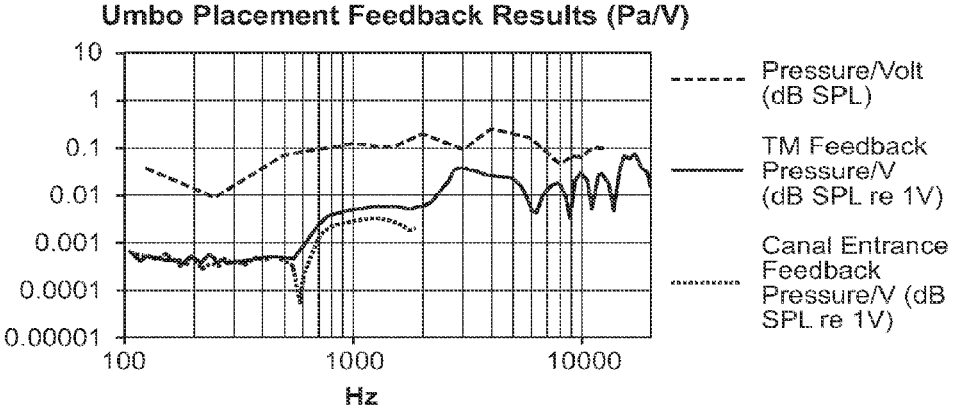
FIG. 18B shows a plot of feedback for a bimorph piezo placed on the umbo.

FIGS. 18A-20B show peak power output and feedback for the tested embodiments of output transducers. Although an idealized target peak power output of 106 dB is shown for purposes of comparison, peak power outputs of less than 106 dB, for example 80 or 90 dB at 10 kHz, can provide improved hearing for many patients. FIGS. 18A and 18B show peak power output and feedback, respectively, of a TRS single crystal bimorph placed on the umbo. The on ear results match the bench top predictions up to 2 kHz, then diverge, with the on-ear results remaining flat up to 12 kHz. The umbo located transducer used a different piezo than the center of pressure located transducer.

Figure 19A:
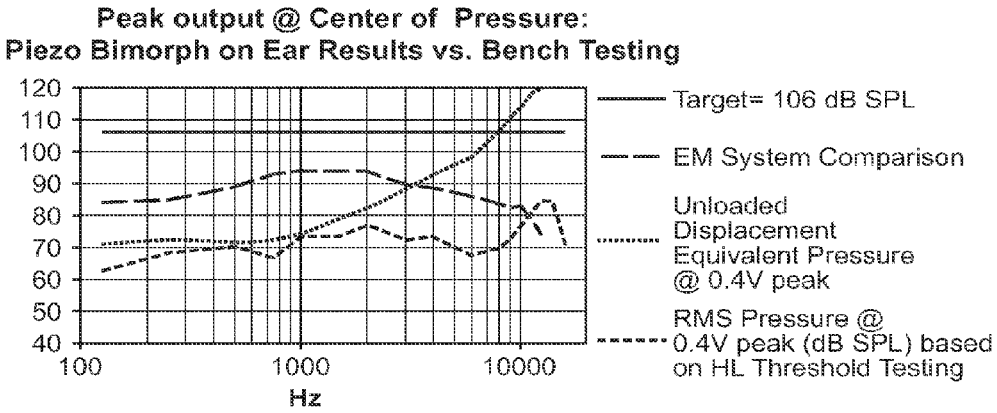
FIG. 19A shows a plot of peak output for a bimorph piezo placed on the center of pressure on an eardrum.
Figure 19B:
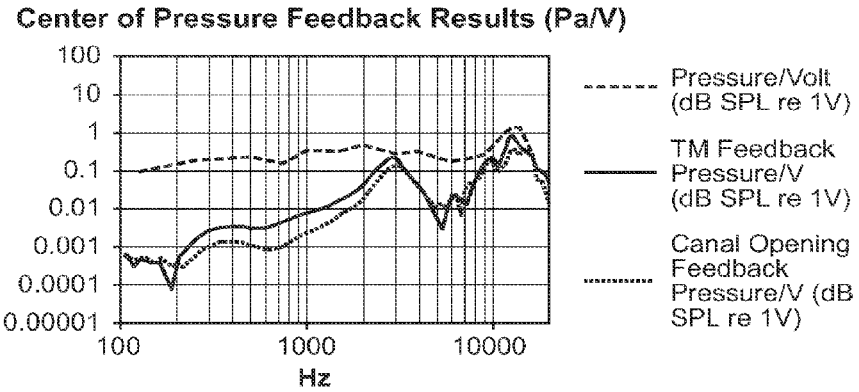
FIG. 19B shows a plot of feedback for a biomorph piezo placed on the center of pressure on an eardrum.

FIGS. 19A and 19B show peak power output and feedback, respectively, of a TRS single crystal bimorph placed on the center of pressure of the eardrum. The on ear results match the bench top predictions up to 2 kHz, then diverge, with the on-ear results remaining flat up to 12 kHz. Employing feedback cancellers or other feedback handling techniques, or moving the microphone location can improve the power output and feedback profiles.

Figure 20A:
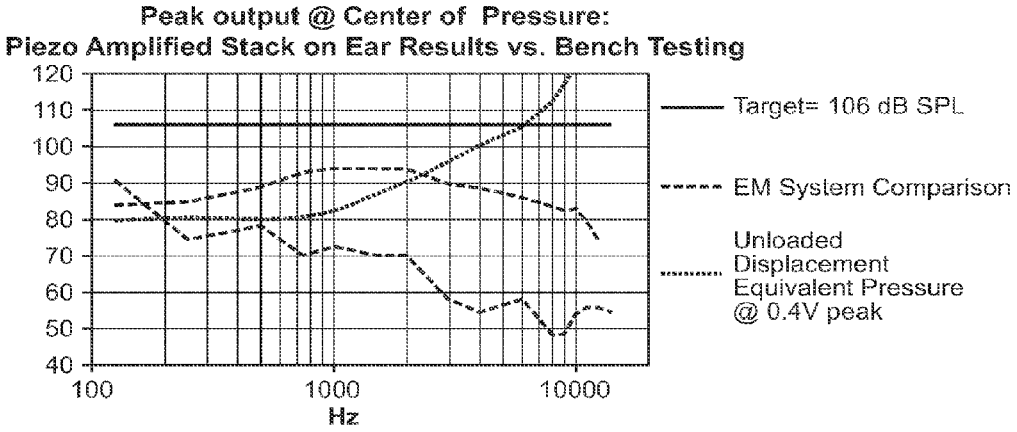
FIG. 20A shows a plot of peak output for a stacked piezo placed on the center of pressure on an eardrum.
Figure 20B:
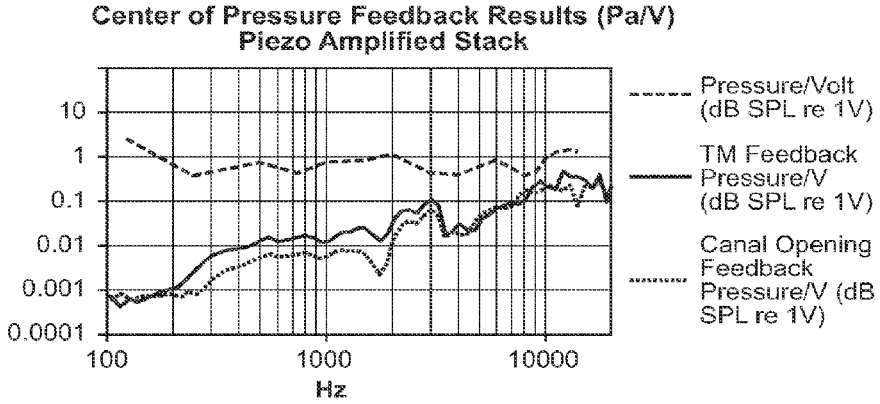
FIG. 20B shows a plot of feedback for a stacked piezo placed on the center of pressure on an eardrum.

FIGS. 20A and 20B show peak power output and feedback, respectively, of a stacked piezo pair with V-jack type displacement amplification placed on the center of pressure of the eardrum. The 100 nF piezo load causes the PV system to be current limited starting at a low frequency. The overall equivalent pressure per volt (when not current limited) is better than the bimorph case by about 20 dB.

While the above is a complete description of the preferred embodiments of the invention, various alternatives, modifications, and equivalents may be used. Therefore, the above description should not be taken as limiting in scope of the invention which is defined by the appended claims.

What is claimed is:

1. A device configured for non-surgical placement through an ear canal to transmit an audio signal to a user, the user having an ear comprising an eardrum, the device comprising:

a mass;

a piezoelectric transducer; and a support configured and shaped to: 1) be positioned along at least a portion of a lateral surface of the eardrum, and 2) support the mass and the piezoelectric transducer with the eardrum, the piezoelectric transducer configured for placement over the lateral surface of the eardrum spaced away from an umbo of the eardrum to face the ear canal and to drive the support and the eardrum with a first force and the mass with a second force, the second force opposite the first force.

2. The device of claim 1 wherein the piezoelectric transducer is disposed between the mass and the support.

3. The device of claim 1 further comprising at least one flexible structure disposed between the piezoelectric transducer and the mass.

4. The device of claim 1 wherein the piezoelectric transducer is magnetically coupled to the support.

5. The device of claim 1 wherein the piezoelectric transducer comprises a first portion connected to the mass and a second portion connected to the support to drive the mass opposite the support.

6. The device of claim 1 wherein the support comprises a first side shaped to conform with the eardrum.

7. The device of claim 6 wherein a protrusion is disposed opposite the first side and affixed to the piezoelectric transducer.

8. The device of claim 6 further comprising a fluid configured to be disposed between the first side and the eardrum to couple the support to the eardrum, the fluid comprising a liquid composed of at least one of an oil, a mineral oil, a silicone oil or a hydrophobic liquid.

9. The device of claim 6 wherein the support comprises a second side disposed opposite the first side, the protrusion extending from the second side to the piezoelectric transducer.

10. The device of claim 1 wherein the support comprises a first component and a second component, the first component comprising a flexible material shaped to conform to the eardrum and flex with motion of the eardrum, the second component comprising a rigid material extending from the transducer to the flexible material to transmit first force to the flexible material and the eardrum.

11. The device of claim 10 wherein the rigid material comprises at least one of a metal, titanium, a stainless steel or a rigid plastic and wherein the flexible material comprises at least one of a silicone, a flexible plastic or a gel.

12. The device of claim 1 further comprising a housing, the housing rigidly affixed to the mass to move the housing and the mass opposite the support.

13. The device of claim 12 wherein the support comprises a rigid material that extends through the housing to the transducer to move the mass and the housing opposite the support.

14. The device of claim 1 wherein the mass comprises circuitry coupled to the transducer and supported with the support and the transducer, the circuitry configured to receive wireless power and wireless transmission of the audio signal to drive the transducer in response to the audio signal.

15. The device of claim 1 wherein the piezoelectric transducer comprises at least one of a piezoelectric unimorph transducer, bimorph-bender piezoelectric transducer, a piezoelectric multimorph transducer, a stacked piezoelectric transducer with a mechanical multiplier or a ring piezoelectric transducer with a mechanical multiplier.

16. The device of claim 15 wherein the piezoelectric transducer comprises the bimorph-bender piezoelectric transducer and the mass comprises a first mass and a second mass, and wherein the bimorph bender comprises a cantilever extending from a first end supporting the first mass to a second end supporting the second mass, and wherein the support is coupled to the cantilever between the first end and the second end to drive the ear drum with the first force and drive the first mass and the second mass with the second force.

17. The device of claim 15 wherein the piezoelectric transducer comprises the stacked piezoelectric transducer with the mechanical multiplier and wherein the mechanical multiplier comprises a first side coupled to the support to drive the eardrum with the first force and a second side coupled to the mass to drive the mass with the second force.

18. The device of claim 15 wherein the piezoelectric transducer comprises the ring piezoelectric transducer with the mechanical multiplier and wherein the mechanical multiplier comprises a first side and a second side, the first side extending inwardly from the ring piezoelectric transducer to the mass, the second side extending inwardly toward a protrusion of the support, and wherein the mass moves away from the protrusion of the support when the ring contracts and toward the protrusion of the support when the ring expands.

19. The device of claim 18, wherein the ring piezoelectric transducer defines a center having a central axis extending there through and wherein the protrusion and the mass are disposed along the central axis.

20. The device of claim 15 wherein the piezoelectric transducer comprises the bimorph bender and wherein the mass comprises a ring having a central aperture formed thereon and wherein the bimorph bender extends across the ring with a first end and a second end coupled to the ring and wherein the support extends through the aperture and connects to the piezoelectric transducer between the first end and the second end to move the support opposite the ring when the bimorph bender bends.

21. The device of claim 20, wherein the bimorph bender is connected to the ring with an adhesive on the first end and the second end such that the first end and the second end are configured to move relative to the ring with shear motion when the bimorph bender bends to drive the support opposite the ring.

22. A device to transmit an audio signal to a user, the user having an ear comprising an eardrum, the device comprising:

a transducer;

circuitry coupled to the transducer, the circuitry configured to receive at least one of wireless power or wireless transmission of the audio signal to drive the transducer in response to the audio signal; and a support having a length, the length of the support configured to be positioned along at least a portion of the lateral surface of the eardrum, wherein the transducer is configured to be supported on the support in a general direction of the length of the support and along the lateral surface of the eardrum to face the ear canal, and wherein the transducer is configured to drive the support and the eardrum with a first force and drive the circuitry with a second force, wherein the second force is opposite the first force, and wherein driving the first force and the second force causes a rotational or twisting movement of one or more of the support or the eardrum.

23. The device of claim 22 wherein the circuitry is rigidly attached to a mass and coupled to the transducer to drive the circuitry and the mass with the first force.

24. The device of claim 22 wherein the circuitry is rigidly attached to a mass and coupled to the transducer to drive the circuitry and the mass with the second force.

25. The device of claim 22 wherein the circuitry is flexibly attached to a mass and coupled to the transducer to drive the circuitry and the mass with the first force.

26. The device of claim 25 wherein the circuitry is flexibly attached to a mass and coupled to the transducer to drive the circuitry and the mass with the second force.

27. The device of claim 22 wherein the circuitry comprises at least one of a photodetector or a coil, supported with the support and coupled to the transducer to drive the transducer with the at least one of the wireless power or wireless transmission of the audio signal.

28. The device of claim 22 wherein the transducer comprises at least one of a piezoelectric transducer, a magnetostrictive transducer, a magnet or a coil.

29. A device to transmit an audio signal to a user, the user having an ear comprising an eardrum and a malleus connected to the ear drum at an umbo, the device comprising:

a transducer; and a support having a length, the length of the support configured to be positioned along at least a portion of a lateral surface of the eardrum, the transducer configured to drive the eardrum and wherein the transducer is supported on the support in a general direction of the length of the support and along the lateral surface of the eardrum spaced away from the umbo of the eardrum to face the ear canal when the support is placed on the outer surface of the eardrum, wherein the transducer is positioned on the support so as to decrease a movement of the transducer relative to a movement of the umbo when the eardrum vibrates and to amplify the movement of the umbo relative to the movement of the transducer when the transducer vibrates.

30. The device of claim 29 further comprising a mass positioned on the support for placement away from the umbo when the support is placed against the eardrum and wherein the transducer extends between the mass and a position on the support that corresponds to the umbo so as to couple vibration of the transducer to the umbo.

31. The device of claim 30 wherein the mass is positioned on the support to align the mass with the malleus away from the umbo when the support is placed against the eardrum.

32. The device of claim 29 wherein the movement of the transducer is no more than about 75% of the movement of the umbo and wherein the movement of the umbo is at least about 25% more than the first movement of the transducer.

33. The device of claim 32 wherein the movement of the transducer is no more than about 67% of the movement of the umbo and wherein the movement of the umbo is at least about 50% more than the movement of the transducer.

34. The device of claim 29 further comprising a mass, wherein the transducer is disposed between the mass and the support.

35. The device of claim 29 wherein the support is shaped to the eardrum of the user to position the support on the eardrum in a pre-determined orientation and wherein the transducer is positioned on the support to align the transducer with a malleus of the user with the eardrum disposed between the malleus and the support when the support is placed on the eardrum.

36. The device of claim 35 wherein the support comprises a shape from a mold of the eardrum of the user.

37. The device of claim 35 wherein the transducer is positioned on the support to place the transducer away from a tip of the malleus when the support is placed on the eardrum.

38. The device of claim 35 wherein the transducer is positioned on the support to align the transducer with the lateral process of the malleus with the eardrum disposed between the lateral process and the support when the support is placed on the eardrum.

39. The device of claim 38 wherein the support comprises a rigid material configured to extend from the transducer toward the lateral process to move the lateral process opposite the mass.

40. The device of claim 29 wherein the transducer comprises at least one of a piezoelectric transducer, a magnetostrictive transducer, a photostrictive transducer, a coil or a magnet.

41. The device of claim 40 wherein the transducer comprises the piezoelectric transducer and wherein the piezoelectric transducer comprises a cantilevered bimorph bender, the cantilevered bimorph bender having a first end anchored to the support and a second end attached to a mass to drive the mass opposite the lateral process when the support is placed on the eardrum.

42. The device of claim 41 further comprising:

the mass coupled to the piezoelectric transducer; and circuitry coupled to the transducer to drive the transducer, the mass and the circuitry supported with the eardrum when the support is placed on the ear;

wherein the support, the transducer, the mass and the circuitry comprise a combined mass of no more than about 60 mg.

43. The device of claim 42 wherein the support, the circuitry, the mass, and the piezoelectric transducer comprise a combined mass of no more than about 40 mg.

44. The device of claim 43 wherein the support, the circuitry, the mass, and the piezoelectric transducer comprise a combined mass of no more than about 30 mg.

45. A device configured for non-surgical placement through an ear canal to transmit an audio signal to a user, the user having an ear comprising an eardrum, the device comprising:

a first transducer;

a second transducer; and a support configured and shaped to: 1) be positioned along at least a portion of a lateral surface of the eardrum, and 2) support the first transducer and the second transducer along the lateral surface of the eardrum to face the ear canal when the support is placed along and against the lateral surface of the eardrum, the first transducer positioned on the support to align with a first side of the malleus, the second transducer positioned on the support to align with a second side of the malleus.

46. The device of claim 45 wherein the first transducer is positioned on the support to align with the first side of the malleus and the second transducer is positioned on the support to align with the second side of the malleus which is opposite the first side of the malleus.

47. The device of claim 45 wherein the support comprises a first protrusion extending to the first transducer to align the first transducer with the first side of the malleus and a second protrusion extending to the second transducer to align the second transducer with the second side of the malleus.

48. The device of claim 45 wherein the first transducer and second transducer are positioned on the support and configured to twist the malleus with a first rotation about an elongate longitudinal axis of the malleus when the first transducer and second transducer move in opposite directions.

49. The device of claim 48 wherein the first transducer and second transducer are positioned on the support and configured to rotate the malleus with a second hinged rotation when the first transducer and second transducer move in similar directions.

50. The device of claim 45 further comprising circuitry coupled to the first transducer and the second transducer, the circuitry configured to generate a first signal to drive the transducer and a second signal to drive the second transducer.

51. The device of claim 50 wherein the circuitry is configured to generate the first signal at least partially out of phase with the second signal and drive the malleus with a twisting motion.

52. The device of claim 50 wherein the circuitry is configured to drive the first transducer substantially in phase with the second transducer at a first frequency below about 1 kHz and wherein the circuitry is configured to drive the first transducer at least about ten degrees out of phase with the second transducer at a second frequency above at least about 2 kHz.

53. The device of claim 50 wherein the first transducer comprises at least one of a first piezoelectric transducer, a first coil and magnet transducer, a first magnetostrictive transducer or a first photostrictive transducer and wherein the second transducer comprises at least one of a second piezoelectric transducer, a second coil and magnet transducer, a second magnetostrictive transducer or a second photostrictive transducer.

* * * * *